US007533961B2

(12) United States Patent
Kikuchi et al.

(10) Patent No.: US 7,533,961 B2
(45) Date of Patent: May 19, 2009

(54) IMAGING METHOD AND IMAGE FORMING APPARATUS

(75) Inventors: Naoki Kikuchi, Kanagawa (JP); Takashi Kimura, Kanagawa (JP); Shigetoshi Hosaka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/901,651

(22) Filed: Sep. 18, 2007

(65) Prior Publication Data

US 2008/0068412 A1 Mar. 20, 2008

(30) Foreign Application Priority Data

Sep. 19, 2006 (JP) ..... 2006-252954
Mar. 15, 2007 (JP) ..... 2007-067094

(51) Int. Cl.
*B41J 2/15* (2006.01)
*B41J 2/145* (2006.01)

(52) U.S. Cl. ..... 347/41; 15/43

(58) Field of Classification Search ..... 347/9, 347/12, 15, 40–43
See application file for complete search history.

(56) References Cited

U.S. PATENT DOCUMENTS 6,217,149 B1 * 4/2001 Takagi et al. ..... 347/41
6,328,400 B1 * 12/2001 Yonekubo et al. ..... 347/15
6,923,520 B2 8/2005 Oikawa et al.
2006/0181562 A1 8/2006 Hirano et al.
2007/0064031 A1 3/2007 Nakano et al.
2007/0085869 A1 4/2007 Hirano et al.
2007/0091135 A1 4/2007 Hosaka et al.
2007/0106962 A1 5/2007 Sakakibara et al.

FOREIGN PATENT DOCUMENTS

JP 2000-52597 2/2000
JP 2002-96455 4/2002
JP 3507415 12/2003
JP 2004-268260 9/2004
JP 2004-339331 12/2004
JP 2005-1221 1/2005
JP 2006-142731 6/2006
JP 2006-281767 10/2006

OTHER PUBLICATIONS

Kuga, Shigenori. "Development and application of dynamic scanning absorptometer". *Japan Tappi Journal*, vol. 48, May 1994, pp. 88-92.
U.S. Appl. No. 11/724,355, filed Mar. 14, 2007.

* cited by examiner

*Primary Examiner*—Thinh H Nguyen
(74) *Attorney, Agent, or Firm*—Cooper & Dunham, LLP.

(57) ABSTRACT

An imaging method is disclosed that is implemented in an image forming apparatus for forming a tone pattern on a recording medium by forming an arrangement of dots on the recording medium. The arrangement of dots is formed on the recording medium by jetting a recording liquid from a recording head while moving the recording head in a main scanning direction a plurality of times and intermittently conveying the recording medium in a sub-scanning direction that perpendicularly intersects the main scanning direction. The imaging method involves forming the arrangement of dots such that dots belonging to a first group that are consecutively aligned in a base tone direction and dots belonging to a second group that are consecutively aligned in the sub scanning direction are respectively formed in non-consecutive order on the recording medium.

13 Claims, 25 Drawing Sheets

FIG.13A

| | |
|---|---|
| 16 | 8 |
| 7 | 15 |
| 14 | 6 |
| 5 | 13 |
| 12 | 4 |
| 3 | 11 |
| 10 | 2 |
| 1 | 9 |

MASK PATTERN

| | | | | | | | |
|---|---|---|---|---|---|---|---|
| 16 | 8 | 16 | 8 | 16 | 8 | 16 | 8 |
| 7 | 15 | 7 | 15 | 7 | 15 | 7 | 15 |
| 14 | 6 | 14 | 6 | 14 | 6 | 14 | 6 |
| 5 | 13 | 5 | 13 | 5 | 13 | 5 | 13 |
| 12 | 4 | 12 | 4 | 12 | 4 | 12 | 4 |
| 3 | 11 | 3 | 11 | 3 | 11 | 3 | 11 |
| 10 | 2 | 10 | 2 | 10 | 2 | 10 | 2 |
| 1 | 9 | 1 | 9 | 1 | 9 | 1 | 9 |

FIG.13B

| | |
|---|---|
| 8 | 16 |
| 7 | 15 |
| 6 | 14 |
| 5 | 13 |
| 4 | 12 |
| 3 | 11 |
| 2 | 10 |
| 1 | 9 |

MASK PATTERN

| | | | | | | | |
|---|---|---|---|---|---|---|---|
| 8 | 16 | 8 | 16 | 8 | 16 | 8 | 16 |
| 7 | 15 | 7 | 15 | 7 | 15 | 7 | 15 |
| 6 | 14 | 6 | 14 | 6 | 14 | 6 | 14 |
| 5 | 13 | 5 | 13 | 5 | 13 | 5 | 13 |
| 4 | 12 | 4 | 12 | 4 | 12 | 4 | 12 |
| 3 | 11 | 3 | 11 | 3 | 11 | 3 | 11 |
| 2 | 10 | 2 | 10 | 2 | 10 | 2 | 10 |
| 1 | 9 | 1 | 9 | 1 | 9 | 1 | 9 |

FIG.13C

| | |
|---|---|
| 8 | 16 |
| 7 | 15 |
| 14 | 6 |
| 13 | 5 |
| 12 | 4 |
| 3 | 11 |
| 2 | 10 |
| 1 | 9 |

MASK PATTERN

| | | | | | | | |
|---|---|---|---|---|---|---|---|
| 8 | 16 | 8 | 16 | 8 | 16 | 8 | 16 |
| 7 | 15 | 7 | 15 | 7 | 15 | 7 | 15 |
| 14 | 6 | 14 | 6 | 14 | 6 | 14 | 6 |
| 13 | 5 | 13 | 5 | 13 | 5 | 13 | 5 |
| 12 | 4 | 12 | 4 | 12 | 4 | 12 | 4 |
| 3 | 11 | 3 | 11 | 3 | 11 | 3 | 11 |
| 2 | 10 | 2 | 10 | 2 | 10 | 2 | 10 |
| 1 | 9 | 1 | 9 | 1 | 9 | 1 | 9 |

FIG.14

| | | | |
|---|---|---|---|
| 24 | 32 | 8 | 16 |
| 7 | 15 | 23 | 31 |
| 22 | 30 | 6 | 14 |
| 5 | 13 | 21 | 29 |
| 20 | 28 | 4 | 12 |
| 3 | 11 | 19 | 27 |
| 18 | 26 | 2 | 10 |
| 1 | 9 | 17 | 25 |

FIG.15

| | |
|---|---|
| 14 | 6 |
| 3 | 11 |
| 8 | 16 |
| 13 | 5 |
| 2 | 10 |
| 7 | 15 |
| 12 | 4 |
| 1 | 9 |

MASK PATTERN

| | | | | | | | |
|---|---|---|---|---|---|---|---|
| 14 | 6 | 14 | 6 | 14 | 6 | 14 | 6 |
| 3 | 11 | 3 | 11 | 3 | 11 | 3 | 11 |
| 8 | 16 | 8 | 16 | 8 | 16 | 8 | 16 |
| 13 | 5 | 13 | 5 | 13 | 5 | 13 | 5 |
| 2 | 10 | 2 | 10 | 2 | 10 | 2 | 10 |
| 7 | 15 | 7 | 15 | 7 | 15 | 7 | 15 |
| 12 | 4 | 12 | 4 | 12 | 4 | 12 | 4 |
| 1 | 9 | 1 | 9 | 1 | 9 | 1 | 9 |

IMAGING METHOD AND IMAGE FORMING APPARATUS

BACKGROUND

1.Technical Field

This disclosure relates to an imaging method for enabling high resolution image formation at high speed, an image forming apparatus that performs such an imaging method, and a computer-readable program that enables a computer to perform such imaging method.

2.Description of the Related Art

An inkjet recording apparatus is an image forming apparatus that uses one or more liquid jetting heads and may be used as a printer, a facsimile, a copier, or a multifunction copier having functions of a printer, facsimile, and copier, for example.

The inkjet recording apparatus forms (i.e. records, prints) images by discharging ink (i.e. recording liquid) from its recording head and onto the surface of a recording medium such as a sheet of paper some other medium on which recording liquid may be applied.

An image forming apparatus may be configured to form four different types (four tones) of dots, namely, "no dot", "small dot", "medium dot", and "large dot". However, such an image forming apparatus has limited capacity to form multiple tones with recording liquid droplets in different dot sizes.

Accordingly, techniques such as the dither method and the error diffusion method have been developed for reproducing halftones by combining density gradation (intensity modulation) of a lower level than that of the original image and area gradation (area modulation).

The dither method (binary dither method) uses the value of each matrix in a dither matrix as a threshold value, compares the value of the dither matrix with the density of a pixel of a corresponding coordinate, and determines whether to output 1 (print/illuminate at a target pixel) or 0 (no printing/illuminating at a target pixel), to thereby obtain a binarized image. This method can obtain binarized data for area gradation by simply comparing the input image data and the threshold values and can perform calculations at high speed.

One example of a halftone pattern used in a halftoning process of the dither method is an orderly linear base tone (e.g. diagonal line base tone).

On the other hand, a serial type (also referred to as a shuttle type or a serial scan type) inkjet recording apparatus forms images by moving a recording head mounted on a carriage in a main scanning direction (also referred to as "main scanning") and intermittently conveying a recording medium in a sub-scanning direction. More specifically, the serial type inkjet recording apparatus forms images by using a multi-pass method and an interlace method. In conducting the multi-pass method, a group of nozzles or different groups of nozzles scan the same area of the recording medium in the main scanning direction plural times, so that a high quality image can be formed. In conducting the interlace method, an image is formed by interlacing the same area by adjusting the amount of conveying the recording medium in the sub-scanning direction and moving the recording head in the main scanning direction plural times.

In forming an image by combining the multi-pass method and the interlace method, the arrangement order for recording dots (e.g. order of applying ink droplets, order of aligning ink droplets) can form a matrix. This arrangement of dots (matrix) is referred to as a mask pattern (also referred to as recording sequence matrix).

High quality images can be formed by utilizing the mask pattern. For example, in the inkjet recording apparatus disclosed in Japanese Laid-Open Patent Application No. 2002-96455, different groups of nozzles scan the same main scan recording area of the recording medium in the main scanning direction plural times. Moreover, the inkjet recording apparatus includes a part for forming a thinned out (pixel skipped) image in accordance with a thin-out mask pattern by scanning a recording area in the main scanning direction plural times and a recording duty setting part for dividing the same recording area in a sub-scanning direction at a predetermined pitch and setting recording duties with different values in accordance with the thin-out mask pattern with respect to each divided area.

In another example, Japanese Registered Patent No. 3507415 discloses a recording apparatus having a control part for using dot arrangement patterns corresponding to a level of quantized image data to form dots corresponding to the level of the image data on a printed medium. The control part is capable of periodically changing the plural dot arrangement patterns used for the same level of the image data, wherein the plural dot arrangement patterns used for the same level of the image data are such that within each period when the patterns are periodically used, the number of dots formed in each of the N rasters are equalized, whereas the number of dots formed in the M columns are equalized, and P, N, and M are each an integral equal to or larger than 2. The plural dot arrangement patterns periodically used for the same level of the image data are such that within each period when the patterns are repeatedly used, when the dots formed using at least one of the plural dot arrangement patterns are shifted at least two pixels in the main-scanning direction, a variation in the ratio of a printing surface of the printing medium which corresponds to a printing range for the dot arrangement pattern occupied by a surface on which dots are formed using the plural dot arrangement patterns is limited to 10% or less.

In yet another example, Japanese Laid-Open Patent Application No. 2005-001221 discloses an inkjet recording apparatus using a halftone process mask in which a linear base tone of a halftone pattern forms dots that always synchronize with the dots formed by performing a combination of multi-passing and interlacing with a serial head.

Conventionally, in a case of forming halftones with a linear base tone, the impact points where the droplets contact the recording medium tend to vary for each tone. This leads to reduction of image quality due to problems such as uneven printing results and banding.

Even with the above-described apparatuses disclosed in Japanese Laid-Open Patent Application No. 2002-96455 and Japanese Registered Patent No. 3507415, the impact points tend to vary as the mask pattern becomes larger, and uneven printing results and banding may not be adequately prevented. Thus, the problems related to use of a linear base tone in a halftone process are not adequately solved by the above disclosed techniques.

In view of such problems, various image processing methods have been contemplated for preventing image degradation even when halftone processing using a linear base tone and multi-pass printing are combined.

For example, a technique has been proposed that involves forming dots aligned in a base tone direction with non-consecutive passes to reduce image degradation caused by uneven printing results and banding.

However, in the above technique, only the dispersity of dots in the base tone direction is taken into consideration and the dispersity of dots in the sub scanning direction is not taken into consideration.

Therefore, according to the above technique, although dot dispersity in the base tone direction may be decreased, problems related to dot dispersity in the sub scanning direction are not addressed. Thus, dot dispersity in the vertical direction may be increased, and lines and unevenness may be created in the vertical direction, for example.

SUMMARY

In an aspect of this disclosure, there is provided an imaging method for achieving higher image quality in forming an image by combining halftone processing using a linear base tone and multi-pass printing, a computer-readable program enabling a computer to perform such an imaging method, and an image forming apparatus having means for executing such an imaging method.

According to another aspect, an imaging method is provided for forming a tone pattern on a recording medium by forming an arrangement of dots on the recording medium, the arrangement of dots being formed on the recording medium by jetting a recording liquid from a recording head while moving the recording head in a main scanning direction a plurality of times and intermittently conveying the recording medium in a sub-scanning direction that perpendicularly intersects the main scanning direction, the method involving: forming the arrangement of dots such that more than one of the dots belonging to a first group that are consecutively aligned in a base tone direction are formed in non-consecutive order on the recording medium and more than one of the dots belonging to a second group that are consecutively aligned in the sub scanning direction are formed in non-consecutive order on the recording medium.

According to another aspect, an image forming apparatus that includes a control part for executing the above-mentioned imaging method is provided.

According to another aspect, a computer-readable program is provided, which program, when executed by a computer, causes the computer to perform the above-mentioned imaging method.

BRIEF DESCRIPTION OF THE DRAWINGS

FIGS. 13A-13C are diagrams illustrating exemplary mask patterns and their corresponding dot arrangement order;

FIG. 14 is a diagram illustrating another exemplary mask pattern according to an embodiment of the present invention;

FIG. 15 is a diagram illustrating another exemplary mask pattern according to an embodiment of the present invention and a corresponding dot arrangement order;

DESCRIPTION OF THE PREFERRED EMBODIMENTS

In the following, preferred embodiments of the present invention are described with reference to the accompanying drawings. However, it is noted that the following preferred embodiments are merely illustrative examples and the present invention is by no way limited to these embodiments.

First, an exemplary image forming apparatus is described that outputs image data generated by image processing operations based on an imaging method according to an embodiment of the present invention.

Figure 1:
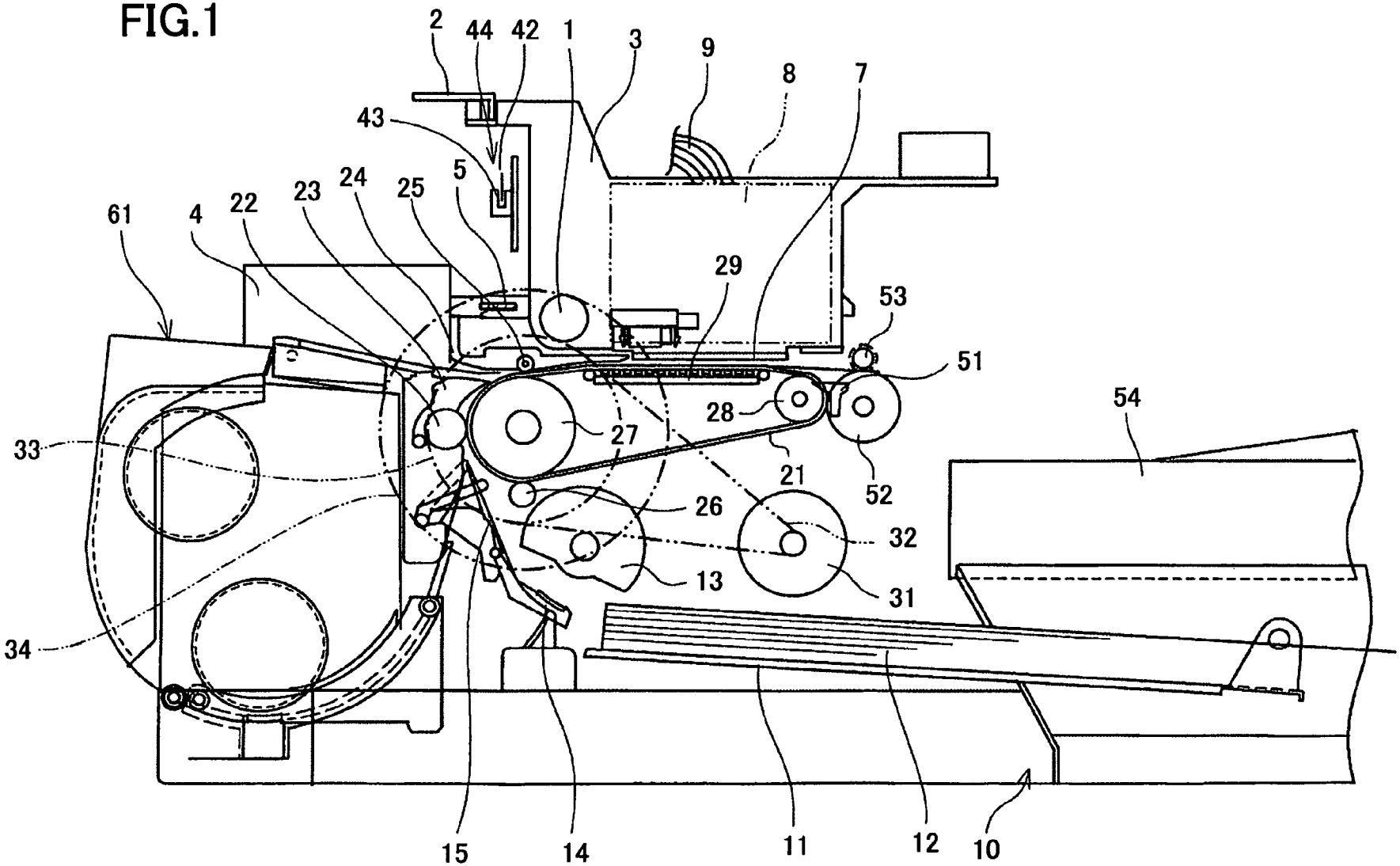
FIG. 1 is a side elevational view of mechanical parts of an exemplary image forming apparatus that outputs image data generated using an imaging method according to an embodiment of the present invention.
Figure 2:
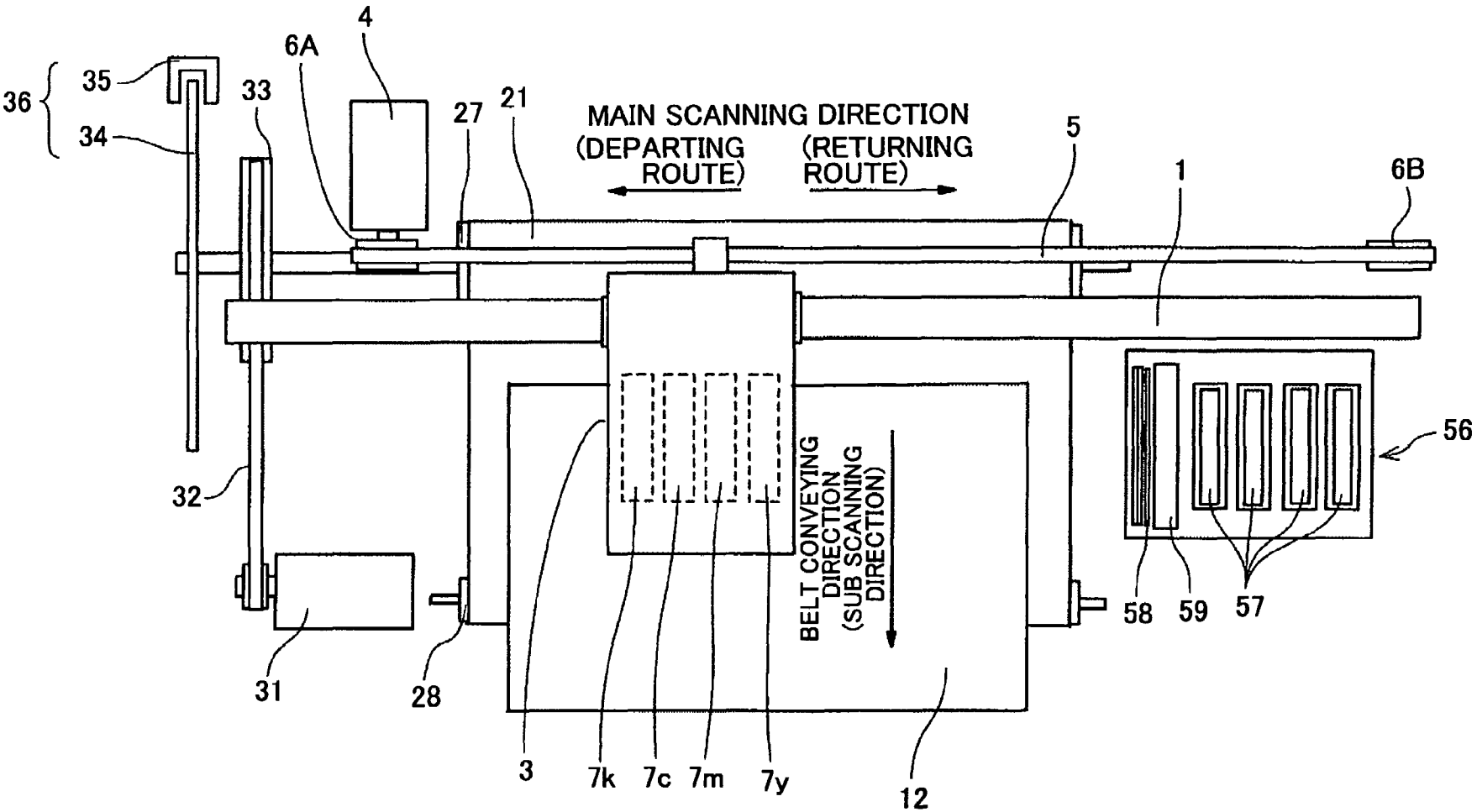
FIG. 2 is a plan view of the mechanical parts of the image forming apparatus shown in FIG. 1.

The image forming apparatus is described below with reference to FIGS. 1 and 2, where FIG. 1 is a side view and FIG. 2 is a plan view of the image forming apparatus.

The illustrated image forming apparatus has guide members including a guide rod 1 and a guide rail 2. The guide rod 1 and the guide rail 2 are mounted in traversed positions between left and right side boards (not shown) of the image forming apparatus. The guide rod 1 and the guide rail 2 hold a carriage 3 so that the carriage 3 can slide in the main scanning direction. A main scanning motor 4 drives the sliding movement of the carriage 3 via a timing belt 5 stretched between a driving pulley 6A and a driven pulley 6B. Thereby, the carriage 3 is able to travel (scan) in the arrow directions shown in FIG. 2 (main scanning direction).

The carriage 3 has a recording head (liquid jetting head) 7 including, for example, four recording head parts 7*y*, 7*c*, 7*m*, and 7*k* for jetting ink droplets of yellow (Y), cyan (C), magenta (M), and black (K), respectively. The recording head 7 having plural ink jetting holes aligned in a direction perpendicular to the main scanning direction is attached to the carriage 3 so that ink droplets can be jetted downward therefrom.

The recording head 7 may include a pressure generating part that generates pressure used for jetting ink droplets from the recording head 7. For example, the pressure generating part may be a thermal actuator which utilizes the pressure changes of ink boiled by an electric heat converting element (e.g. heating resistor), a shape-memory alloy actuator which utilizes the changes of shape of an alloy in accordance with temperature, or an electrostatic actuator utilizing static electricity.

Furthermore, the recording head 7 is not limited to having plural recording head parts corresponding to each color. For example, the recording head 7 may have plural ink jetting nozzles for jetting ink of plural colors.

The carriage 3 also has a sub-tank 8 for supplying ink of each color to the recording head 7. The sub-tank 8 is supplied with ink from a main tank (i.e. ink cartridge, not shown) via an ink supplying tube(s) 9.

The image forming apparatus also includes a sheet feeding portion for feeding sheets of paper 12 stacked on a sheet stacking part 11 of a sheet feed cassette 10. The sheet feeding portion includes a separating pad 14 having a friction coefficient sufficient for separating sheets of paper 12 from the sheet stacking part and a sheet feeding roller 13 (in this example, a half moon shaped roller) for conveying the sheets of paper 12 one at a time from the sheet stacking part 11. The separating pad 14 is configured to urge the sheets in the direction toward the sheet feeding roller 13.

The paper 12 conveyed from the sheet feeding part is conveyed to an area below the recording head 7. In order to convey the paper 12 to the area below the recording head 7, the image forming apparatus is provided with a conveyor belt 21 that conveys the paper 12 by attracting the paper 12 with electrostatic force; a counter roller 22 and the conveyor belt 21 having the paper 12 delivered in between after receiving the paper 12 conveyed from the sheet feeding part via a guide 15; a conveyor belt guide 23 for placing the paper 12 flat on the conveyor belt 21 by changing the orientation of the paper 12 conveyed in a substantially upright (perpendicular) position by an angle of approximately 90 degrees; and a pressing member 24 for pressing a pressing roller 25 against the conveyor belt 21. Furthermore, the image forming apparatus includes a charging roller (charging part) 26 for charging the surface of the conveyor belt 21.

In this example, the conveyor belt 21 is an endless belt stretched between a conveyor roller 27 and a tension roller 28. A sub-scanning motor 31 rotates the conveyor roller 27 via a timing belt 21 and a timing roller 33 so that the conveyor belt 21 is rotated in the belt conveying direction shown in FIG. 2 (sub-scanning direction). It is to be noted that a guide member 29 is positioned at the backside of the conveyor belt 21 in correspondence with a target image forming area of the recording head 7. Furthermore, the charging roller 26 is positioned contacting the top surface of the conveyor belt 21 so that the charging roller 26 rotates in accordance with the rotation of the conveyor belt 21.

As shown in FIG. 2, the image forming apparatus also includes a rotary encoder 36. The rotary encoder 36 includes a slit disk 34 attached to a rotary shaft of the conveyor roller 27 and a sensor 35 for detecting a slit(s) formed in the slit disk 34.

The image forming apparatus also includes a sheet discharging portion for discharging the sheet of paper 12 onto which data are recorded by the recording head 7. The sheet discharging portion includes a separating claw 51 for separating the paper 12 from the conveyor belt 21, a first sheet discharging roller 53, a second sheet discharging roller 53, and a sheet discharge tray 54 for stacking the paper(s) 12 thereon.

Furthermore, a double-side sheet feeding unit (not shown) may be detachably attached to a rear portion of the image forming apparatus. By rotating the conveyor belt in the reverse direction, the paper 12 is delivered to the double-side sheet feeding unit so as to have the paper 12 flipped upside down. Then, the flipped paper 12 is conveyed back to the part between the counter roller 22 and the conveyor belt 21.

Furthermore, as shown in FIG. 2, a nozzle recovery mechanism 56 for maintaining/restoring the operating status of the nozzle(s) may be provided at a non-printing area toward one side (in this example, toward the back side) of the main scanning direction of the carriage 3.

The nozzle recovery mechanism 56 includes, for example, plural caps 57 for covering the surface of each of the nozzles of the recording head 7, a wiper blade 58 for wiping off residual ink from the surface of the nozzles, and an ink receptacle 59 for receiving accumulated ink that is jetted in a process of disposing of undesired ink.

Accordingly, with the image forming apparatus having the above-described configuration, sheets of paper 12 are separated and conveyed sheet by sheet from the sheet feeding part, then the separated conveyed paper 12 is guided to the part between the conveyor belt 21 and the counter roller 22 in an upright manner by the guide 15, and then the orientation of the conveyed paper is changed approximately 90 degrees by guiding the tip part of the paper with the conveyor guide 23 and pressing the paper 12 against the conveyor belt 21 with the pressing roller 25.

In this conveying operation, an AC bias supplying part of a control part (not shown) of the image forming apparatus alternately applies negative and positive alternate voltages to the charging roller 26 in accordance with an alternate charging pattern. Thereby, the conveyor belt 21 is alternately charged with negative and positive voltages at intervals of a predetermined width in accordance with the alternate charging pattern. When the paper 12 is conveyed onto the charged conveyor belt 21, the paper 12 is attracted to the conveyor belt 21 by electrostatic force. Thus held, the paper 12 is conveyed in the sub-scanning direction by the rotation of the conveyor belt 21.

Then, the recording head 7 jets ink droplets onto the paper 12 while the paper 12 is being moved in correspondence with the forward and backward movement of the carriage 3. After the recording head 7 records (prints) a single row by jetting ink in accordance with image signals, the paper 12 is further conveyed a predetermined distance for recording the next row. The recording operation of the recording head 7 is completed when a signal is received indicative of the completion of the recording operation or indicative of the rear end of the paper 12 reaching the edge of the recording area. After the completion of the recording operation, the paper is discharged to the discharge tray 54.

In a case of conducting double side printing, the paper 12 is flipped upside down after the recording of the front side (the side which is printed first) of the paper 12 is completed. The paper 12 is flipped so that the back side of the paper is the printing surface by rotating the conveyor belt 21 in reverse and delivering the paper 12 to the double side sheet feeding unit (not shown). Then, the flipped paper 12 is conveyed to the part between the counter roller 22 and the conveyor belt 21. After the paper 12 is placed on the conveyor belt 21, the recording head 7 conducts the above-described recording operation on the back side of the paper 12. After the recording operation is completed, the paper 12 is discharged to the discharge tray 54.

In a case where the image forming apparatus is standing by to conduct a printing (recording) operation, the carriage 3 is moved toward the recovery mechanism 56. The cap 57 covers the nozzle side of the recording head 7 to keep the nozzles moist. This prevents poor jetting performance caused by dried ink. Furthermore, where the cap covers the nozzle side of the recording head 7, a recovery operation may be performed by suctioning accumulated viscous ink (recording liquid) from the nozzles and ejecting the ink and bubbles. Then, the wiper blade 58 wipes off the ink that has adhered to the nozzle side of the recording head 7 during the recovery operation. Furthermore, an empty jetting (idling) operation that is irrelevant to a printing operation may be performed in which ink is jetted, for example, prior to a recording operation or during the recording operation.

Figure 3:
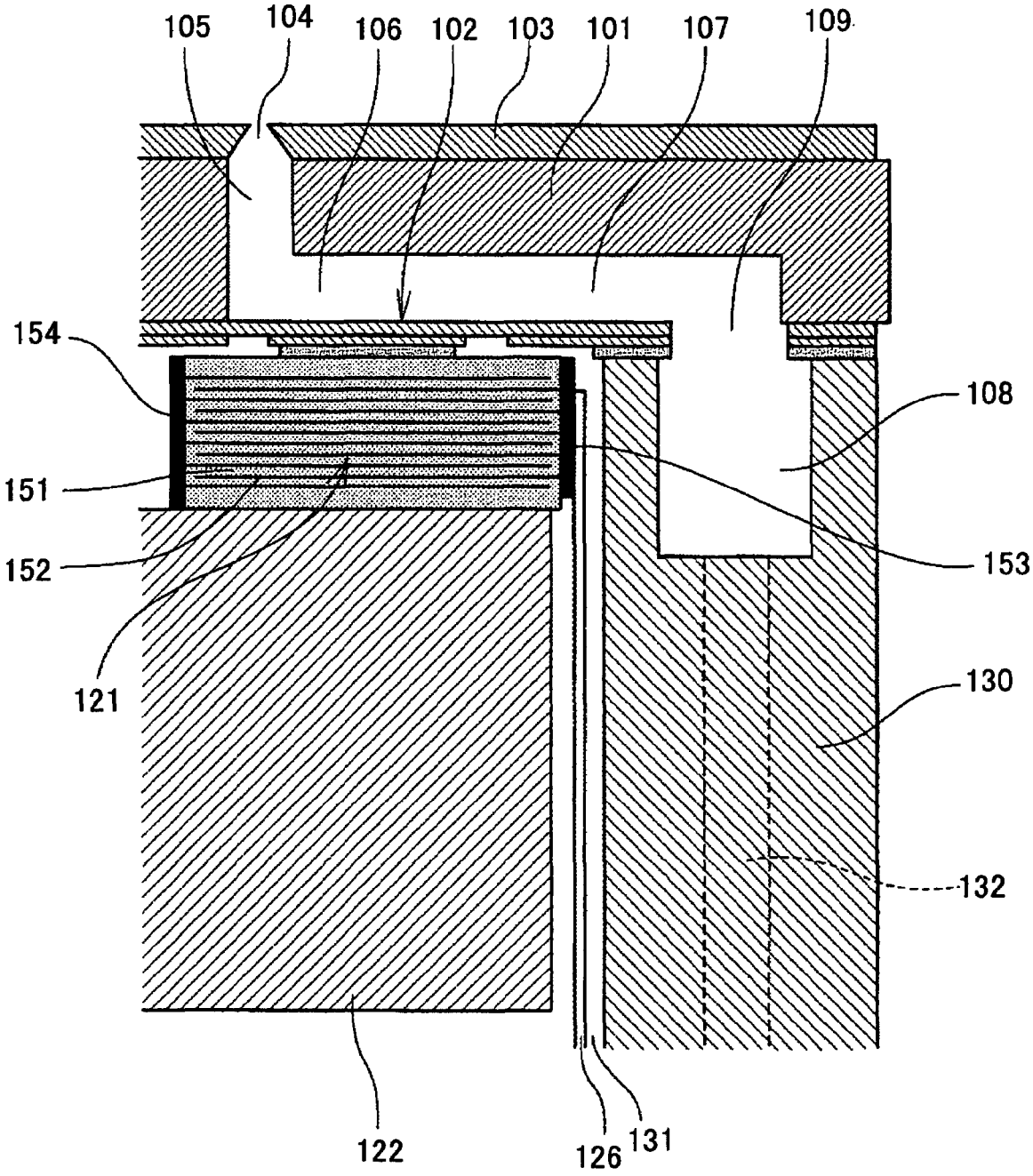
FIG. 3 is a cross-sectional view of an exemplary recording head of the exemplary image forming apparatus taken along the length of a liquid chamber.
Figure 4:
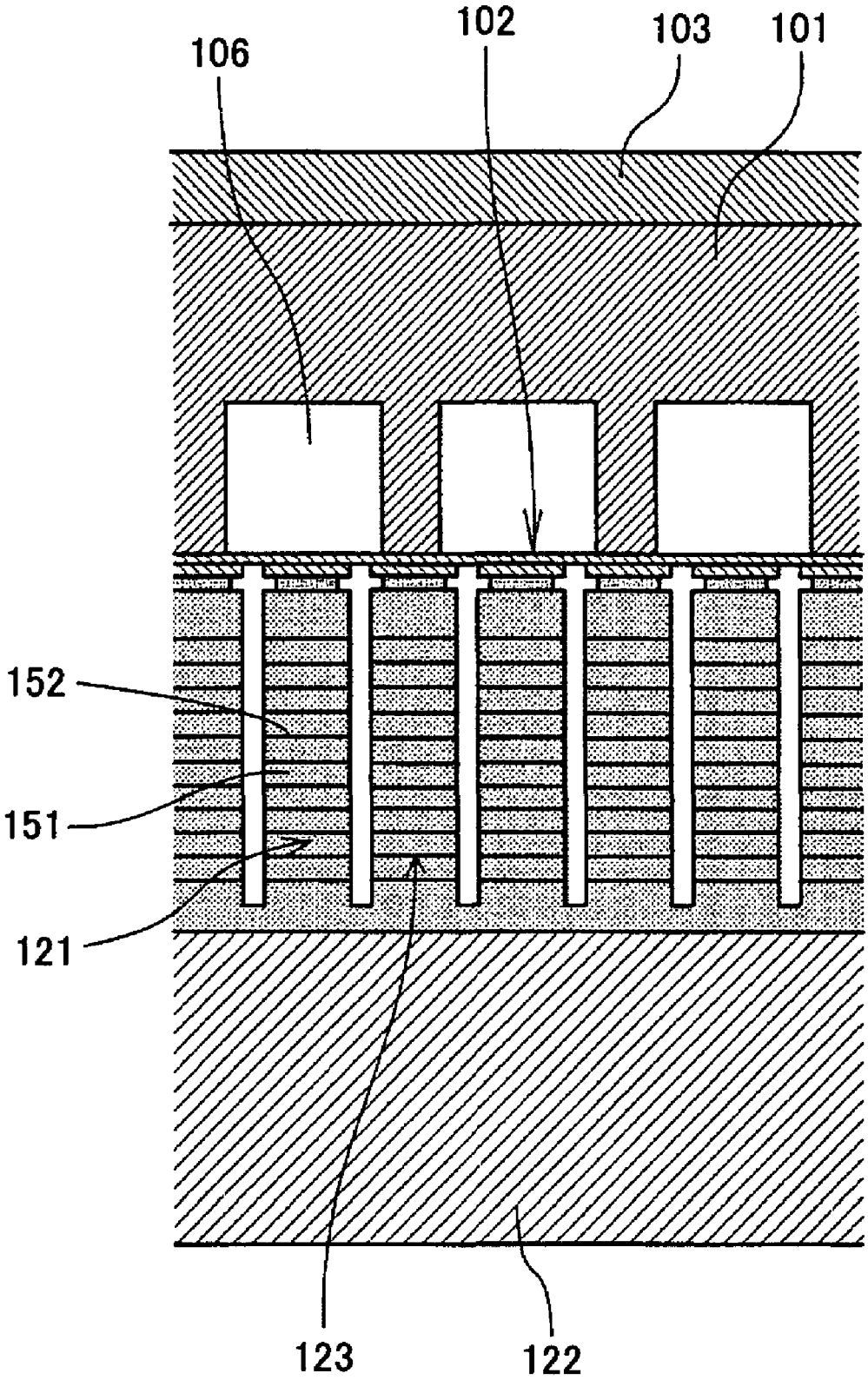
FIG. 4 is a cross-sectional view of the exemplary recording head taken along the width of the liquid chamber.

Next, an example of a recording head part included in the recording head 7 is described with reference to FIGS. 3 and 4. FIG. 3 is a cross-sectional view along a longitudinal direction of a liquid chamber of the recording head 7. FIG. 4 is a cross-sectional view along a lateral direction of the liquid chamber of the recording head 7.

The recording head 7 includes a layered structure formed by bonding together a flow plate 101 (for example, formed by performing anisotropic etching on a single crystal silicon substrate), a vibration plate 102 (for example, formed by performing electroforming on a nickel plate) provided on a lower surface of the flow plate 101, and a nozzle communication path 103 provided on an upper surface of the flow plate 101. This layered structure is formed with, for example, a nozzle communication path 105 in flow communication with the nozzle(s) 104 of the recording head 7, a liquid chamber 106 serving as a pressure generating chamber, a common liquid chamber 108 for supplying ink to the liquid chamber 106 via a fluid resistance part (supply path) 107, and an ink supply port 109 in flow communication with the common liquid chamber 108.

Furthermore, the recording head 7 includes two rows (although only one row is illustrated in FIG. 3) of layered structure type piezoelectric elements (also referred to as "pressure generating part" or "actuator part") 121 for applying pressure to the ink inside the liquid chamber 106 by deforming the vibration plate 102, and a base substrate 122 affixed to the piezoelectric elements 121. It is to be noted that plural pillar parts 123 are formed in-between the piezoelectric elements 121. Although the pillar parts 123 are formed at the same time of forming the piezoelectric elements 121 when cutting a base material of the piezoelectric element 121, the pillar parts 123 simply become normal pillars since no drive voltage is applied thereto.

Furthermore, the piezoelectric element 121 is connected to an FPC cable 126 on which a driving circuit (driving IC, not shown) is mounted.

The peripheral portions of the vibration plate 102A are bonded to a frame member 130. The frame member 130 is fabricated to form a void portion 131 for installing an actuator unit (including, for example, the piezoelectric element 121, the base substrate 122) therein, a concave part including the common liquid chamber 108, and an ink supply hole 132 for supplying ink from the outside to the common liquid chamber 108. The frame member 130 is fabricated by injection molding with use of, for example, a thermal setting resin (e.g. epoxy type resin) or polyphenylene sulfate.

The flow plate 101 is fabricated to form various concave parts and hole parts including the nozzle communication path 105 and the liquid chamber 106. The flow plate 101 is fabricated, for example, by using an anisotropic etching method in which an alkali type etching liquid (e.g. potassium hydroxide, KOH) is applied to a single crystal silicon substrate having a crystal plane orientation of (110). It is however to be noted that other materials may be used for fabricating the flow substrate 101 besides a single crystal silicon substrate. For example, a stainless steel substrate or a photosensitive resin may also be used.

The vibration plate 102 is fabricated, for example, by performing an electroforming method on a metal plate formed of nickel. It is however to be noted that other metal plates or a bonded member formed by bonding together a metal plate and a resin plate may also be used. The piezoelectric elements 121 and the pillar parts 123, and the frame member 130 are bonded to the vibration plate 102 by using an adhesive agent.

The nozzle plate 103 is formed with nozzles 104 having diameters ranging from 10 μm-30 μm in correspondence with the sizes of respective liquid chambers 106. The nozzle plate 103 is bonded to the flow plate 101 by using an adhesive agent. The nozzle plate 103 includes, for example, a metal material member having a water repellent layer formed on its outermost surface.

The piezoelectric element (in this example, PZT) 121 has a layered structure in which piezoelectric material 151 and internal electrodes 152 are alternately layered on top of one another as shown in FIG. 4. The internal electrodes 152, which are alternately extended to the side edge planes of the piezoelectric element 121, are connected to an independent electrode 153 and a common electrode 154. In this example, the pressure is applied to the ink in the liquid chamber 106 by using a piezoelectric constant d33 material for the piezoelectric material 151. It is however to be noted that pressure may also be applied to the ink in the liquid chamber 106 by using a piezoelectric constant d31 material for the piezoelectric material 151. Furthermore, a single row of piezoelectric elements 121 may be provided in correspondence with a single base substrate 121.

Accordingly, in a case of jetting ink (recording liquid) from the nozzles 104 of the above-described recording head 7, the piezoelectric element 121 is contracted by lowering the voltage applied to the piezoelectric element 121 to a voltage below a reference electric potential. Thereby, the volume of the liquid chamber 106 increases as the vibration plate 102 is lowered in correspondence with the contraction of the piezoelectric element 121. Then, ink flows into the liquid chamber 106. Then, the voltage applied to the piezoelectric element is raised so that the piezoelectric element 121 expands in the layered direction of the piezoelectric element 121. Thereby, the volume of the liquid chamber 106 decreases as the vibration plate 102 deforms in a manner protruding toward the nozzle 104 in correspondence with the expansion of the piezoelectric element 121. As a result, pressure is applied to the ink inside the liquid chamber 106, thereby jetting ink out from the nozzle 104.

Then, the position of the vibration plate 102 returns to its original position by lowering the voltage applied to the piezoelectric element 121 to the reference electric potential. As the vibration plate 102 returns to the original position, the liquid chamber 106 expands to create a negative pressure in the liquid chamber 106. The negative pressure in the liquid chamber 106 allows ink to be supplied into the liquid chamber 106 from the common liquid chamber 108. The recording operation of the recording head 7 moves on to the next ink jetting process after the vibration of the meniscus face of the nozzle 104 attenuates and becomes stable.

It is to be noted that the method of driving the recording head 7 is not limited to the above-described example (pull/push method). For example, a pull method or a push method may be employed by controlling the drive waveform applied to the recording head 7.

Next, an example of a control part 200 of the image forming apparatus is described with reference to FIG. 5.

Figure 5:
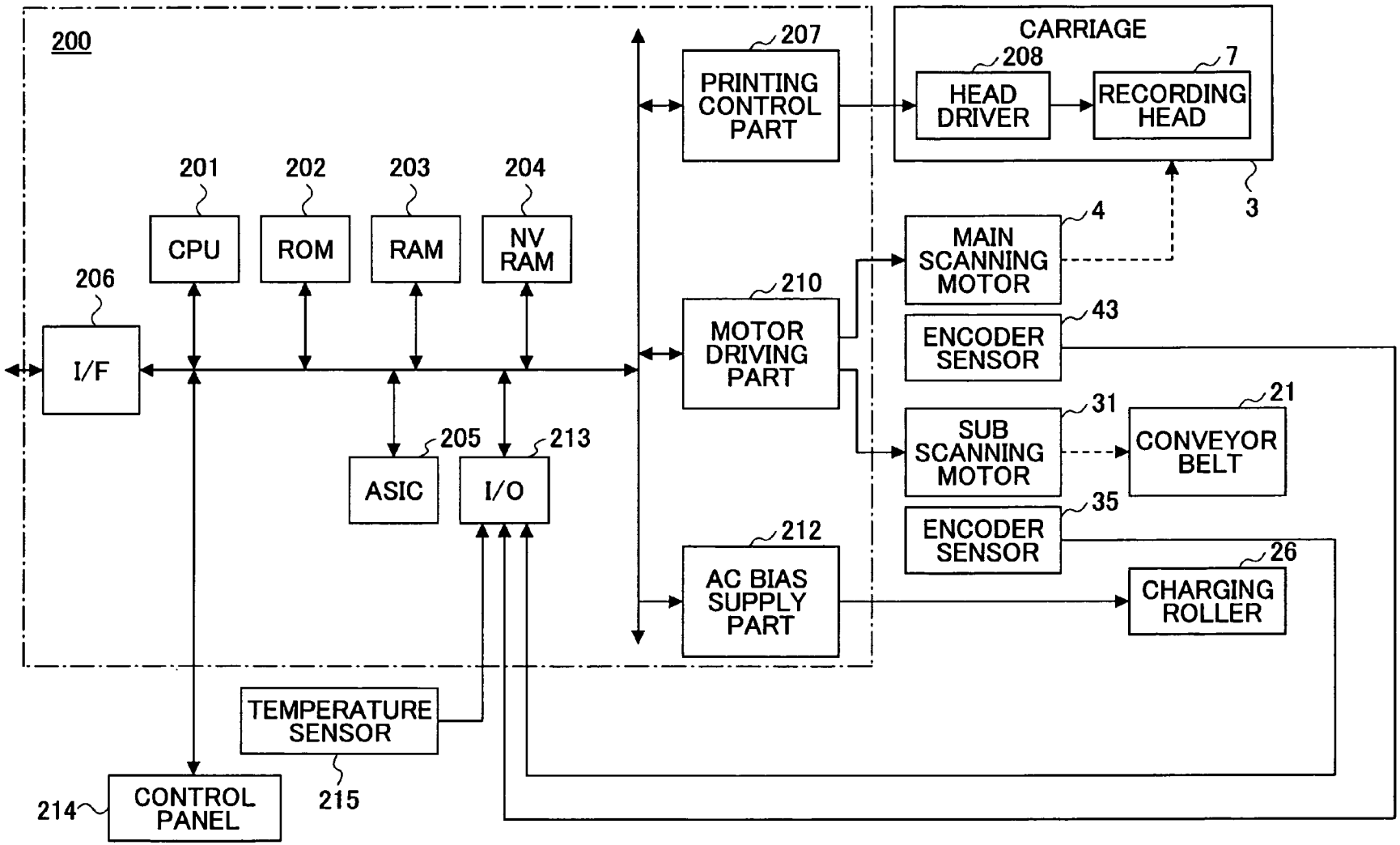
FIG. 5 is a block diagram illustrating an exemplary control part of the exemplary image forming apparatus.

The control part 200 of FIG. 5 includes, for example, a CPU 201 for overall control of the image forming apparatus, a ROM 202 for storing programs executed by the CPU 211 and other data, a RAM for temporarily storing image data and the like, a rewritable non-volatile memory 204 for maintaining data when the power of the image forming apparatus is turned off, and an ASIC 205 for processing various signals corresponding to image data, input/output signals for performing image processing, and controlling various parts of the image forming apparatus.

The control part 200 further includes, for example, an I/F 206 for exchanging data and signals with the host, a printing control part 207 including a data transfer part and a drive waveform generating part for controlling the recording head 7, a head driver (driver IC) 208 for driving the recording head 7 provided on the carriage 3, a motor driving part 210 for driving the main scanning motor 4 and the sub-scanning motor 31, an AC bias supply part 212 for supplying AC bias to the charge roller 34, and an I/O 213 for receiving various detection signals from the encoder sensors 43, 35, the temperature sensor 215, and other sensors.

The control part 200 is connected to a control panel 214 for inputting data to the image forming apparatus and displaying data.

The control part 200 receives data such as image data from the host side at the I/F 206 via a cable or a network (e.g., the Internet). The host side is connected to, for example, an information processing apparatus (e.g., a personal computer), an image reading apparatus (e.g., an image scanner) and/or a photographing apparatus (e.g., a digital camera).

The CPU 201 of the control part 200 reads out and analyzes the image data (printing data) stored in a reception buffer of the I/F 206. Then, the ASIC 205 performs various processes on the image data such as image processing and data rearrangement. Then, the processed image data are transferred from the printing control part (head drive control part) 207 to the head driver 208. It is to be noted that the generation of dot patterns for outputting images is conducted in the printer driver of the host side (described below).

The printer control part 207 transfers image data in the form of serial data to the head driver 208. In addition, the printer control part 207 outputs transfer clocks (required for transferring the image data), latch signals, and droplet control signals (mask signals) to the head driver 208. The printer control part 207 has a drive waveform generating part including a D/A converter for performing D/A conversion on pattern data of drive signals stored in the ROM 202 and a drive waveform selecting part for selecting the waveform to be output to the head driver 208. Accordingly, the printer control part 207 generates drive waveforms including one or more drive pulses (drive signals) and outputs the drive waveforms to the head driver 208.

The head driver 208 applies drive signals included in the waveforms output from the printer control part 207 to a driving element (e.g. the above-described piezoelectric element 121). The driving element generates energy for enabling ink droplets to be selectively jetted from the recording head 7. The head driver 208 applies the drive signals based on serially input image data corresponding to a single line of the recording head 7. By selecting the drive pulse included in the drive waveform, ink droplets of different sizes including large droplets (large dots), medium droplets (medium dots), and small droplets (small dots) can be jetted from the recording head 7.

The CPU 201 calculates the drive output value (control value) for controlling the main scanning motor 4 and drives the main scanning motor 4 via the motor driving part 210 in accordance with the calculated value. The calculation of the CPU 201 is based on the detected speed value and the detected position value obtained by sampling the detection pulses of the encoder sensor 43 (i.e. linear encoder) and the target speed value and the target position value stored beforehand in a speed/position profile.

In the same manner, the CPU 201 calculates the drive output value (control value) for controlling the sub-scanning motor 31 and drives the sub-scanning motor 31 via the motor driving part 210 in accordance with the calculated value. The calculation of the CPU 201 is based on the detected speed value and the detected position value obtained by sampling the detection pulses of the encoder sensor 35 (i.e. rotary encoder) and the target speed value and the target position value stored beforehand in a speed/position profile.

Next, an image processing apparatus and an image forming apparatus that includes a computer-readable program for enabling a computer to execute the imaging method according to the present embodiment are described.

Figure 6:
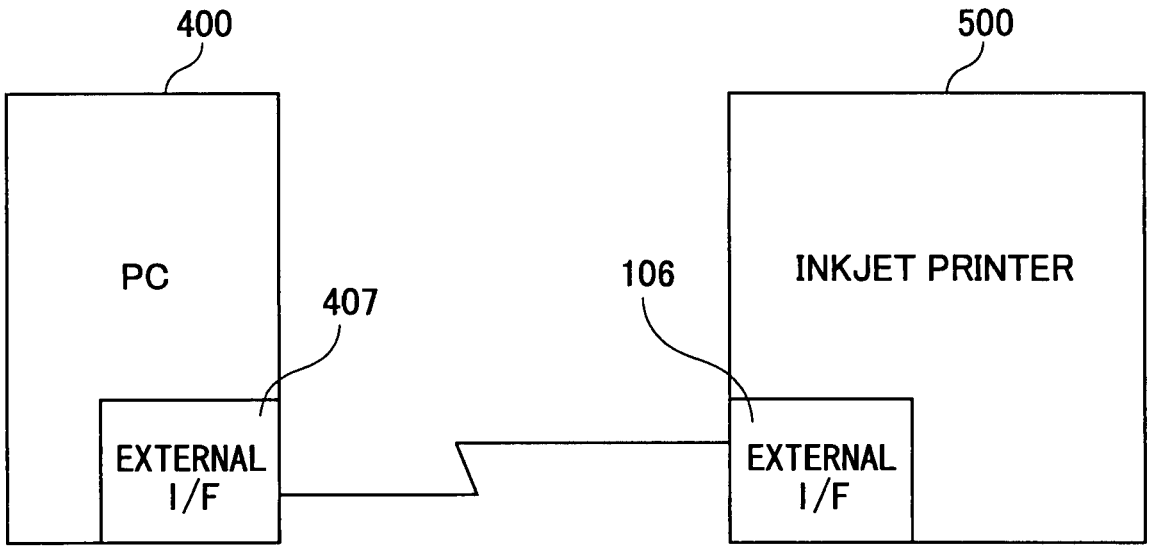
FIG. 6 is a block diagram illustrating an exemplary image forming system according to an embodiment of the present invention.

FIG. 6 is a diagram showing an exemplary image forming system according to an embodiment of the present invention that includes an inkjet printer (inkjet recording apparatus) 500 as a specific example of the above-described image forming apparatus.

In the illustrated image forming system (printing system), a personal computer (PC) as an image processing apparatus 400 and the inkjet printer (i.e. image forming apparatus) 500 are interconnected via a predetermined interface or a network. It is noted that one or more image processing apparatuses 400 may be connected to the image forming apparatus 500.

Figure 7:
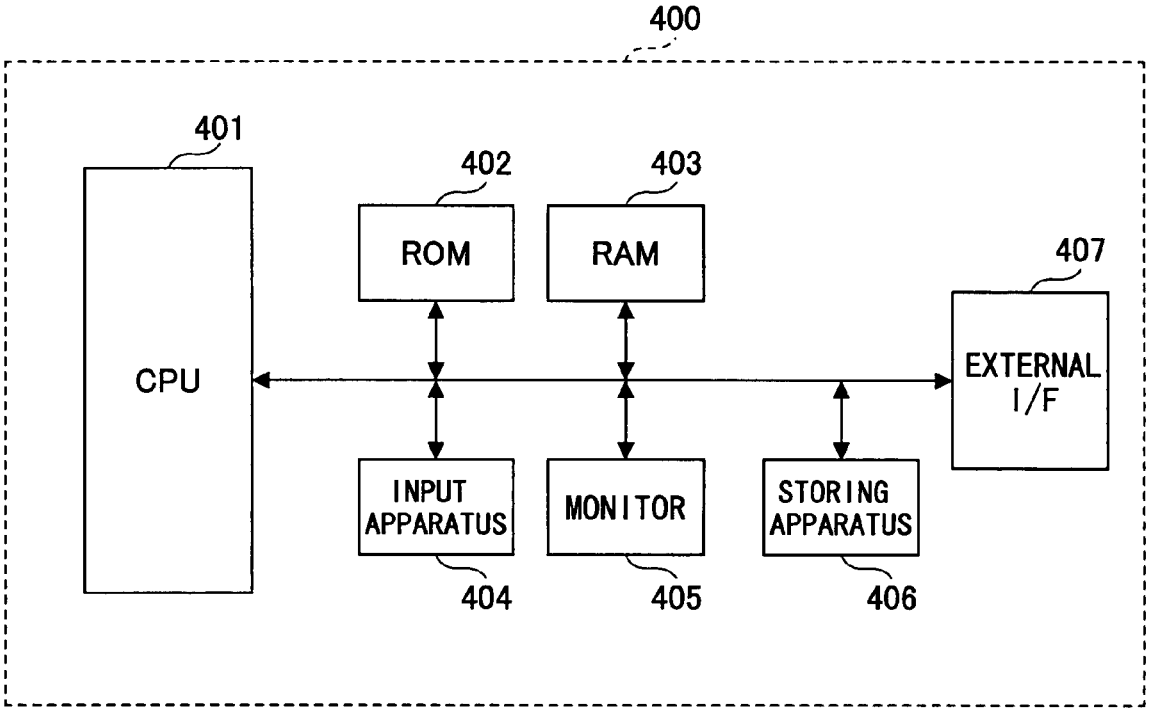
FIG. 7 is a block diagram illustrating an exemplary image processing apparatus of the exemplary image forming system.

As shown in FIG. 7, the image processing apparatus 400 has, for example, a CPU 401, a ROM 402, and a RAM 403 connected with a bus line. Furthermore, the bus line is also connected with a storing apparatus 406 including a magnetic storage (e.g. hard disk), an input apparatus 404 (e.g., a mouse, a keyboard), a monitor 405 (e.g., a LCD, a CRT), and a recording medium reading apparatus 408 that reads out data from a computer-readable recording medium (e.g., an optical disk). Moreover, the bus line is also connected with a predetermined interface (external I/F) 407 for transmitting and receiving data with outside networks (e.g., the Internet) and outside devices (e.g., a USB).

A program including an image processing program according to an embodiment of the present invention is stored in the storing apparatus 406 of the image processing apparatus 400. The image processing program may be installed in the storing apparatus 406 by reading out the program from a computer-readable recording medium 409 via the reading apparatus 408 or by downloading the program from an outside network (e.g., the Internet) via the external I/F 407. By installing the program in the storing apparatus 406, the image processing apparatus 400 can perform the below-described image processing method (image processing operation) according to an embodiment of the present invention. The program may operate on a given operating system (OS). Furthermore, the program may be part of a given application software package.

Next, an example of executing an image processing method of the present invention with the program installed in the image processing apparatus 400 is described with reference to FIG. 8.

This example is a case where most of the steps (processes) of the image processing method are conducted by the image processing apparatus (PC side) 400. This example is preferable when a relatively low cost inkjet printer is used.

A printer driver 411, which is included in the program installed in the image processing apparatus 400, performs various processes on image data obtained from, for example, an application software program. The printer driver 411 includes, for example, a CMM (Color Management Module) process part 412, a BG/UCR (Black Generation/Under Color Removal) process part 413, a γ correction process part 414, a halftone process part 415, a dot arrangement process part 416, and a rasterizing part 417. The CMM process part 412 is for converting the color space of the obtained image data from a color space for display on a monitor to a color space for image formation with an image forming apparatus, in other words, conversion from the RGB color system to the CMY color system. The BG/UCR process part 413 is for generating black or removing under color with respect to the values of C, M, and Y. The γ correction part 414 is for correcting input/output image data in accordance with the property of the image forming apparatus or the preferences of the user. The halftone process part 415 is for performing a halftone process on the image data. The dot arrangement part 416 is for displacing the arrangement of the dot pattern jetted from the image forming apparatus 500 in a predetermined order in accordance with the results of the halftone process (this process may be performed as part of the halftone process). The rasterizing part 417 is for converting the printing image data (dot pattern data) obtained by the halftone process and the dot arrangement process to image data corresponding to each position (location) of the nozzles of the image forming apparatus 500. As a result, the converted image data of the rasterizing part 417 is output to the image forming apparatus (inkjet printer 500).

Next, an example of conducting part of the steps (processes) of the image processing method with the image forming apparatus 500 is described with reference to FIG. 9. This example is preferable when a relatively high cost inkjet printer is used since the processes of the method can be executed at high speed.

The printer driver 421 in the image processing apparatus (PC side) 400 includes, for example, a CMM (Color Management Module) process part 422 for converting the color space of the obtained image data from a color space for display on a monitor to a color space for image formation with an image forming apparatus (i.e. conversion from the RGB color system to the CMY color system), a BG/UCR (Black Generation/Under Color Removal) process part 423 for generating black or removing under color with respect to the values of C, M, and Y, and a γ correction process part 424 for correcting input/output image data in accordance with the properties of the image forming apparatus or the preferences of the user. The corrected image data generated by the γ correction process part 424 are output to the image forming apparatus (inkjet printer) 500.

The printer controller 511 (control part 200) in the image forming apparatus 500 includes a halftone process part 515 for performing a halftone process on the image data, a dot arrangement process part 516 for displacing the arrangement of the dot pattern jetted from the image forming apparatus 500 in a predetermined order in accordance with the results of the halftone process (this process may be performed as part of the halftone process), and a rasterizing part 517 for converting the printing image data (dot pattern data) obtained by the halftone process and the dot arrangement process to image data corresponding to each position (location) of the nozzles of the image forming apparatus 500. As a result, the converted image data of the rasterizing part 517 are output to the printing control part 207.

Figure 8:
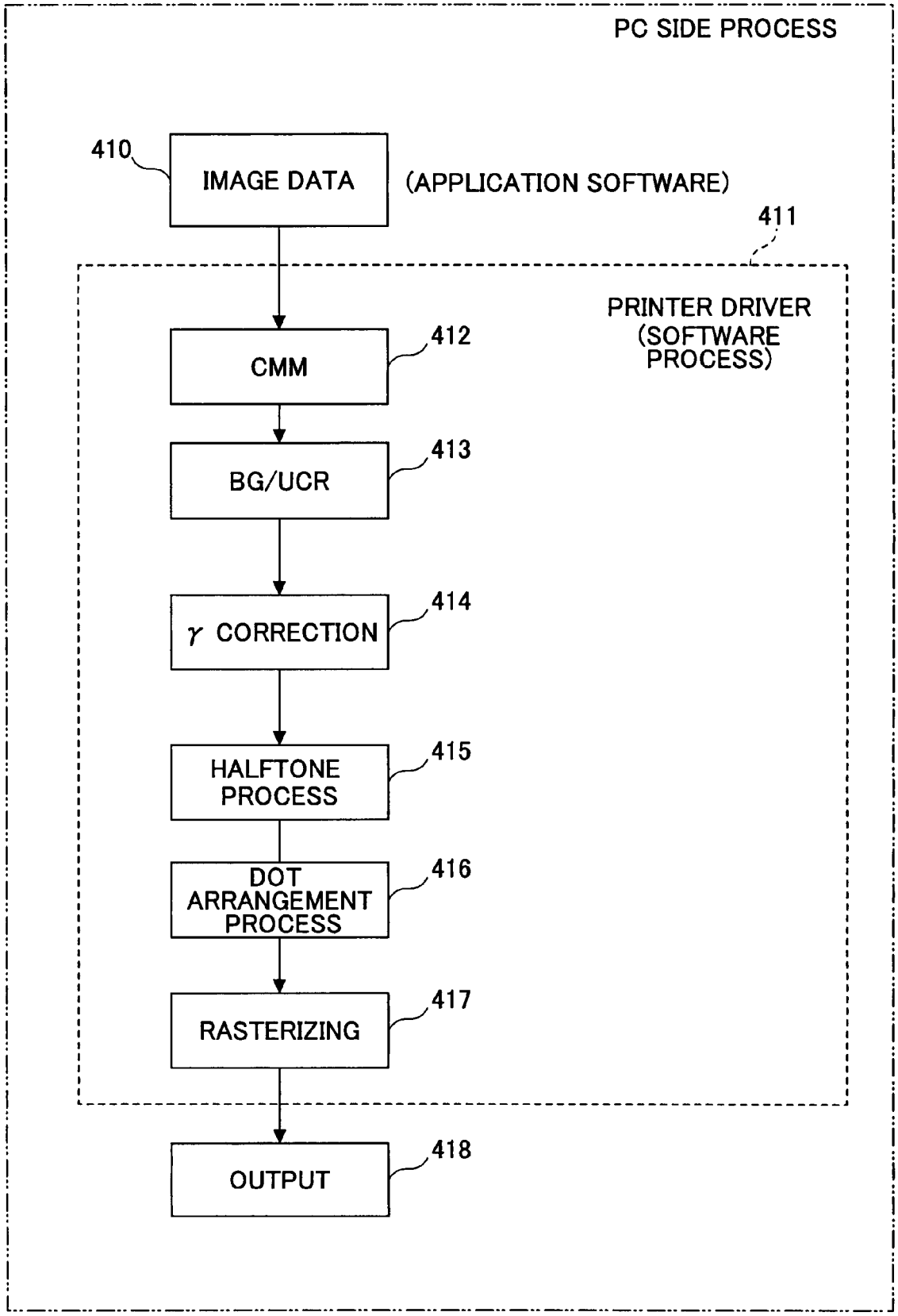
FIG. 8 is a block diagram illustrating the functional configuration of an exemplary printer driver that performs an imaging method according to an embodiment of the present invention.
Figure 9:
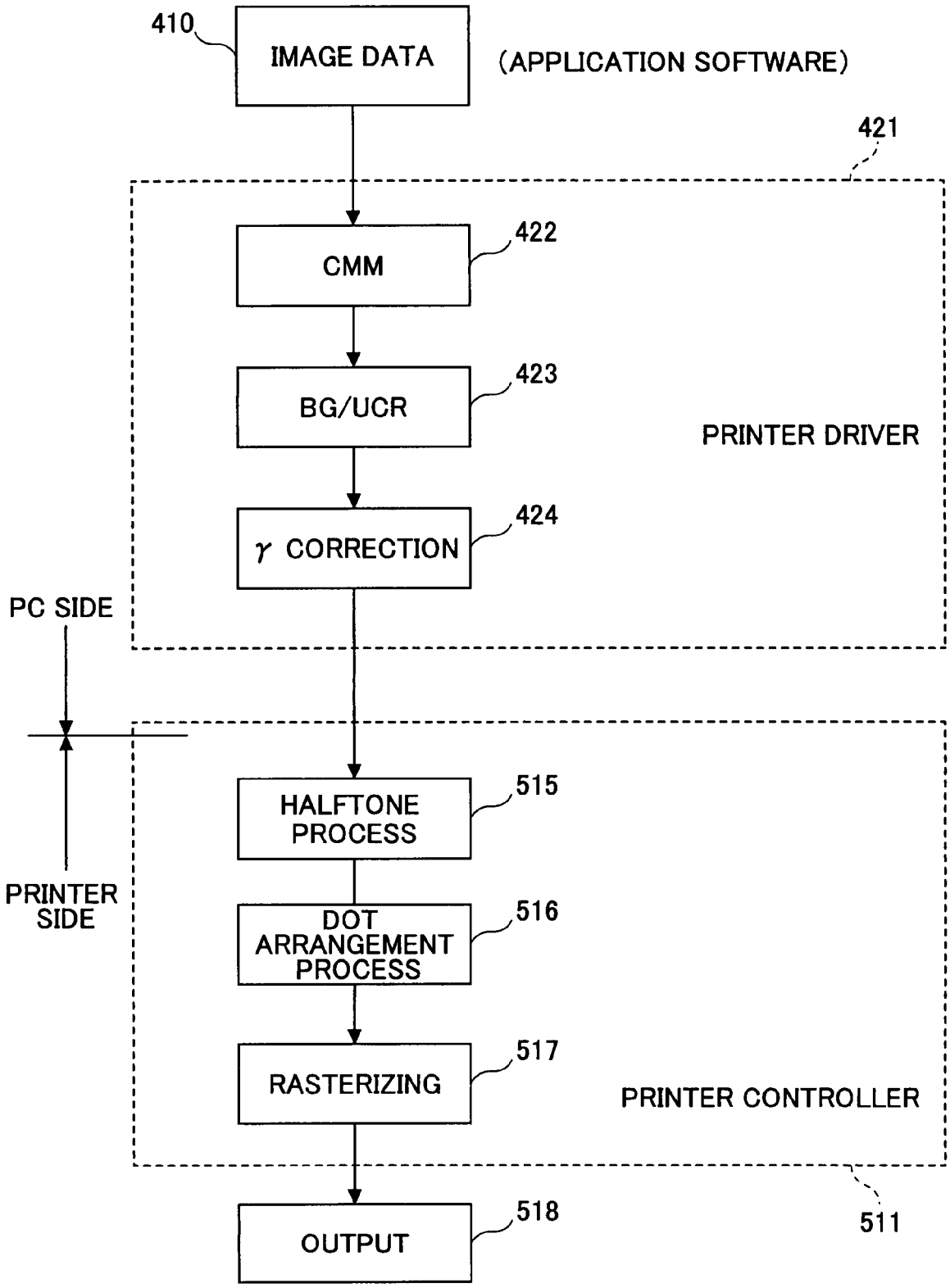
FIG. 9 is a block diagram illustrating functional configurations of another exemplary printer driver and a printer controller that perform an imaging method according to an embodiment of the present invention.

The image processing method of the present invention can be suitably applied to both the configurations shown in FIGS. 8 and 9. The image processing method is described below by using the configuration shown in FIG. 8 where the image forming apparatus (printer side) does not have the function of generating dot patterns in accordance with an inside command (command from a part inside the image forming apparatus) for printing images or letters (characters). That is, in the example below, a printing command from application software of the image processing apparatus (which is the host) 400 is executed by processing an image with a printer driver 411, generating multi-value dot pattern data that can be output by the image forming apparatus (image data for printing), rasterizing the image data, transferring the rasterized image data to the image forming apparatus 500, and printing the image data with the image forming apparatus 500.

More specifically, in the image processing apparatus 400, printing commands, including information on the position, thickness and the shape of the lines that are to be printed, from application software or the operating system are temporarily stored in an image data memory, along with information on the type of character, size, and the position of the letters that are to be printed. It is to be noted that the commands are in a predetermined printing language.

The commands stored in the image data memory are interpreted by the rasterizer part. If the command is for depicting (printing) a line, image data are converted into a dot pattern in correspondence with, for example, the position and thickness designated by the command. If the command is for depicting (printing) a letter, corresponding data are extracted from font outline data stored inside the image processing apparatus (host computer) 400, so that image data are converted into a dot pattern in correspondence with, for example, the position and size designated by the command.

Then, various image processes are performed on the data of the dot pattern (image data 410). The image processed data are stored in a raster data memory. The image processing apparatus 400 rasterizes the data of the dot pattern based on an orthogonal grid indicating a basic printing position. The various image processes include, for example, a color management process (CMM), γ correction process, a halftone process (e.g. a dither method, an error diffusion method), an undertone removal process, and a total ink amount controlling process. Then, the rasterized data are transferred to the image forming apparatus 500 via an interface.

In the following, an exemplary image forming apparatus (multifunction machine) having functions of an inkjet recording apparatus and a copier is described with reference to FIG. 10.

Figure 10:
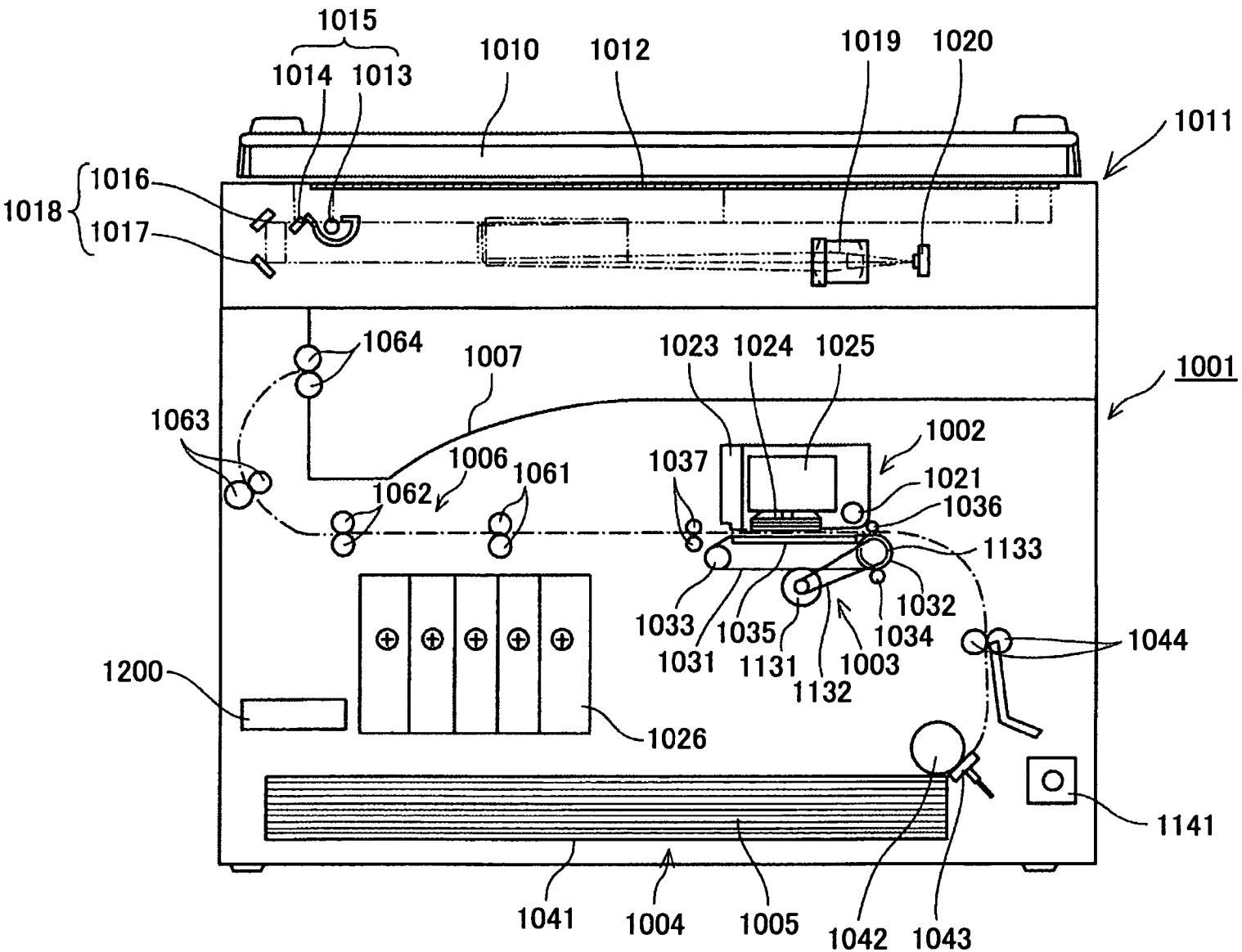
FIG. 10 is a diagram showing a configuration of another exemplary image forming apparatus that performs an imaging method according to an embodiment of the present invention.

FIG. 10 is a diagram showing an overall configuration of the image forming apparatus of the present example.

The illustrated image forming apparatus includes an apparatus main frame (box structure) 1001 inside which component parts such as an image forming part 1002 and a sub scanning conveying part 1003 (the above two parts collectively being referred to as 'printer engine unit' hereinafter) are accommodated.

A sheet feeding part 1004 is arranged at a bottom portion of the main frame 1001, and recording medium (paper sheet) 1005 is fed from the sheet feeding part 1004 one sheet at a time to be conveyed by the sub scanning conveying part 1003 to a position opposite the image forming part 1002. Then, liquid droplets are jetted onto the paper sheet 1005 to form a predetermined image thereon after which the paper sheet 1005 is discharged onto a sheet discharge tray 1007 arranged at the upper face of the apparatus main frame 1001 via a sheet discharge conveying part 1006.

Also, the illustrated image forming apparatus includes an image reading part (scanner part) 1011 for reading an image as an input system for image data generated by the image forming unit 1002.

The image reading part 1011 includes a scanning optical system having an illuminating light source 1013 and a mirror 1014, another scanning optical system 1018 having mirrors 1016 and 1017, a contact glass 1012, a lens 1019, and an image reading element 1020. The scanning optical systems 1015 and 1018 are moved to read an image of a document placed on the contact glass 1012. The document image is read as an image signal by the image reading element 1020 that is arranged behind the lens 1019. The image signal is then digitized and processed to be printed and output by the image forming apparatus.

In the illustrated example, a press plate 1010 for pressing the document onto the contact glass 1012 is arranged over the contact glass 1012.

Also, the illustrated image forming apparatus includes an input system for receiving, via a cable or a network, data including print image data from a host side apparatus that may be an external information processing apparatus such as a personal computer or some other information processing apparatus, an external image reading apparatus such as an image scanner, an external image capturing apparatus such as a digital camera, for example. The received data are processed to be printed and output by the image forming apparatus.

It is noted that the image forming part 1002 has a similar configuration to that of the above-described inkjet recording apparatus (image forming apparatus) and includes a movable carriage 1023 that is guided by a guide rod 1021 to move in the main scanning direction (direction perpendicular to the sheet conveying direction) and a recording head 1024 arranged on the carriage 1023. The recording head 1024 includes one or more liquid jetting heads having nozzle rows for jetting liquid droplets in plural different colors. It is assumed that the illustrated image forming part 1002 is a shuttle type image forming unit that forms an image by jetting liquid droplets from the recording head 1024 while moving the carriage 1023 in the main scanning direction by a carriage scanning mechanism and moving the paper sheet 1005 in the sheet conveying direction (sub scanning direction) by the sub scanning conveying part 1003. In an alternative example, a line head may be used as the recording recording head 1024 of the image forming part 1002.

The recording head 1024 includes nozzle rows that are configured to jet black (Bk) ink, cyan (C) ink, magenta (M) ink, and yellow (Y) ink. The inks in the different colors are supplied to the recording head 1024 from sub tanks 1025 that are arranged in the carriage 1023. Further, the inks in the different colors are supplied to the sub tanks 1025 via tubes (not shown) from corresponding ink cartridges 1026 as main tanks that are detachably installed within the apparatus main frame 1001.

The sub scanning conveying part 1003 includes a conveyor belt 1031, a conveying roller 1032, a driven roller 1033, a charge roller 1034, a guide member 1035, a pressurizing roller 1036, and a conveying roller 1037. The conveyor belt 1031 is an endless belt that is arranged around the conveying roller 1032 and the driven roller 1031. The conveying roller 1032 is a drive roller for altering the conveying direction of the sheet 1005 fed from the lower side by approximately 90 degrees so that the sheet 1005 may be conveyed facing the image forming part 1002. The charge roller 1034 is applied an AC bias for charging the surface of the conveyor belt 1031. The guide member 1035 guides a portion of the conveyor belt 1031 facing opposite the image forming part 1002. The pressurizing roller 1036 is positioned opposite the conveying roller 1032 and is configured to press the paper sheet 1005 against the conveyor belt 1031. The conveying roller 1037 conveys the paper sheet 1005 having an image is formed thereon by the image forming part 1002 to the sheet discharge conveying part 1006.

The conveyor belt 1031 of the sub scanning conveying part 1003 is configured to move around in the sub scanning direction in accordance with the rotating movement of the conveying roller 1032 that is rotated by a sub scanning roller 1131 via a timing belt 1132 and a timing roller 1133.

The sheet feeding part 1004 is configured to be detachable from the apparatus main frame 1001, and includes a sheet feeding cassette 1041 that stacks and accommodates plural paper sheets 1005, a sheet feeding roller 1042 and a friction pad used for separating the sheets 1005 accommodated in the sheet feeding cassette 1041 one by one, and a sheet feeding conveying roller 1044 as a resist roller for conveying the fed paper sheet 1005 to the sub scanning conveying part 1003. The sheet feeding roller 1042 is configured to be rotated by a sheet feed motor 1141 corresponding to a HB type stepping motor via sheet feeding clutch (not shown). The sheet feeding conveying roller 1044 is also configured to be rotated by the sheet feed motor 1141.

The sheet discharge conveying part 1006 includes pairs of sheet discharge conveying rollers 1061 and 1062 for conveying the paper sheet 1005, a pair of sheet discharge conveying rollers 1063 and a pair of discharge rollers 1064 for sending the paper sheet 1005 to the discharge tray 1007.

In the following, a control part of the above-described image forming apparatus is described with reference to FIG. 11.

Figure 11:
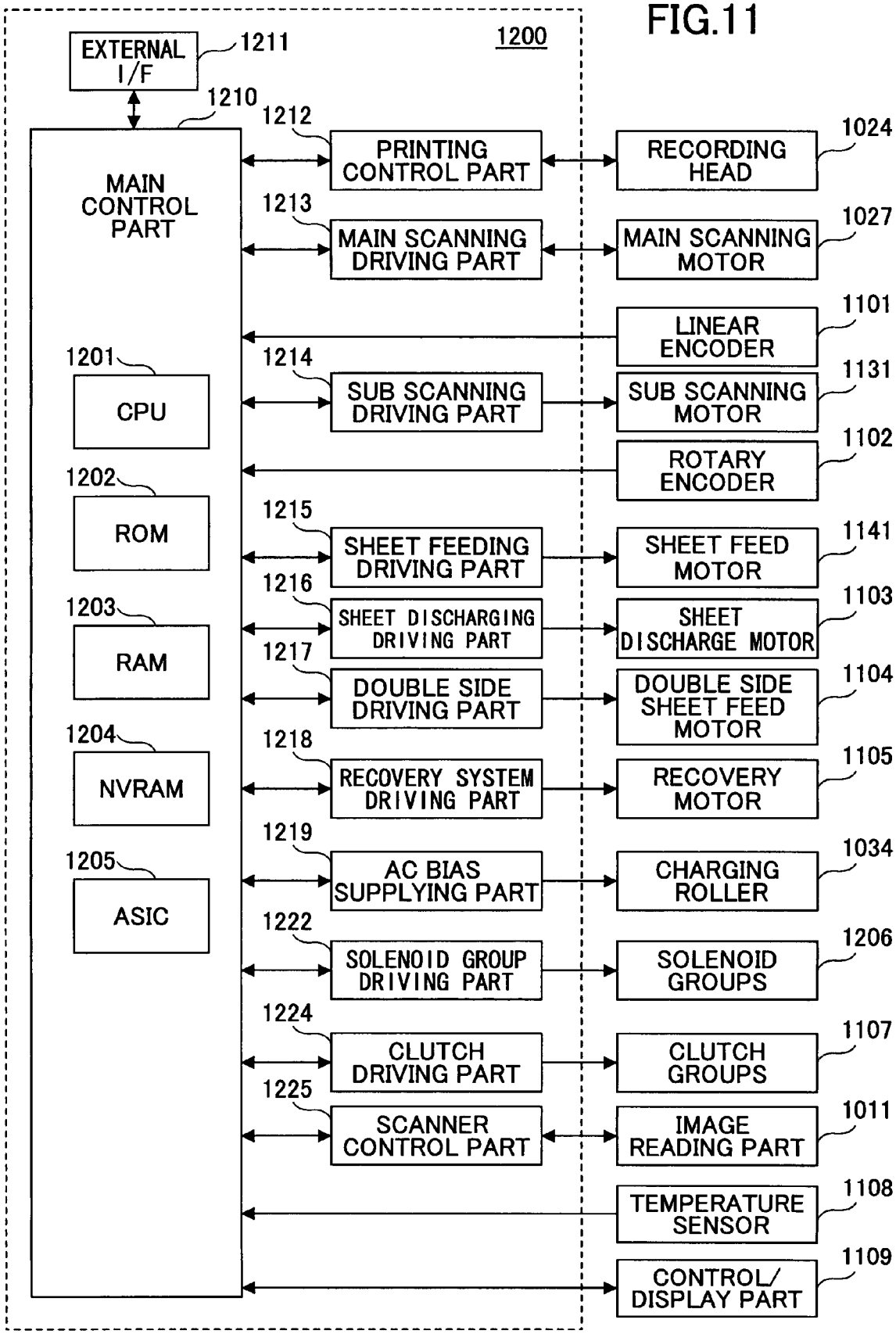
FIG. 11 is a block diagram showing a configuration of a control part of the exemplary image forming apparatus shown in FIG. 10.

FIG. 11 is a block diagram showing an exemplary configuration of the control part 1200 of the image forming apparatus shown in FIG. 10.

The control part 1200 has a main control part 1210 for controlling various components provided therein. For example, the main control part 1210 controls a CPU 1201, a ROM 1202 for storing programs to be executed by the CPU 1201 and other fixed data, a RAM 1203 for temporarily storing image data and the like, a non-volatile memory (NVRAM) for maintaining data when the power of the image forming apparatus is turned off, and an ASIC 1205 for performing various image processes (e.g. halftone process) of the present invention with respect to input images.

The control part 1200 further includes, for example, an I/F 1211 for exchanging data and signals with the host (e.g. image processing apparatus), a printing control part 1212 including a head driver for controlling the drive of the recording head 1024, a main scanning driving part (motor driver) 1213 for driving a main scanning motor 1027 which moves the carriage 1023, a sub-scanning motor 1214 for driving the sub-scanning motor 1131, a sheet feeding driving part 1215 for driving the sheet feed motor 1141, a sheet discharging driving part 1216 for driving a sheet discharge motor 1103 that drives the rollers of the sheet discharge part 1006, a double side driving part 1217 for driving a double side sheet feed motor 1104 that drives the rollers of a double side sheet feeding unit (not shown), a recovery system driving part 1218 for driving a recovery motor 1105 for driving a maintaining/recovering mechanism (not shown), and an AC bias supplying part 1219 for supplying AC bias to the charging roller 1034.

Moreover, the control part 1200 may also include, for example, a solenoid (SOL) group driving part (driver) 1222 for driving various solenoid groups 1206, a clutch driving part 1224 for driving electromagnetic clutch groups 1107 related to sheet feeding, and a scanner control part 1225 for controlling the image reading part 1011.

Furthermore, the main control part 1210 inputs detection signals from a temperature sensor 1108 for detecting the temperature of the conveyor belt 1031. It is to be noted that although detections signals of other sensor are also input to the main control part 1210, illustration of the sensors is omitted. Furthermore, the main control part 1210 outputs display information with respect to control/display part 1109 including various displays, keys, and buttons provided in the main body 1001 (e.g. numeric pad, start button).

Furthermore, the main control part 1210 inputs output signals (pulses) from a linear encoder 1101 for detecting the amount of movement and movement speed of the carriage 1023 and output signals (pulses) from a rotary encoder 1102 for detecting the movement speed and the movement speed of the conveyor belt 1031. Accordingly, the main control part 1210 moves the carriage 1023 and the conveyor belt 1031 by controlling the drive of the main scanning motor 1027 and the sub-scanning motor 1131 via the main scanning driving part 1213 and the sub-scanning driving part 1214 in correspondence with the detection signals (pulses) from the linear encoder 1101 and the rotary encoder 1102.

Next, an image forming operation of the above-described image forming apparatus is described.

First, an alternate voltage (i.e. high voltage having rectangular waves of positive/negative electrodes) is applied to the charging roller 1034 from the AC bias supplying part 1219. Since the charging roller 1034 is in contact with the surface layer (insulating layer) of the conveyor belt 1031, positive and negative charges are alternately applied to the surface layer of the conveyor belt 1031 in the paper conveying direction of the conveyor belt 1031. Accordingly, a predetermined area of the conveyor belt 1031 is charged, to thereby create an unequal electric field in the conveyor belt 1031.

Then, a recording medium 1005 is fed from the sheet feeding part 1004 and conveyed onto the conveyor belt 1031 between the conveying roller 1032 and the pressurizing roller 1036. In accordance with the orientation of the electric field of the conveyor belt 1031, the recording medium 1005 is attracted to the surface of the conveyor belt 1031 by the electrostatic force of the conveyor belt 1031. Thereby, the recording medium 1005 is conveyed in correspondence with the movement of the conveyor belt 1031.

Thereby, an image (tone pattern) comprising an arrangement of dots is formed (printed) on the recording medium 1005 by jetting a recording liquid from the recording head 1024 while moving the recording head 1024 in the main scanning direction a plurality of times and intermittently conveying the recording medium 1005 in the sub-scanning direction in accordance with print data generated by the image processing apparatus. After the image (tone pattern) is formed, a front tip side of the recording medium 1005 is separated from the conveyor belt 1031 by a separating claw (not shown). Then, the recording medium 1005 is discharged to the sheet discharge tray 1007 by the sheet discharge part 1006.

In the following, a dot arrangement used in an imaging method according to an embodiment of the present invention is described with reference to FIGS. 12A and 12B.

Figure 12A:
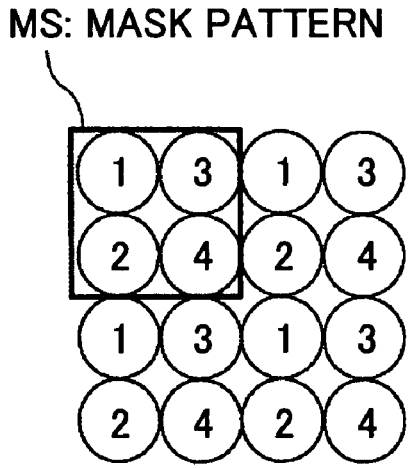
FIG. 12A is a diagram showing an exemplary mask pattern implementing a combination of a multi-pass method and an interlace method.

The order of dots formed by combining a multi-pass method (i.e., image forming method that involves scanning the same area of a sheet in the main scanning direction multiple times using the same nozzle group or different nozzle groups) and an interlace method (i.e., image forming method that involves adjusting the sheet conveying distance in the sub scanning direction to perform interlaced scanning on the same area of a sheet multiple times) can be arranged in the form of a matrix as shown in FIG. 12A. Such a matrix is referred to as a mask pattern or a recording sequence matrix.

Figure 12B:
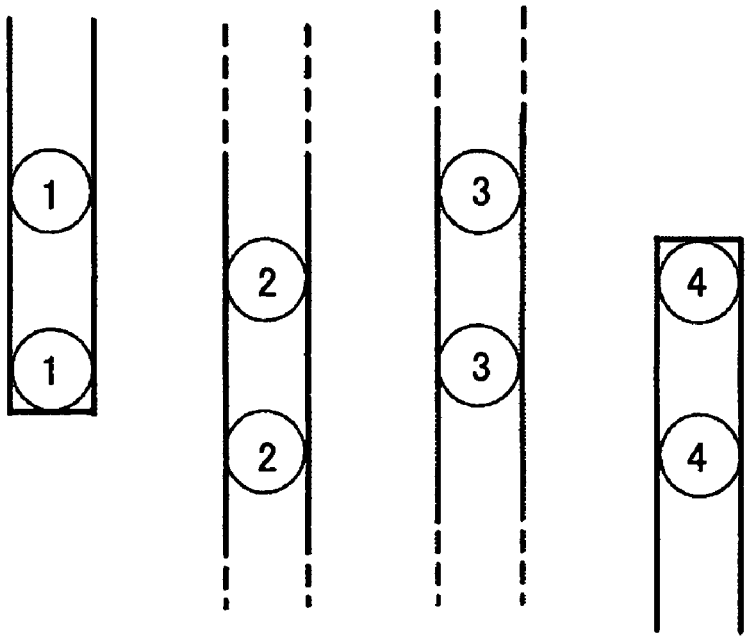
FIG. 12B is a diagram showing the relative positioning of dots printed in first through fourth passes using the mask pattern of FIG. 12A.

FIG. 12B is a diagram showing the relative positioning of dots printed in first through fourth passes using the mask pattern of FIG. 12A.

In a case where the mask pattern shown in FIG. 12A is used, the dots enumerated with the number "1" represent dots that are printed in the first pass (see FIG. 12B). Likewise, the dots enumerated with the number "2" represent dots that are printed in the second pass after the paper is conveyed (advanced) in the sub-scanning direction, the dots enumerated with the number "3" represent dots that are printed in the third pass after the paper is further conveyed (advanced) in the sub-scanning direction, and the dots enumerated with the number "4" represent dots that are printed in the fourth pass after the paper is conveyed (advanced) in the sub-scanning direction.

In the following, an example is described in which a mask pattern determining a dot arrangement order as is shown in FIG. 13A is used to form a 8×8 image.

According to conventional concepts, the dispersity of the illustrated image in the diagonal direction (base tone direction) is 7, and the dispersity of the image in the vertical direction is 0.25.

In order to decrease image dispersity in the diagonal direction, the mask pattern of FIG. 13B may be selected to realize a dispersity of 0.25.However, in the case where the mask pattern of FIG. 13B is selected, dots aligned in the sub scanning direction are printed in consecutive order by consecutive passes so that influences of dot impact position deviations may not be dispersed in the sub scanning direction.

In view of such a problem, according to an embodiment of the present invention, in addition to forming consecutive dots aligned in the base tone direction (i.e., diagonal direction in the drawings) through non-consecutive passes, consecutive dots aligned in the sub scanning direction (i.e., vertical direction in the drawings) are also formed through non-consecutive passes. In this way, deviations in ink droplet impact positions with respect to the base tone direction may be dispersed, and deviations in ink droplet impact positions with respect to the sub scanning direction may also be dispersed so that banding and irregularities in the printed image may be reduced.

For example, by selecting a mask pattern as is illustrated in FIG. 13C, consecutive dots aligned in the base tone direction may be formed by non-consecutive passes and consecutive dots aligned in the sub scanning direction may be formed by partially non-consecutive passes. Specifically, as can be appreciated from the illustrated 8×8 images shown in FIGS. 13B and 13C, the dots printed by eight consecutive passes in FIG. 13C make up portions of two parallel vertical lines as opposed to one vertical line as in FIG. 13B. In other words, although portions of consecutive dots aligned in the sub scanning direction are formed by consecutive passes, the consecutive dots are formed through at least partially non-consecutive passes so that dispersity with respect to the sub scanning direction may be improved compared to the example of FIG. 13B.

In the following, quantization of dispersity, which is influenced by the way consecutive dots are formed by multiple passes, is described.

According to the present embodiment, dispersity is defined by the following formula 1:

$$\text{Dispersity}=\Sigma(\text{dot formation scanning interval}-\text{average scanning interval})^2/\text{number of scans for dot formation} \quad \text{[Formula 1]}$$

An example is described below for calculating the dispersity in the sub scanning direction of dots formed using the mask pattern of FIG. 13B. The dot formation scanning interval with respect to the sub scanning direction is "1" between the first and second passes, the second and third passes, the third and fourth passes, the fourth and fifth passes, the fifth and sixth passes, the sixth and seventh passes, and the seventh and eighth passes, and the scanning interval between the eighth pass and the first pass is '9'. Also, the average scanning interval is "2" (i.e., $\{1+1+1+1+1+1+1+9\}/8=2$), and the number of scans used for forming dots in the sub scanning direction is "8" so that dispersity in the sub scanning direction is calculated as "7" as is illustrated by the following formula 2.

$$\{(1-2)^2+(1-2)^2+(1-2)^2+(1-2)^2+(1-2)^2+(1-2)^2+(1-2)^2+(9-2)^2\}/8=7 \quad \text{[Formula 2]}$$

Another example is described below for calculating the dispersity in the sub scanning direction of dots formed using the mask pattern of FIG. 13C, which is used in an imaging method according to an embodiment of the present invention. In this example, the scanning interval of dot formed in the sub scanning direction is "1" between the first and second passes, the second and third passes, the twelfth and thirteenth passes, the thirteenth and fourteenth passes, and the seventh and eighth passes; the dot formation scanning interval with respect to the sub scanning direction is "4" between the third and seventh passes and the eight and twelfth passes, and the scanning interval is "3" between the fourteenth and first passes. Also, the average scanning interval is "2" (i.e., $\{1+1+4+1+4+1+1+3\}/8=2$), and the number of scans for forming the dots in the sub scanning direction is "8". Accordingly, the dispersity of dots in the sub scanning direction may be calculated as "1.75" as is illustrated by the following formula 3.

$$\{(1-2)^2+(1-2)^2+(4-2)^2+(1-2)^2+(4-2)^2+(1-2)^2+(1-2)^2+(3-2)^2\}/8=1.75 \quad \text{[Formula 3]}$$

It has been confirmed from such calculation results that banding and unevenness in a printed image may be adequately reduced by setting the condition "dispersity≦5".

As can be appreciated from the above descriptions, by changing the mask pattern from that shown in FIG. 13B to that shown in FIG. 13C, the dispersity in the sub scanning direction may be decreased.

Also, it is noted that the dispersity in the base tone direction of the dots formed using the mask pattern of FIG. 13C is "0.75" as is calculated from the following formula 4 so that banding and unevenness of a printed image may be adequately reduced.

$$\{(2-2)^2+(1-2)^2+(2-2)^2+(1-2)^2+(3-2)^2+(3-2)^2+(3-2)^2+(1-2)^2\}/8=0.75 \quad \text{[Formula 4]}$$

It is noted that the dispersity in the sub scanning direction in the case of using the mask pattern shown in FIG. 13A is "0.25" as is calculated from the following formula 5.

$$\{(2-2)^2+(2-2)^2+(2-2)^2+(3-2)^2+(2-2)^2+(2-2)^2+(2-2)^2+(1-2)^2\}/8=0.25 \quad \text{[Formula 5]}$$

It has been appreciated that both the dispersity in the base tone direction and the dispersity in the sub scanning direction are preferably reduced to improve image quality.

In the case of using a small mask pattern, when imaging is performed through shifting the dot arrangement order by one dot position, adjacent dots are formed by consecutive passes at least in one of the base tone direction or the sub scanning direction as can be appreciated from FIGS. 13A-13C.

On the other hand, when a larger mask pattern using a large number of passes such as that shown in FIG. 14 (32 passes) is used, all adjacent dots may be formed by non-consecutive passes by shifting the dot arrangement order in the main scanning direction. However, in the case of imaging dots by a small number of passes using a small mask pattern, dot impact position deviations may not be adequately dispersed in areas where adjacent dots are formed by consecutive passes and image degradation may be caused as a result, for example.

In view of such a problem, according to one embodiment of the present invention, the dot arrangement order may be arranged such that the scanning interval between each set of adjacent dots in the sub scanning direction is a plural number to have all adjacent dots formed by non-consecutive passes even when the mask pattern uses a small number of passes.

FIG. 15 illustrates a specific example of the above embodiment in which 16 passes are used. It is noted that the dispersity in the base tone direction and the dispersity in the sub scanning direction in the example of FIG. 15 are the same as those of FIG. 13C. In other words, the mask patterns (arrangement of dots) shown FIG. 13C and FIG. 15 may not be distinguished by their corresponding dispersion values based on the dispersion as defined by the above formula 1.In this case, these mask patterns may be distinguished by evaluating their consecutive dispersity values, such being defined by the following formula 6.

$$\text{Consecutive Dispersity}=\Sigma(\text{dot formation scanning interval in dot arrangement order}-\text{average scanning interval in dot arrangement order})^2/\text{number of scans for dot formation} \quad \text{[Formula 6]}$$

The difference between consecutive dispersity as is defined by the above formula 6 and dispersity as is defined by formula 1 is described below.

The above formula 1 takes into account the dot arrangement order values of subject dots according to their numerical order and disregards the positional order of the dots. On the other hand, the above formula 6 takes into account the dot arrangement order values of subject dots according to their positional order.

Specifically, in the example of FIG. 13C, the dispersity with respect to the sub scanning direction according to the definition of formula 1 is "1.75" as is calculated by the above formula 3.

On the other hand, according to the definition of formula 6, the dot formation scanning interval in dot arrangement order for dots formed in the sub scanning direction is "1" between the first and second passes, the second and third passes, the twelfth and thirteenth passes, the thirteenth and fourteenth passes, and the seventh and eighth passes; and the scanning interval is "9" between the third and twelfth passes, the fourteenth and seventh passes, and the eighth and first passes. In other words, consecutive dispersion is calculated based on the scanning interval between adjacent dots. It is noted that the average scanning interval in dot arrangement order is "4" (i.e., $\{1+1+9+1+1+9+1+9\}/8=4$), and the number of scans for dot formation is "8" so that the consecutive dispersity in the example of FIG. 13C is "15" as is calculated from the following formula 7.

$$\{(1-4)^2+(1-4)^2+(9-4)^2+(1-4)^2+(1-4)^2+(9-4)^2+(1-4)^2+(9-4)^2\}/8=15 \quad \text{[Formula 7]}$$

It is noted that the consecutive dispersity in the sub scanning direction for a dot image formed using the mask pattern shown in FIG. 15 is "7" as can be calculated from the following formula 8.That is, the consecutive dispersity in the sub scanning direction is lower in the example of FIG. 15 compared to the example of FIG. 13C.

$$\{(11-10)^2+(11-10)^2+(11-10)^2+(11-10)^2+(11-10)^2+(11-10)^2+(11-10)^2+(3-10)^2\}/8=15 \quad \text{[Formula 8]}$$

Also, it is noted that the consecutive dispersity in the base tone direction for the example of FIG. 13C is "15" while the consecutive dispersity in the base tone direction for the example of FIG. 15 is "7". That is, the consecutive dispersity in the base tone direction is lower in the example of FIG. 15 compared to the example of FIG. 13C.

According to an embodiment of the present invention, the condition "consecutive dispersity≦10" is preferably satisfied.

It is noted that although differences in consecutive dispersity may not be apparent in the case of performing only one pass, deviations in dot impact positions may be dispersed by forming adjacent dots with non-consecutive passes. Thus, image quality may be improved by evaluating the consecutive dispersity of a dot image formed by a mask pattern and selecting a mask pattern that can achieve suitable consecutive dispersity characteristics.

The evaluation process as is described above is not limited to being applied in a case where a mask pattern for forming a line base tone is used. For example, advantageous effects may be obtained by performing the evaluation process in the case of using a mask pattern as is shown in FIG. 16A.

Figure 16A:
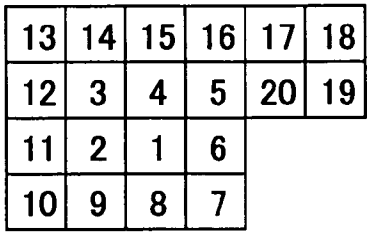
FIG. 16A is a diagram illustrating another mask pattern according to an embodiment of the present invention.
Figure 16B:
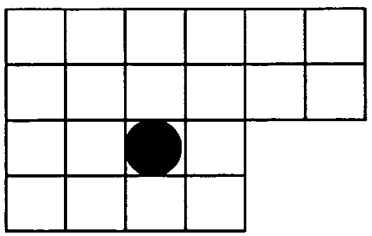
FIGS. 16B-16F are diagrams illustrating the order in which dots are printed in the case of using the mask pattern of FIG. 16A.
Figure 16C:
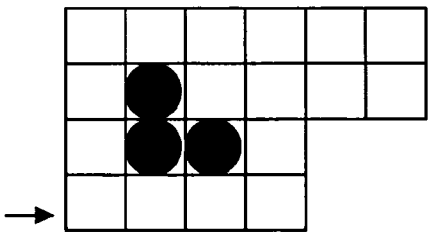
Figure 16D:
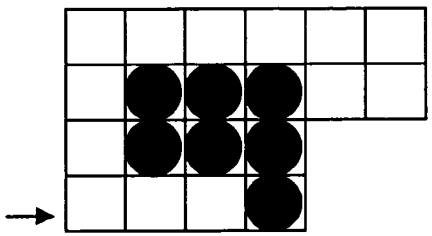
Figure 16E:
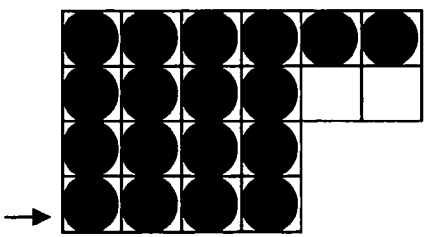
Figure 16F:
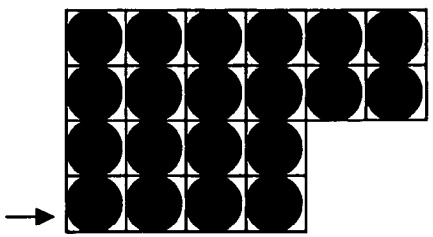

It is noted that the numbers indicated in FIG. 16A represent the order in which ink is applied within the mask pattern. Specifically, ink is applied within the mask pattern in the order as is illustrated in FIGS. 16B through 16F.

According to an embodiment of the present invention, an image processing apparatus may be configured to run a printer driver corresponding to a program for enabling a computer to execute at least one of the above-described image processing methods (imaging methods) according to embodiments of the present invention. In another embodiment, an image forming apparatus may have means for performing at least one of the above-described image processing methods (imaging methods). In another embodiment, the image forming apparatus may include application specific integrated circuits (ASIC) for performing at least one of the above-described image processing methods (imaging methods) according to embodiments of the present invention. In yet another embodiment, a program for enabling a computer to execute the above-described image processing methods (imaging methods) may be stored in a predetermined information storage medium to be installed in and read by an image processing apparatus.

In the following, preferred embodiments of a recording medium on which an imaging method according to an embodiment of the present invention can be suitably performed are described.

It is noted that when printing is performed on a recording medium with low absorbability, the image quality may be affected by the dot position accuracy. Specifically, since ink does not easily spread on a recording medium with low absorbability, even when the dot position accuracy is slightly degraded, blank portions corresponding to portions where ink is not adequately applied may be created on the recording medium. The blank portions may cause irregularity or decrease of image density which lead to image quality degradation.

By using an imaging method according to an embodiment of the present invention for forming an image on such a recording medium, dot position inaccuracies may be dispersed throughout the image to prevent image quality degradation. It is noted that such advantageous effects may be obtained particularly in a case where the imaging method according to an embodiment of the present invention is used in forming an image on a recording medium as is described below.

The recording medium subject to image processing by the imaging method according to the present embodiment is composed of a base material and at least one coating layer arranged on at least one side of the base material. It is noted that the coating layer may be arranged on the other side of the base material as is necessary or desired.

As preferred characteristics of the recording medium, the amount of ink transferred to the recording medium when the recording medium is brought into contact with the ink for 100 ms as measured by a dynamic scanning absorptometer is preferably within a range of 4-15 ml/m$^2$, and more preferably within a range of 6-14 ml/m$^2$. Also, the amount of transferred pure water measured under the above conditions is preferably within a range of 4-26 ml/m$^2$, and more preferably within a range of 8-25 ml/m$^2$.

When the amount of transferred pure water or ink at a contact time of 100 ms is smaller than the preferable range, beading may occur. When the amount is larger than the preferable range, the diameter of a recorded ink dot may become smaller than a preferable diameter.

The amount of ink transferred to the recording medium when the recording medium is brought into contact with the ink for 400 ms as measured by the dynamic scanning absorptometer is preferably within a range of 7-20 ml/m$^2$, and more preferably within a range of 8-19 ml/m$^2$. Also, the amount of transferred pure water measured under the above conditions is preferably within a range of 5-29 ml/m$^2$, and more preferably within a range of 10-28 ml/m$^2$.

When the amount of transferred pure water or ink at a contact time of 400 ms is smaller than the preferable range, drying property becomes insufficient and spur marks may appear. When the amount is larger than the preferable range, image bleeding may occur and the glossiness of an image after being dried may be degraded.

It is noted that the dynamic scanning absorptometer (DSA: JAPAN TAPPI JOURNAL, Volume 48, May 1994, pp. 88-92, Shigenori Kuga) is an apparatus that can accurately measure the amount of a liquid absorbed during a very short period of time.

The dynamic scanning absorptometer directly reads the absorption speed of a liquid from the movement of a meniscus in a capillary and automatically measures the amount of the liquid absorbed. The test sample is shaped like a disc. The dynamic scanning absorptometer scans the test sample by moving a liquid-absorbing head spirally over the test sample to thereby measure the amount of the liquid absorbed at as many points as necessary. The scanning speed is automatically changed according to a predetermined pattern.

A liquid supplying head that supplies liquid to the test sample is connected via a Teflon (registered trademark) tube to the capillary. Positions of the meniscus in the capillary are automatically detected by an optical sensor.

In the above example, a dynamic scanning absorptometer (K350 series, type D, Kyowa Co., Ltd.) is used to measure the amount of transferred pure water or ink. The amount of transferred pure water or ink at a contact time of 100 ms or 400 ms is obtained by interpolation, using the transferred amounts measured at time points around each contact time. Also, the measurements are performed under an environmental condition of 23° C. and 50% RH.

In the following, the base material of the recording medium is described.

Various materials may be used for the base material depending on the purpose of paper. For example, a sheet of paper mainly made of wood fibers and a nonwoven fabric mainly made of wood and synthetic fibers may be used.

A sheet of paper may be made of wood pulp or recycled pulp. Examples of wood pulp are leaf bleached kraft pulp (LBKP), needle bleached kraft pulp (NBKP), NBSP, LBSP, GP, and TMP.

As materials of recycled pulp, recycled papers in the list of standard qualities of recycled papers of the Paper Recycling Promotion Center may be used. For example, chemical pulp or high-yield pulp made of recycled papers may be used as the base material. Such recycled papers include printer papers such as non-coated computer paper, thermal paper, and pressure-sensitive paper; OA papers such as plain paper; coated papers such as art paper, ultra-lightweight coated paper, and matt paper; and non-coated papers such as bond paper, color bond paper, note paper, letter paper, wrapping paper, fancy paper, medium quality paper, newspaper, woody paper, supermarket flyers, simili paper, pure-white roll paper, and milk cartons. The above materials may be used individually or in combination.

Normally, recycled pulp is made by the following four steps:

(1) A defibrating step of breaking down used paper into fibers and separating ink from the fibers by using a mechanical force and a chemical in a pulper.

(2) A dust removing step of removing foreign substances (such as plastic) and dust in the used paper by using, for example, a screen and a cleaner.

(3) A deinking step of expelling the ink separated by a surfactant from the fibers by using a flotation method or a cleaning method.

(4) A bleaching method of bleaching the fibers by oxidization or reduction.

When mixing recycled pulp with wood pulp, the percentage of recycled pulp is preferably 40% or lower so that produced paper does not curl after recording.

As an internal filler for the base material, a conventional white pigment may be used. For example, the following substances may be used as a white pigment: an inorganic pigment such as precipitated calcium carbonate, heavy calcium carbonate, kaolin, clay, talc, calcium sulfate, barium sulfate, titanium dioxide, zinc oxide, zinc sulfide, zinc carbonate, satin white, aluminum silicate, diatomaceous earth, calcium silicate, magnesium silicate, synthetic silica, aluminum hydroxide, alumina, lithophone, zeolite, magnesium carbonate, or magnesium hydrate; and an organic pigment such as styrene plastic pigment, acrylic plastic pigment, polyethylene, microcapsule, urea resin, or melamine resin. The above substances may be used individually or in combination.

As an internal sizing agent used when producing the base material, a neutral rosin size used for neutral papermaking, alkenyl succinic anhydride (ASA), alkyl ketene dimer (AKD), or a petroleum resin size may be used. Especially, a neutral rosin size and alkenyl succinic anhydride are preferable. Alkyl ketene dimer has a high sizing effect and therefore provides an enough sizing effect with a small amount. However, since alkyl ketene dimer reduces the friction coefficient of the surface of recording paper (medium), recording paper made using alkyl ketene dimer may cause a slip when being conveyed in an ink jet recording apparatus.

In the following, the coating layer of the recording medium is described.

The coating layer contains a pigment and a binder, and may also contain a surfactant and other components.

As a pigment, an inorganic pigment or a mixture of an inorganic pigment and an organic pigment may be used.

For example, kaolin, talc, heavy calcium carbonate, precipitated calcium carbonate, calcium sulfite, amorphous silica, alumina, titanium white, magnesium carbonate, titanium dioxide, aluminum hydroxide, calcium hydrate, magnesium hydrate, zinc hydroxide, or chlorite may be used as an inorganic pigment. Especially, kaolin provides a high gloss surface similar to that of an offset paper and is therefore preferable. When a pigmented ink is used, since the colorant is dispersed in ink and stays on the surface of the coating layer, it is not necessary to mix a large amount of inorganic pigment having a low refractive index such as amorphous silica or alumina in the coating layer.

There are several types of kaolin, for example, delaminated kaolin, calcined kaolin, and engineered kaolin made by surface modification. To provide a high gloss surface, the mass percentage of a type of kaolin, in which 80 or more mass percent of particles have a diameter of 2 μm or smaller, in the total amount of kaolin is preferably 50 percent or more.

The mass ratio of the binder to kaolin in the coating layer is preferably 100:50.If the mass ratio of kaolin is lower than 50, sufficient glossiness may not be obtained. There is no specific limit to the amount of kaolin. However, when the fluidity and the thickening property of kaolin under a high shearing force are taken into account, the mass ratio of kaolin is preferably 90 or lower in terms of coatability.

As an organic pigment, a water-soluble dispersion of, for example, styrene-acrylic copolymer particles, styrene-butadiene copolymer particles, polystyrene particles, or polyethylene particles may be used. The above organic pigments may be used in combination.

The amount of an organic pigment in the total amount of pigment in the coating layer is preferably 2-20 mass percent. An organic pigment as described above has a specific gravity lower than that of an inorganic pigment and therefore provides a thick, high-gloss coating layer having a good coatability. If the mass percentage of an organic pigment is less than 2 percent, a desired effect is not obtained. If the mass percentage of an organic pigment is more than 20 percent, the fluidity of a coating liquid becomes too low and, as a result, the efficiency of a coating process decreases and the operational costs increase.

Organic pigments can be divided into several types according to their particle shapes: solid-shape, hollow-shape, and doughnut-shape. To achieve a good balance between the glossiness, coatability, and fluidity of a coating liquid, an organic pigment having hollow-shaped particles with a void percentage of 40 percent or higher and an average diameter of between 0.2 and 3.0 μm is preferable.

As a binder, a water-based resin is preferably used. As a water-based resin, a water-soluble resin or a water-dispersible resin may be used. Any type of water-based resin may be used depending on the purpose. For example, the following water-based resins may be used: polyvinyl alcohol; a modified polyvinyl alcohol such as anion-modified polyvinyl alcohol, cation-modified polyvinyl alcohol, or acetal-modified polyvinyl alcohol; polyurethane; polyvinyl pyrrolidone; a modified polyvinyl pyrrolidone such as polyvinyl pyrrolidone-vinyl acetate copolymer, vinyl pyrrolidone-dimethylaminoethyl methacrylate copolymer, quaternized vinyl pyrrolidone-dimethylaminoethyl methacrylate copolymer, or vinyl pyrrolidone-methacrylamide propyl trimethyl ammonium chloride copolymer; cellulose such as carboxymethyl cellulose, hydroxyethyl cellulose, or hydroxypropylcellulose; modified cellulose such as cationized hydroxyethyl cellulose; polyester, polyacrylic acid(ester), melamine resin, or modified versions of these substances; synthetic resin made of polyester-polyeurethane copolymer; and other substances such as poly(metha)acrylic acid, poly(metha)acrylamide, oxidized starch, phosphorylated starch, self-denatured starch, cationized starch, other modified starches, polyethylene oxide, polyacrylic acid soda, and alginic acid soda. The above substances may be used individually or in combination.

Among the above substances, polyvinyl alcohol, cation-modified polyvinyl alcohol, acetal-modified polyvinyl alcohol, polyester, polyurethane, and polyester-polyeurethane copolymer are especially preferable in terms of ink-absorption rate.

Any type of water-dispersible resin may be used depending on the purpose. For example, the following water-dispersible resins may be used: polyvinyl acetate, ethylene-polyvinyl acetate copolymer, polystyrene, styrene-(metha)acrylic ester copolymer, (metha)acrylic ester polymer, polyvinyl acetate-(metha)acrylic acid(ester)copolymer, styrene-butadiene copolymer, an ethylene-propylene copolymer, polyvinyl ether, and silicone-acrylic copolymer. A water-dispersible resin may contain a cross-linking agent such as methylol melamine, methylol hydroxypropylene urea, or isocyanate. Also, a self-crosslinking copolymer containing a unit of methylol acrylamide may be used as a water-dispersible resin. Two or more of the water-dispersible resins described above may be used at the same time.

The mass ratio of the water-based resin to the pigment in the coating layer is preferably 2:100 to 100:100, and more preferably 3:100 to 50:100.The amount of the water-based resin in the coating layer is determined so that the liquid-absorption rate of a recording medium falls within a specific range.

When a water-dispersible colorant is used, whether to mix a cationic organic compound in the binder is optional. For example, primary to tertiary amines that react with sulfonic groups, carboxyl groups, or amino groups of a direct dye or an acid dye in a water-soluble ink, and form insoluble salt; or a monomer, oligomer, or polymer of quarternary ammonium salt may be used. Among them, an oligomer and a polymer of quarternary ammonium salt are especially preferable.

As a cationic organic compound, the following substances may be used: dimethylamine-epichlorohydrin polycondensate, dimethylamine-ammonia-epichlorohydrin condensate, poly(trimethyl aminoethyl-methacrylate methylsulfate), diallylamine hydrochloride-acrylamide copolymer, poly(diallylamine hydrochloride-sulfur dioxide), polyallylamine hydrochlorid, poly(allylamine hydrochlorid-diallylamine hydrochloride), acrylamide-diallylamine copolymer, polyvinylamine copolymer, dicyandiamide, dicyandiamide-ammonium chloride-urea-formaldehyde condensate, polyalkylene polyamine-dicyandiamide ammonium salt consensate, dimethyl diallyl ammonium chloride, poly diallyl methyl amine hydrochloride, poly(diallyl dimethyl ammonium chloride), poly(diallyl dimethyl ammonium chloride-sulfur dioxide), poly(diallyl dimethyl ammonium chloride-diallyl amine hydrochloride derivative), acrylamide-diallyl dimethyl ammonium chloride copolymer, acrylate-acrylamide-diallyl amine hydrochloride copolymer, polyethylenimine, ethylenimine derivative such as acrylamine polymer, and modified polyethylenimine alkylene oxide. The above substances may be used individually or in combination.

It is preferable to use a cationic organic compound with a low-molecular weight such as dimethylamine-epichlorohydrin polycondensate or polyallylamine hydrochlorid and a cationic organic compound with a relatively-high molecular weight such as poly(diallyl dimethyl ammonium chloride) in combination. Compared with a case where only one cationic organic compound is used, using cationic organic compounds in combination improves image density and reduces feathering.

The equivalent weight of cation in a cationic organic compound obtained by the colloid titration method (performed using polyvinyl potassium sulfate and toluidine blue) is preferably between 3 and 8 meq/g. With an equivalent weight in the above range, the dry deposit mass of the cationic organic compound falls within a preferable range.

In the measurement of the equivalent weight of cation, the cationic organic compound is diluted with distillated water so that the solid content in the solution becomes 0.1 mass percent. No pH control is performed.

The dry deposit mass of the cationic organic compound is preferably between 0.3 and 2.0 g/m$^2$. If the dry deposit mass of the cationic organic compound is lower than 0.3 g/m$^2$, sufficient improvement in image density and sufficient reduction in feathering may not be achieved.

Any surfactant may be used depending on the purpose. For example, an anion surfactant, a cation surfactant, an amphoteric surfactant, or a nonionic surfactant may be used. Among the above surfactants, a nonionic surfactant is especially preferable. Adding a surfactant improves water resistance and density of an image, and thereby reduces bleeding.

For example, the following nonionic surfactants may be used: higher alcohol ethylene oxide adduct, alkylphenol ethylene oxide adduct, fatty acid ethylene oxide adduct, polyhydric alcohol fatty acid ester ethylene oxide adduct, higher aliphatic amine ethylene oxide adduct, fatty acid amide ethylene oxide adduct, fatty oil ethylene oxide adduct, ethylene oxide adduct of fat, polypropylene glycol ethylene oxide adduct, glycerol fatty acid ester, pentaerythritol fatty acid ester, sorbitol-sorbitan fatty acid ester, sucrose fatty acid ester, polyhydric alcohol alkyl ether, and alkanolamine fatty acid amide. The above substances may be used individually or in combination.

Polyhydric alcohol is not limited to a specific type and any type of polyhydric alcohol may be used depending on the purpose. For example, glycerol, trimethylolpropane, pentaerythrite, sorbitol, or surcose may be used. Ethylene oxide adduct may be made by replacing a part of ethylene oxide with an alkylene oxide such as propylene oxide or butylene oxide to the extent that the water solubility is not affected. The percentage of the replaced part is preferably 50 percent or lower. The hydrophile-lipophile balance (HLB) of a nonionic surfactant is preferably between 4 and 15, and more preferably between 7 and 13.

The mass ratio of the surfactant to the cationic organic compound is preferably 0:100 to 10:100, and more preferably 0.1:100 to 1:100.

Other components may also be added to the coating layer to the extent that its advantageous effects are not undermined. Examples of other components include additives such as an alumina powder, a pH adjuster, an antiseptic agent, and an antioxidant.

In the following, a method of forming the coating layer is described.

The method of forming the coating layer is not limited to a specific method and may be selected according to various purposes. For example, the coating layer may be formed by impregnating the base material with a coating liquid or by applying a coating liquid to the base material.

For the impregnation or application of a coating liquid, a coater such as a conventional size press, a gate roll size press, a film transfer size press, a blade coater, a rod coater, an air knife coater, or a curtain coater may be used. Also, using a conventional size press, a gate roll size press, or a film transfer size press attached to a paper machine for the impregnation or application of a coating liquid may improve the efficiency of the process.

There is no specific limit to the amount of a coating liquid on the base material. However, the solid content of a coating liquid on the base material is preferably between 0.5 and 20 $g/m^2$, and more preferably between 1 and 15 $g/m^2$.

After the impregnation or application of a coating liquid, the coating liquid may be dried. The temperature for this drying process is preferably between 100 and 250° C., but is not limited to the specific range.

The recording medium may also have a back layer on the back of the base material, and other layers between the base material and the coating layer or between the base material and the back layer. Also, a protective layer may be provided on the coating layer.

The recording medium according to an embodiment of the present invention may be any type of recording medium having a preferable liquid-absorption rate as described above, such recording medium including but not limited to an ink jet recording medium, coated paper for offset printing, and coated paper for gravure printing, for example.

The grammage of an recording medium according to an embodiment of the present invention is preferably between 50 and 250 $g/m^2$. When the grammage is less than 50 $g/m^2$, the strength of the paper becomes low and the paper may be jammed in an image forming apparatus. When the grammage is more than 250 $g/m^2$, the strength of the paper becomes too high to be able to bend along the paper conveying path of an image forming apparatus and may be jammed.

When printing is performed on the above described recording medium, ink dots may not easily penetrate and spread across the recording medium so that the dot position accuracy in the printing process has a substantial impact on the image quality of the printed image.

Specifically, since ink does not easily spread on a recording medium with low absorbability, even when the dot position accuracy is slightly degraded, blank portions corresponding to portions where ink is not adequately applied may be created on the recording medium. The blank portions may cause irregularity and decrease of image density which lead to image quality degradation.

By using an imaging method according to an embodiment of the present invention upon forming an image on such a recording medium, dot position inaccuracies may be dispersed throughout the image to prevent image quality degradation.

In the following, an image forming apparatus that performs an imaging method according to an embodiment of the present invention and an image forming system including such an image forming apparatus are described.

As can be appreciated from the above descriptions, an imaging method according to an embodiment of the present invention prevents image quality degradation in a case where dot position accuracy is low. Such an effect may be further enhanced by using an image forming apparatus that can achieve higher dot position accuracy.

In this respect, according to a preferred embodiment, an image forming apparatus as is described below may be used.

It is noted that when a nozzle plate arranged at an ink outlet has adequate water repellent and ink repellent characteristics, desirable ink droplet formation (particle formation) may be enabled even in the case of using ink with low surface tension. Also, by enhancing the water repellent characteristics of the nozzle plate, a meniscus may be properly formed and ink may be prevented from being pulled in one direction upon being sprayed. As a result, ink spraying deviations may be reduced, and an image with high dot position accuracy may be obtained. According to one preferred embodiment, a water-repellent layer as is described below may be arranged on a surface of an inkjet head where ink outlets are arranged.

The surface roughness Ra of the water-repellent layer is preferably 0.2 μm or lower. Keeping the surface roughness Ra equal to or lower than 0.2 μm reduces the amount of ink that remains on the nozzle surface after wiping.

FIGS. 17 and 18A-18C are cross-sectional views of an exemplary inkjet head nozzle plate.

The illustrated nozzle plate includes a nozzle base material 602 that is formed by electroforming nickel and an ink repellent layer 601 corresponding to a silicon resin film having a film thickness of at least 0.1 μm that is formed on the surface of the nozzle base material 602. The surface roughness Ra of the ink repellent layer 601 is preferably 0.2 μm or lower. Also, the film thickness of the ink repellent layer 601 is more preferably at least 0.5 μm.

Figure 17:
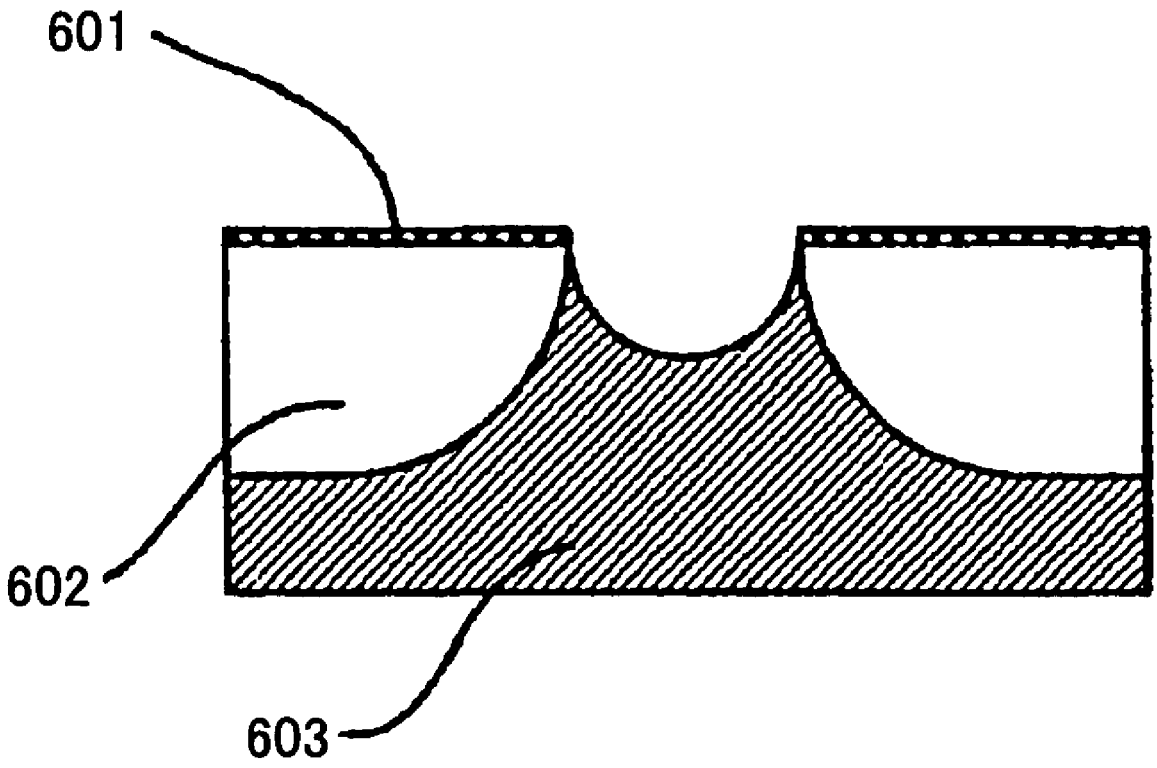
FIG. 17 is a cross-sectional view of an exemplary inkjet head nozzle plate.

It is noted that FIG. 17 illustrates a case in which ink 603 is filled in the ink nozzle. In this case, a meniscus (P) is formed at the border between the ink repellent layer 601 corresponding to a silicon resin film and the nozzle base material 602 as is shown in FIG. 18C.

By reducing the amount of ink remaining after wiping, ink spraying deviations upon discharging ink droplets from the ink outlet may be reduced, and the ink impact position accuracy may be improved. Further, by performing an imaging method according to an embodiment of the present invention in the present image forming apparatus, impact position deviations may be dispersed and evened out so that a printed image with higher image quality may be obtained.

In the following, the round shape of the inkjet head is described.

When a water-repellent layer is formed on a surface of a nozzle base material, the ink outlet portion of the water-repellent layer is preferably shaped so that the area of a cross section of the ink outlet taken along a plane that is orthogonal to a center line of the ink outlet increases gradually as the distance between the cross section and the surface of the nozzle base material increases.

Figure 18A:
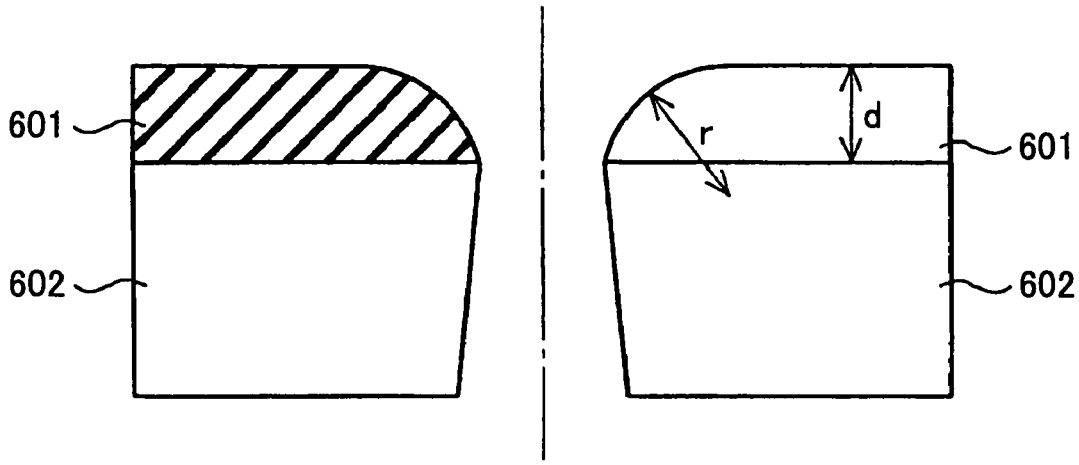
FIGS. 18A-18C are enlarged cross-sectional views of the exemplary inkjet head nozzle plate.
Figure 18B:
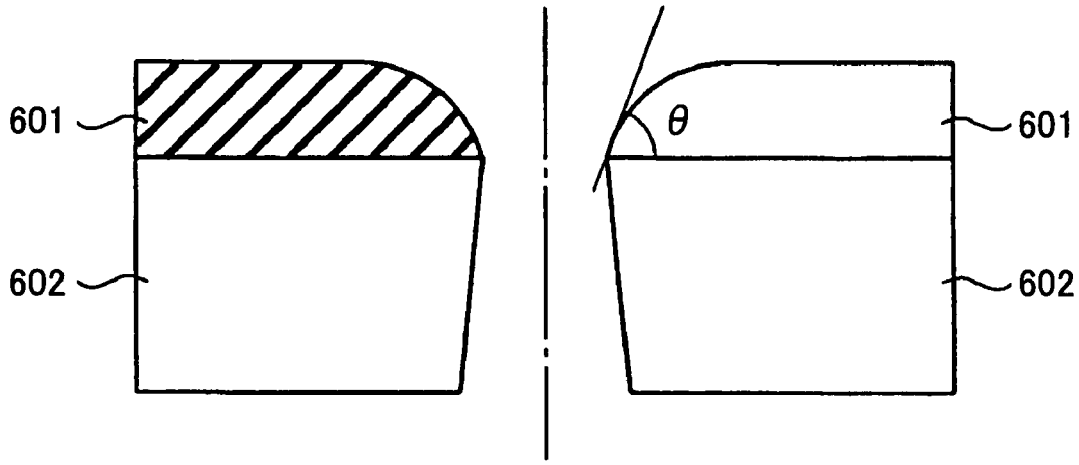
Figure 18C:
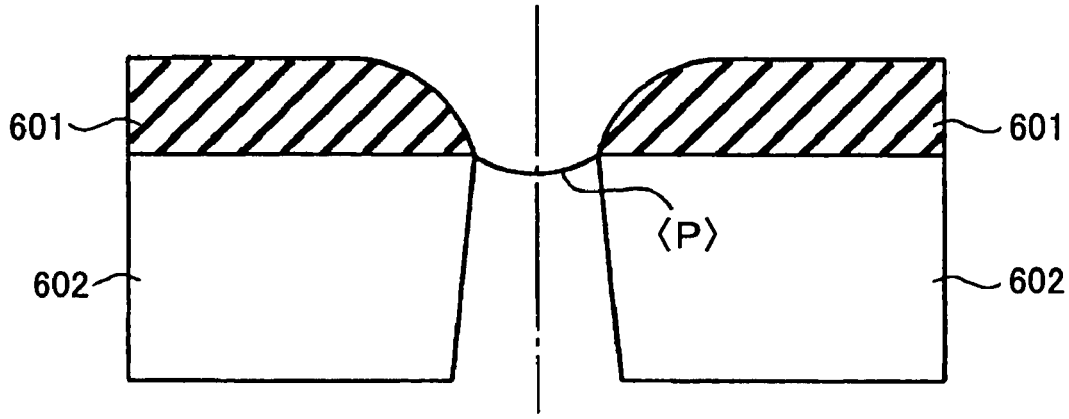

In other words, as is shown in FIGS. 18A-18C, portions of the ink repellent layer in the vicinity of the ink outlet are preferably arranged into a curved surface.

Also, the curvature radius of the curved line of the curved surface on a cross section of the ink repellent layer taken along a plane including the center line of the ink outlet is preferably longer than the film thickness of the ink repellent layer.

In other words, the curved line of the curved surface on a cross section of the ink repellent layer taken along a plane including the center line of the liquid drop spraying opening is preferably shaped like a circular arc and its curvature radius is preferably longer than the film thickness of the ink repellent layer.

Also, the angle formed between the surface of the nozzle base material and a tangential line touching the edge of the curved surface on a cross section of the water-repellent layer taken along a plane including the center line of the ink outlet is preferably less than 90 degrees.

As is shown in FIGS. 18A-18C, an opening of the nozzle base material 602 forming the ink outlet is arranged so that the shape of a cross section of the opening taken along a plane that is orthogonal to a center line represented by a dashed-dotted line in the drawings becomes approximately circular. An opening of the ink repellent layer 601 arranged on the surface of the nozzle base material 602 is shaped so that the area of a cross section of the opening taken along a plane that is orthogonal to the center line increases as the distance between the cross section and the surface of the nozzle base material 602 increases. In other words, the opening of the ink repellent layer is arranged so that its cross section area increases in the ink spraying direction.

More specifically, as shown in FIG. 18A, the portion of the ink repellent layer 601 surrounding the opening has a curved shape, and the curved line of the curved shape between the edge of the opening of the nozzle base material 602 and the surface of the ink repellent layer 601 has a curvature radius r. The curvature radius r is preferably longer than a thickness d of portions of the ink repellent layer 601 other than the portion surrounding the opening.

The thickness d of portions of the ink repellent layer 601 other than the portion surrounding the opening is preferably the maximum thickness of the ink repellent layer 601.

In this way, the opening of the ink repellent layer 601 forms a continuous opening with the opening of the nozzle base material 602, and the portion of the ink repellent layer 601 surrounding the opening has a curved shape with no angular edges. Shaping the ink repellent layer 601 as described above prevents a wiper blade made of rubber, for example, from getting caught at the boundary between the ink repellent layer 601 and the nozzle base material 602 and peeling the ink repellent layer 601 off the nozzle base material 602.

Also, as shown in FIG. 18B, an angle θ formed between the surface of the nozzle base material 602 and a tangential line b touching the edge of the curved shape surrounding the opening of the water-repellent layer 601 on a cross section taken along a plane including the center line is preferably less than 90 degrees.

As shown in FIG. 18C, when the angle θ between the surface of the nozzle base material 602 and the tangential line b is less than 90 degrees, the meniscus (liquid surface) P may be stably formed at the boundary of the nozzle base material 602 and the ink repellent layer 601, and the possibility of the meniscus P being formed at other portions may be greatly reduced.

By arranging the nozzle plate to have the above-described configuration, meniscus formation of ink may be stabilized so that the ink spraying stability may be improved in an image forming apparatus that uses an inkjet head including such a nozzle plate.

As for the silicone resin used as the ink repellent layer 601, a liquid silicone resin that cures at room temperature is preferable. Especially, a liquid silicone resin that cures at room temperature and has hydrolytic reactivity is preferable. In the present example, SR2411 manufactured by Dow Corning Toray Co. Ltd. is used.

Table 1 shown below indicates results of testing inkjet heads with various ink repellent layer configurations. Specifically, Table 1 indicates results of testing the ink buildup around the nozzle, peeling of the ink repellent layer 601 at the edge portion, and the spraying stability of the inkjet heads in relation to their edge configurations (i.e., configuration of the edge portions of the repellent layer 601 from the edge of the opening of the nozzle base material 602 to portions surrounding the opening of the ink repellent layer 601).

TABLE 1

| Edge shape | | Build-up of ink | Peeling of edge | Spray stability |
|---|---|---|---|---|
| Angular | | Partly occurred | Occurred | Good |
| Not angular (curved shape) | $\theta \leqq 90°$ | Not occurred | Not occurred | Good |
| | $\theta > 90°$ | Not occurred | Not occurred | Not good |
| | $r \geqq d$ | Not occurred | Not occurred | Good |
| | $r < d$ | Not occurred | Partly occurred | Not good |

As can be appreciated from table 1, when the edge portion of the ink repellent layer 601 (i.e., portion surrounding the opening of the ink repellent layer 601) is angular, ink buildup occurs around the nozzle and peeling of the ink repellent layer 601 occurs at the edge upon wiping the nozzle surface.

Figure 19A:
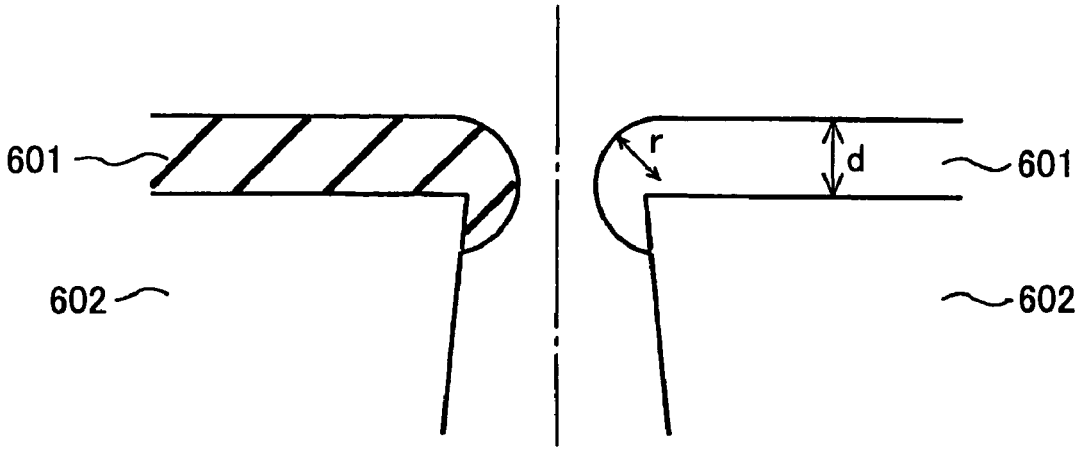
FIGS. 19A-19C are enlarged cross-sectional views of nozzle plates provided as comparative examples.
Figure 19B:
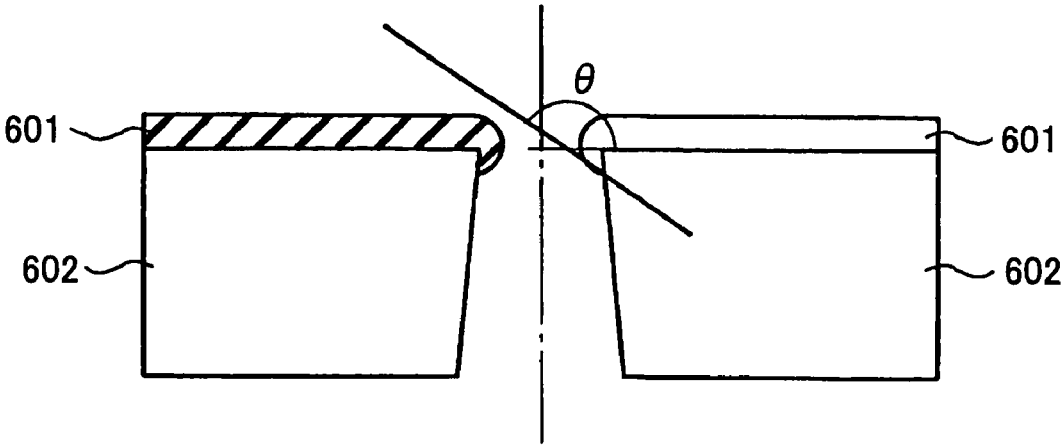

When the edge has a curved shape, ink buildup does not occur. However, when the edge is shaped as shown in FIG. 19A (r<d, comparative example), the ink repellent layer 601 is partially peeled at the edge; and when the edge is shaped as shown in FIG. 19B (θ>90°, comparative example), adequate spraying stability cannot be obtained.

Figure 19C:
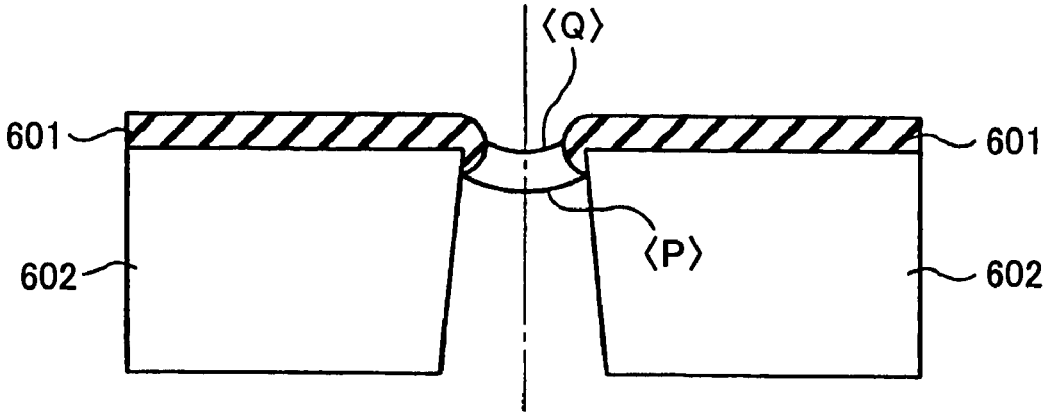

As shown in FIG. 19C, when r<d and/or θ>90°, the meniscus (liquid surface) may be formed either at the boundary of the nozzle base material 602 and the ink repellent layer 601 (meniscus P) or at the projecting point (where the cross section area of the opening of the ink repellent layer 601 becomes smallest) of the ink repellent layer 601 (meniscus Q). Thus, variations in ink spraying characteristics may occur and adequate spraying stability may not be obtained upon forming an image with an image forming apparatus using an inkjet head that includes a nozzle plate as shown in FIG. 19C.

In the following, an exemplary method of fabricating a nozzle area of an inkjet head according to an embodiment of the present invention is described.

Figure 20:
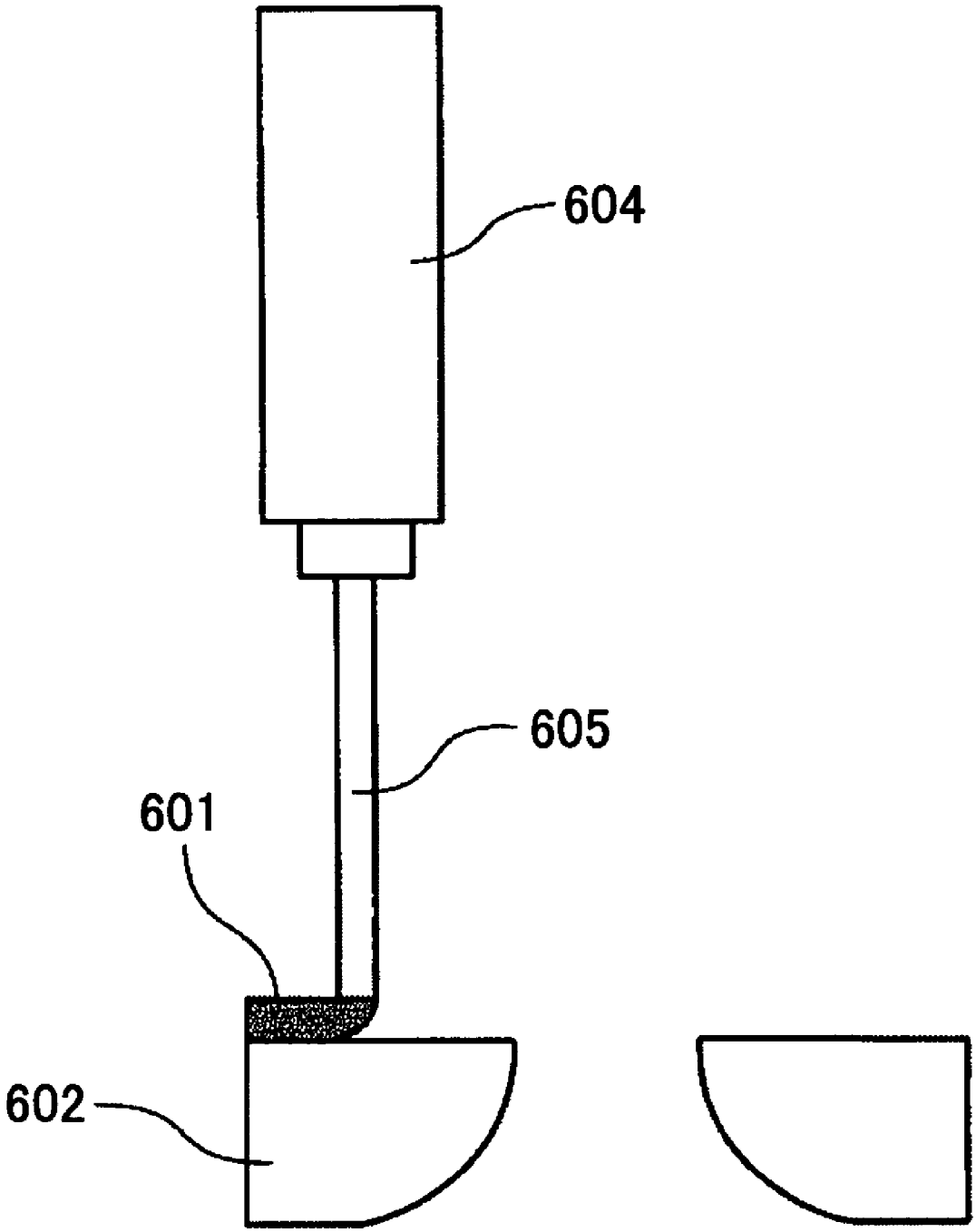
FIG. 20 is a diagram illustrating a process of fabricating an ink repellent layer of the inkjet head nozzle plate.

FIG. 20 is a diagram illustrating a step of fabricating the ink repellent layer according to an embodiment of the present invention.

In FIG. 20, a dispenser 604 for applying a silicone solution is positioned above the ink outlet surface of the nozzle base material 602, which is formed by electroforming nickel. The dispenser 604 is scanned over the nozzle base material 602 while maintaining a specific distance between the nozzle base material 602 and a needle 605. The needle 605 dispenses a silicone resin and thereby selectively forms an ink repellent layer composed of a silicone resin film on the ink outlet surface of the nozzle base material 602.

In one preferred embodiment, SR2411 (Dow Corning Toray Co. Ltd.), a silicone resin that cures at room temperature and has a viscosity of 10 mPa.s may be used. However, it is noted that in a test production using the above material, a small portion of the silicon resin overflowed into the nozzle hole and the back side of the nozzle plate. The silicone resin film (ink repellent layer) fabricated in the manner described above had a thickness of 1.2 μm and a surface roughness Ra of 0.18 μm.

Figure 21B:
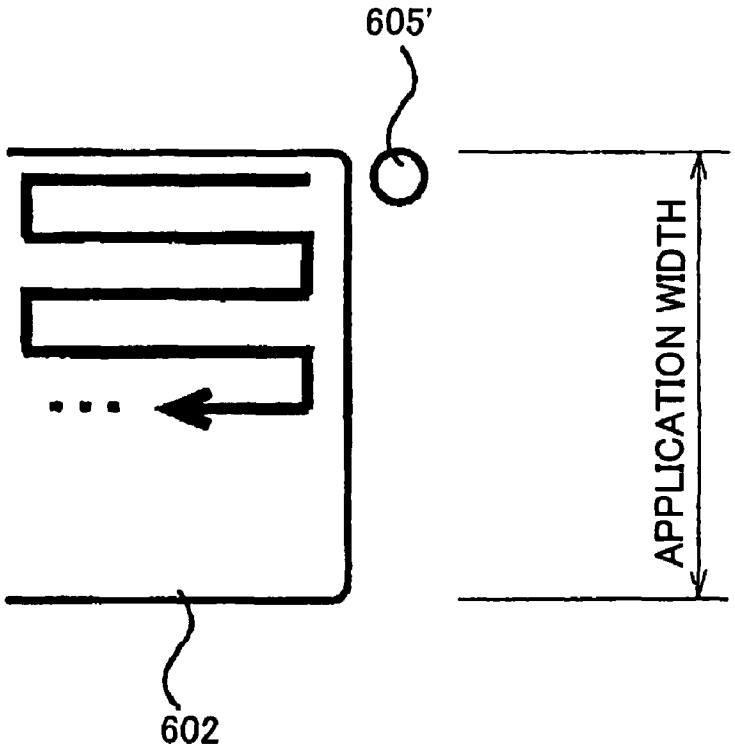
FIGS. 21A and 21B are diagrams illustrating exemplary methods of applying the ink repellent layer material depending on configurations of the nozzle plate and the tip portion of a dispensing needle.
Figure 21A:
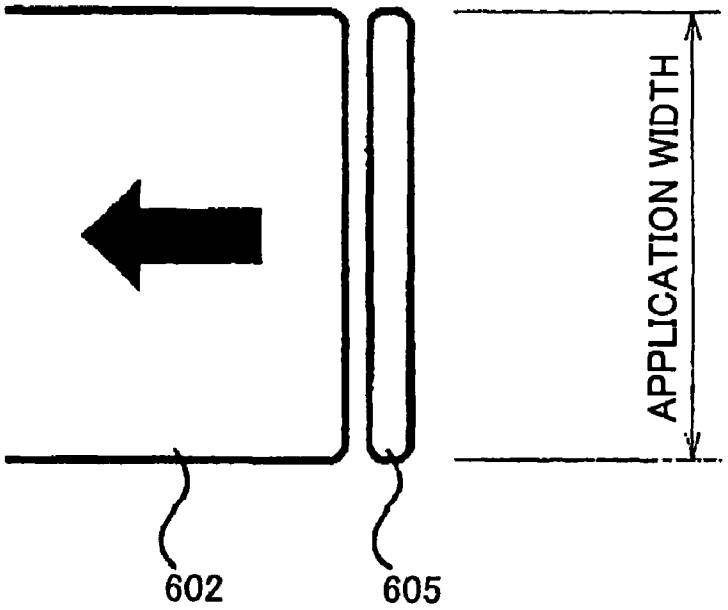

As shown in FIG. 21A, a dispensing opening at the tip of the needle 605 of the dispenser 604 has substantially the same width as that of the nozzle base material 602. The dispenser 604 as described above makes it possible to complete the application of silicone resin on the entire surface of the nozzle base material 602 by scanning the dispenser 604 only once in the application direction (the direction of the arrow shown in FIG. 21A).

In other words, the scanning direction of the dispenser 604 for applying the silicone resin may be arranged to only be in one direction so that the scanning direction may not have to be changed and switched to the opposite direction during the application operation as in the example of FIG. 21B.

It is noted that the width of a dispensing opening at the tip of a conventional needle 605' as is shown in FIG. 21B is narrower than the width of the nozzle base material 601 (application width). In this case, the dispenser 721 must be scanned back and forth in different directions. In other words, since the width of the needle 605' is substantially narrower than the width of the nozzle base material 602 (application width), the scanning direction of the dispenser 604 may have to be changed many times in different directions to complete the silicone resin application operation, which may involve repeating the process of changing the scanning direction by 90 degrees to move the application position of the needle 605' and then scanning the dispenser 604 in the opposite direction, for example. Therefore, with the conventional needle 605', it is difficult to apply silicon resin on an object at a uniform thickness.

In contrast, according to an embodiment of the present invention, by arranging the needle 605 to have a dispensing opening with substantially the same width as that of the nozzle base material 602, silicone resin may be applied on the nozzle base material 602 at a uniform thickness so that the ink repellent layer 601 may be accurately fabricated.

Figure 22:
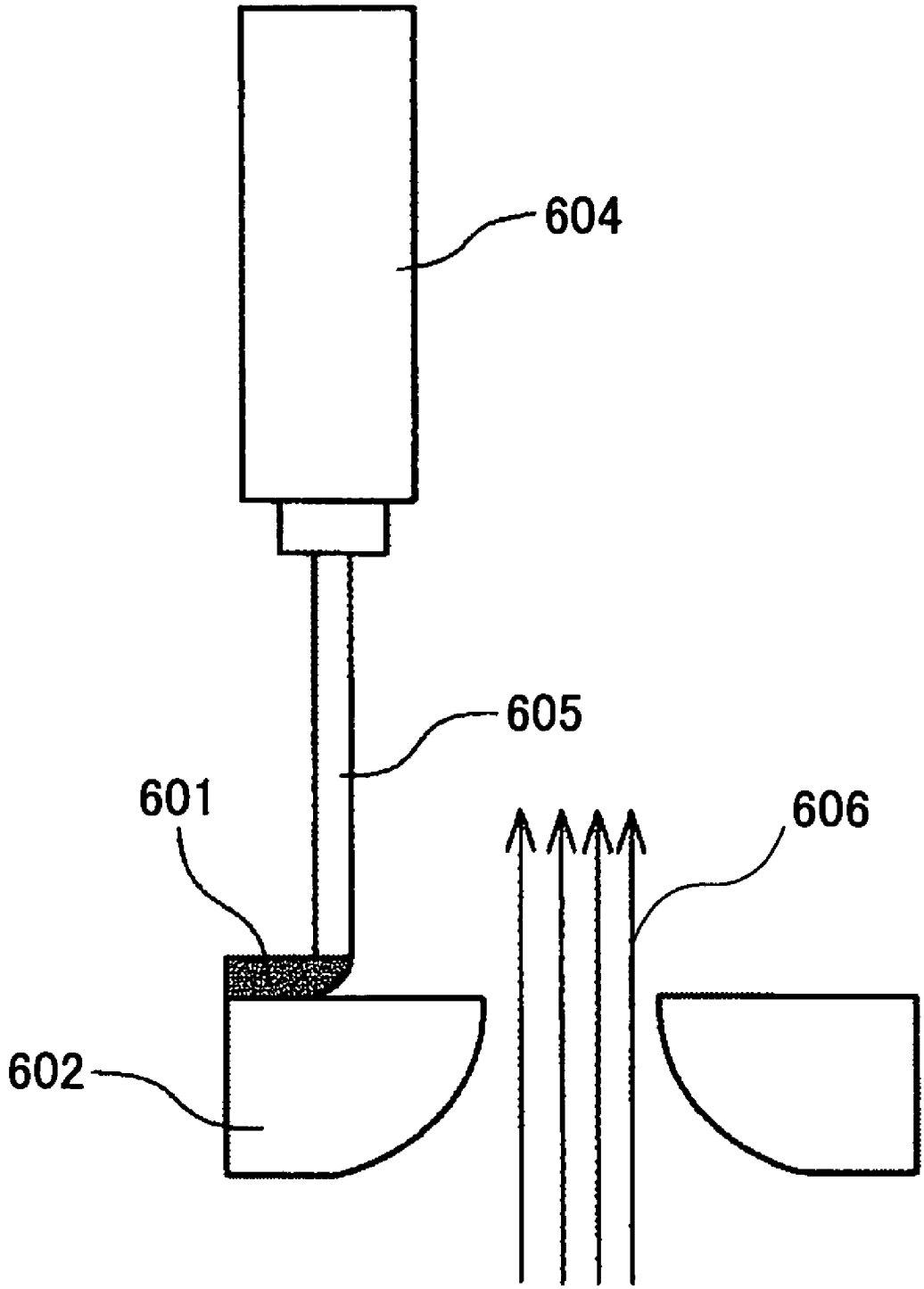
FIG. 22 is a diagram illustrating another exemplary process of fabricating the ink repellent layer.

FIG. 22 is a diagram illustrating another exemplary method of applying silicone resin using the dispenser 604. In this example, gas 606 is emitted from the nozzle hole (opening) while silicone resin is applied. It is noted that any type of gas, such as air, that does not easily react chemically with the silicone resin may be used as the gas 606.

By emitting the gas 606 from the nozzle hole while applying the silicone resin, the silicone resin film may only be applied to portions of the nozzle plate surface other than the surface of the nozzle hole.

Figure 23:
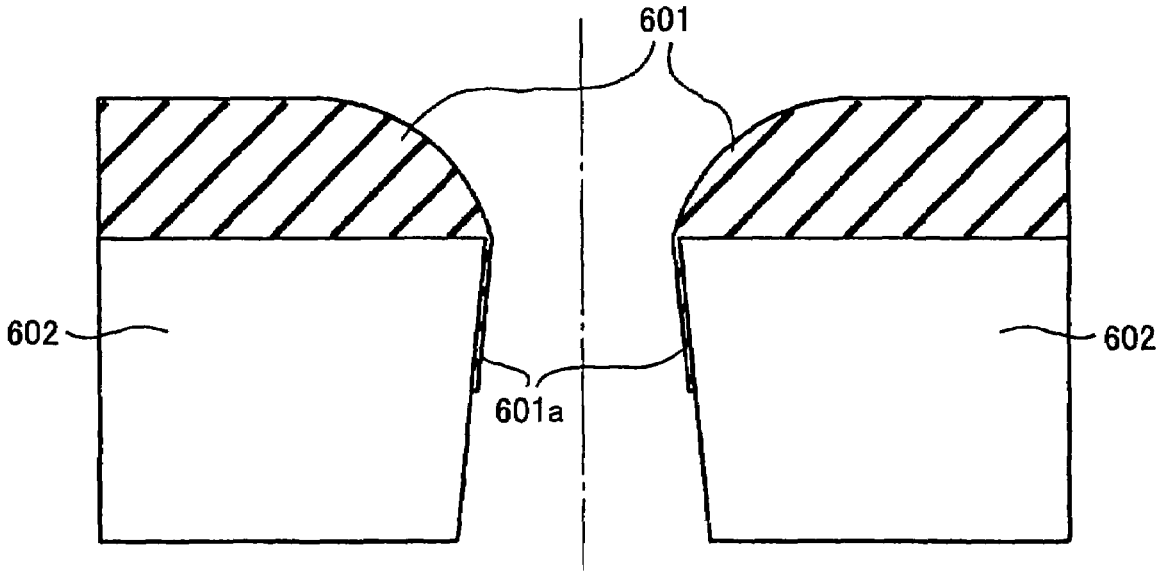
FIG. 23 is a diagram illustrating an ink repellent layer fabricated by an exempalry modified process.

In another example as shown in FIG. 23, the ink repellent layer made of silicon resin may be formed on the inner wall of the nozzle hole up to a predetermined depth (for example, several μm). In this case, the silicone resin is applied without emitting the gas 606 until the silicone resin reaches the predetermined depth, and the gas 606 may be emitted thereafter.

In this example, a very thin ink repellent layer 601*a* (ink repellent layer on the inner wall of the nozzle hole) may be formed extending from the edge of the opening of the nozzle base material 602 in addition to the ink repellent layer 601 formed on the ink outlet surface of the nozzle plate.

A wiping test was performed using EPDM rubber (rubber hardness: 50 degrees) on the ink repellent layer 601 of the nozzle plate fabricated in the above-described manner. The test revealed that desirable ink repellent characteristics of the ink repellent layer 601 may be maintained even after wiping the nozzle plate 1,000 times. In another test, the nozzle plate with the ink repellent layer 601 was immersed in ink with a temperature of 70° C. for 14 days. The test revealed that the ink repellent layer 602 could substantially retain its initial ink repellent characteristics even under such conditions.

In the following, the film thickness of the above ink repellent layer is described.

Figure 24:
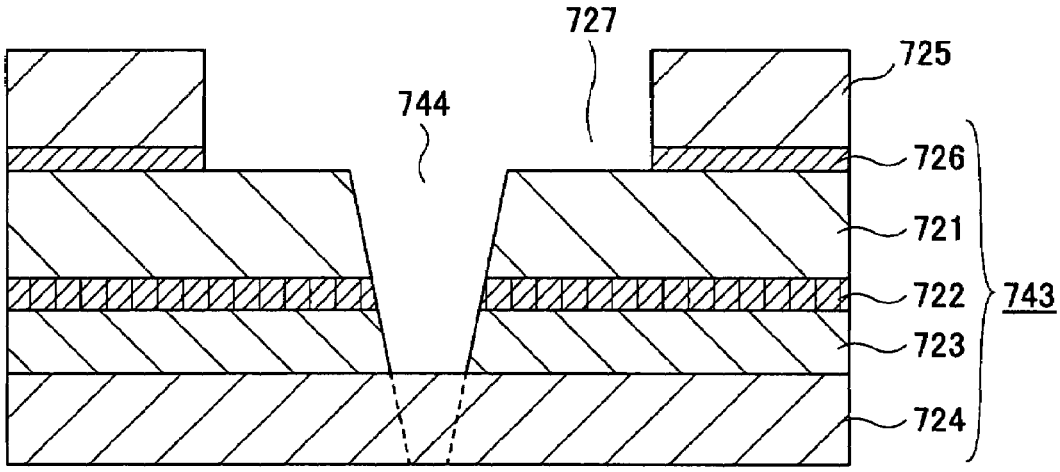
FIG. 24 is a cross-sectional view of another exemplary inkjet head nozzle plate.

FIG. 24 is a cross-sectional view of an exemplary inkjet head in which a nozzle hole is formed by excimer laser processing.

A nozzle plate 743 of the illustrated inkjet head includes a resin material 721 and a high rigidity material 725 that are bonded together by a thermoplastic adhesive 726. An $SiO_2$ thin-film layer 722 and a fluorine ink repellent layer 723 are successively deposited on the surface of the resin material 721. A nozzle hole 744 with a certain diameter is formed through the resin material 721 and a connecting nozzle hole 727 that connects with the nozzle hole 744 is formed through the high rigidity material 725.

To form the $SiO_2$ thin-film layer 722, a film forming method that can form a film with a temperature that does not affect the resin material 721 is used. For example, a sputtering method, an ion beam deposition method, an ion plating method, a chemical vapor deposition (CVD) method, and a plasma CVD (P-CVD) method may be used.

In terms of process time and material costs, the thickness of the $SiO_2$ thin-film layer 722 is preferably made as thin as possible to the extent that its adherency can be maintained. If the $SiO_2$ thin-film layer 722 is too thick, it may cause a problem in etching a nozzle hole with an excimer laser. More specifically, even when a nozzle hole was formed through the resin material 721 without any problem, a part of the $SiO_2$ thin-film layer 722 may not be etched and remain unprocessed.

The thickness of the $SiO_2$ thin-film layer 722 is preferably within a range of 0.1-30 nm, and more preferably within a range of 1-10 nm, so that adherency is maintained and no part of the $SiO_2$ thin-film layer 722 remains unprocessed. In an experiment, when the thickness of the $SiO_2$ thin-film layer 722 was 3 nm, sufficient adherency was obtained and there was no problem in the etching process by the excimer laser.

When the thickness was 30 nm, only a very small part of the $SiO_2$ thin-film layer 722 remained unprocessed to an extent that does not cause any practical problems. When the thickness was more than 30 nm, a substantial part of the $SiO_2$ thin-film layer 722 remained unprocessed to an extent that makes the nozzle unusable.

For the water-repellent layer 723, any material that repels ink may be used. For example, a fluorine water-repellent material or a silicone water-repellent material may be used.

There are many types of fluorine water-repellent materials. For example, in one experiment, it has been confirmed that adequate water repellent characteristics may be secured by depositing a mixture of perfluoropolyoxetane and modified perfluoropolyoxetane (Daikin Industries, Ltd., brand name: OPTOOL DSX) at a thickness within the range of 0.1-3 nm.

Specifically, in this experiment, samples of water-repellent layers made of OPTOOL DSX having thicknesses of 1 nm, 2 nm, and 3 nm were fabricated and tested. The test results revealed that the above samples of water repellent layers have substantially the same water repellent characteristics and wiping durability.

Also, in a preferred embodiment an adhesive tape 724 made of a resin film having adhesive applied thereon may be attached onto the surface of the fluorine water-repellent layer 723 so that the adhesive tape 724 may functions as a support during the excimer laser etching process.

As a silicone water-repellent material, a liquid silicone resin or an elastomer that cures at room temperature may be used. Such a silicone water-repellent material may be applied on the $SiO_2$ thin-film layer 722 so that it polymerizes and cures to form an ink-repellent coating.

Also, a liquid silicone resin or an elastomer that cures when irradiated with an ultraviolet ray may be used as a silicone water-repellent material. In this case, such a silicone water-repellent material applied on the $SiO_2$ thin-film layer 722 is irradiated with an ultraviolet ray so that it cures and forms an ink-repellent coating. The viscosity of a silicone water-repellent material is preferably 1,000 cP or lower.

Figure 25:
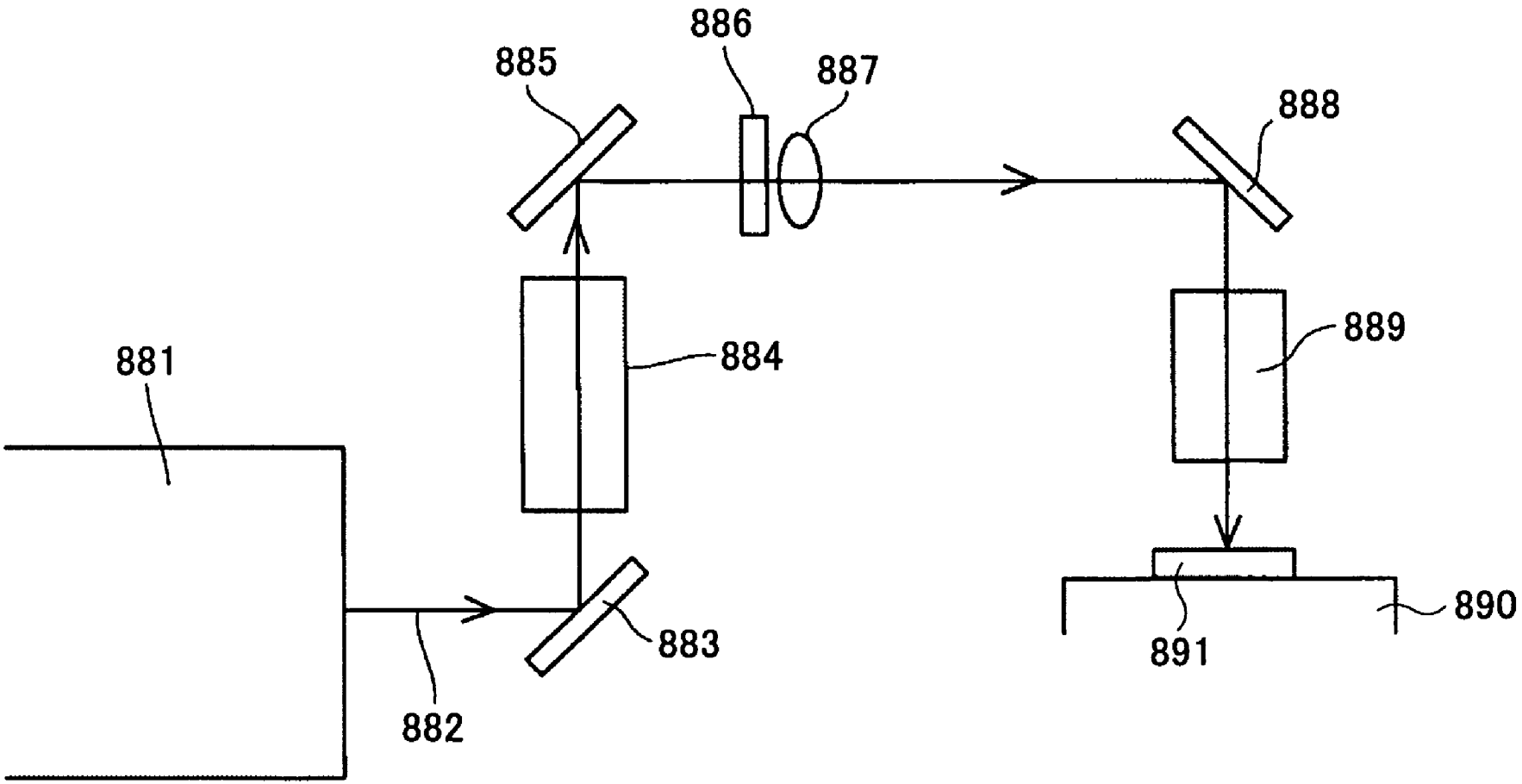
FIG. 25 is a diagram showing a configuration of an excimer laser device that is used for forming a nozzle hole.

FIG. 25 is a diagram showing a configuration of an exemplary excimer laser device for etching a nozzle hole.

An excimer laser beam 882 emitted from a laser oscillator 881 is reflected by mirrors 883, 885, and 888 and thereby guided to a processing table 890. Along the light path of the laser beam 882 from the laser oscillator 881 to the processing table 890, a beam expander 884, a mask 886, a field lens 887, and an imaging optical system 889 are provided at their respective positions so that an optimum laser beam is delivered to a processing object (nozzle plate) 891. The processing object 891 is placed on the processing table 890 to have the laser beam 882 irradiated thereon. For the processing table 890, a conventional XYZ table may be used, for example. The processing table 890 is able to change the positions of the object 891 so that any point on the processing object 891 can be irradiated with the laser beam 882. Although an excimer laser is used in the example described above, any short-wavelength ultraviolet laser that is capable of an ablation process may also be used.

FIGS. 26A-26F are diagrams illustrating process steps of fabricating the nozzle plate of an inkjet head.

Figure 26A:
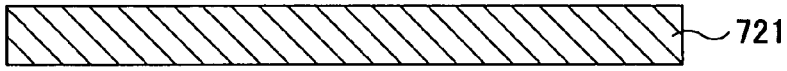
FIGS. 26A-26F are diagrams illustrating an exemplary process of fabricating the inkjet head nozzle plate of FIG. 24.

FIG. 26A shows a resin film 721 as a nozzle base material. The resin film 721 may be made of a polyimide film that contains no particles such as Kapton (brand name of DuPont). It is noted that a normal polyimide film contains particles of, for example, $SiO_2$ (silica) to make it easier for a roll film handling device to handle the polyimide film (to improve the slipperiness of the polyimide film). However, $SiO_2$ (silica) particles obstruct the etching process by an excimer laser and thereby make the shape of a nozzle irregular. Therefore, a polyimide film that does not contain $SiO_2$ (silica) particles is preferably used as the resin film 721.

Figure 26B:
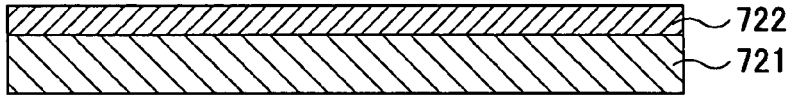

FIG. 26B illustrates a process of forming the $SiO_2$ thin-film layer 722 on the surface of the resin film 721. The $SiO_2$ thin-film layer 722 may preferably be formed using a sputtering method. The thickness of the $SiO_2$ thin-film layer 722 is preferably within a range of several angstroms (Å) to 2 nm, and more preferably within a range of 1-5 nm.

As for the sputtering method, the $SiO_2$ thin-film layer 722 is preferably formed by sputtering Si and then emitting $O_2$ ions onto the Si surface. In this way, adherency of the $SiO_2$ thin-film layer 722 to the resin film 721 may be improved, and the $SiO_2$ thin-film layer 722 may have desirable film quality, water repellency, and wiping durability, for example.

Figure 26C:
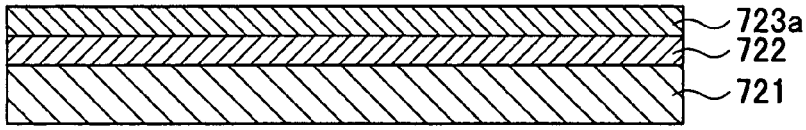

FIG. 26C illustrates a process of applying a fluorine water-repellent agent 723*a* on the $SiO_2$ thin-film layer 722. Although application methods such as spin coating, roll coating, screen printing, and spray coating may be used, a vacuum deposition method is preferable to improve the adherency of the water-repellent layer 723.

Also, the vacuum deposition is preferably performed just after the formation of the $SiO_2$ thin-film layer 722 in the same vacuum chamber. In this way, process steps may be simplified, and desirable film quality may be obtained.

As a fluorine water-repellent material, an amorphous compound such as perfluoropolyoxetane, modified perfluoropolyoxetane, or a mixture of them is preferably used to obtain sufficient ink repellency.

Figure 26D:
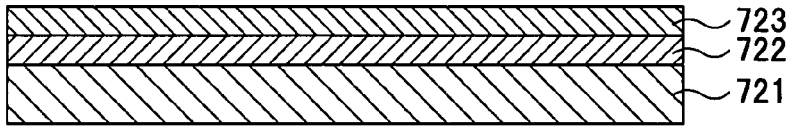

FIG. 26D illustrates a process of leaving the nozzle plate (processing object) in the atmosphere after depositing the fluorine water-repellent agent 723*a*. By performing such a process the fluorine water-repellent agent 723*a* binds chemically to the $SiO_2$ thin-film layer 722 using the moisture in the atmosphere as a medium, and thereby forms the fluorine water-repellent layer 723.

Figure 26E:
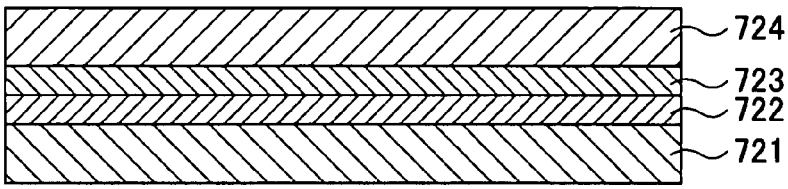

FIG. 26E illustrates a process of attaching the adhesive tape 724 on the fluorine water-repellent layer 723. The adhesive tape 724 is preferably placed at a position that is free of air bubbles. That is, if a nozzle hole is formed in a position where air bubbles reside, the quality of the nozzle hole may be degraded.

Figure 26F:
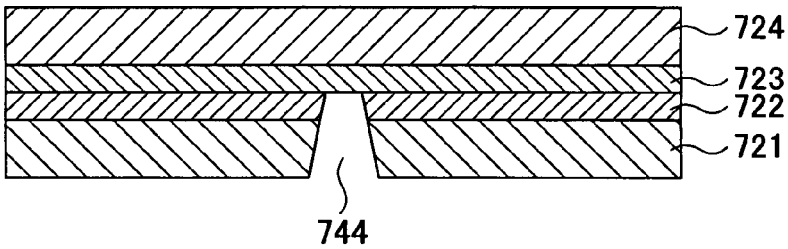

FIG. 26F illustrates a process of forming the nozzle hole 744. The nozzle hole 744 is formed by irradiating excimer laser on the above layered structure from the resin film 721 side. After the nozzle hole 744 is formed, the adhesive tape 724 is removed. In the exemplary process steps described above, a description of the step of forming the high rigidity material 725 shown in FIG. 24 for increasing the rigidity of the nozzle plate 743 is omitted. According to a preferred embodiment, such a step may performed between the steps shown in FIG. 26D and FIG. 26E.

Figure 27:
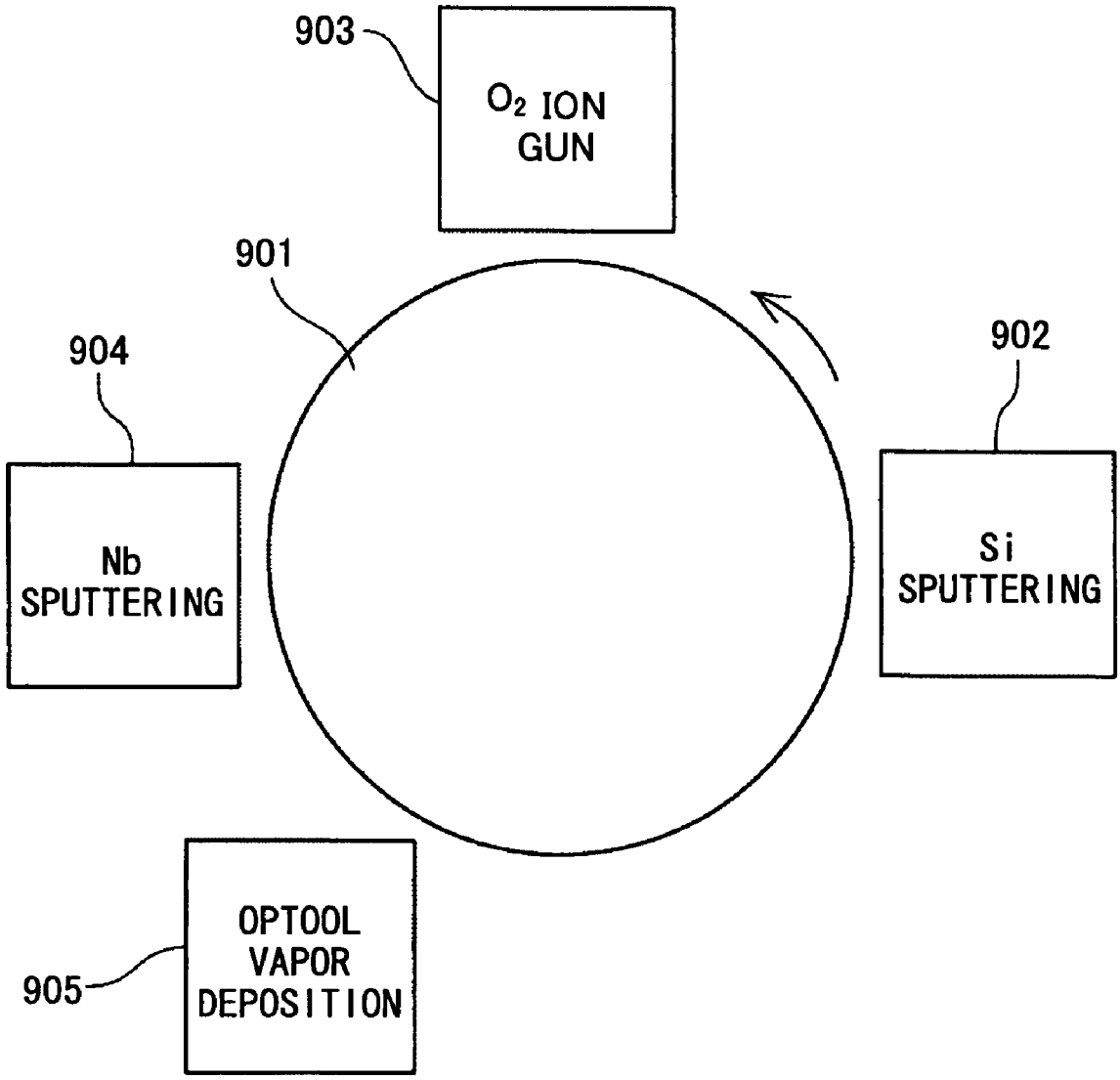
FIG. 27 is a diagram illustrating an exemplary apparatus used for fabricating an inkjet head.

FIG. 27 is a diagram showing a configuration of an exemplary apparatus used in the process of fabricating an inkjet head.

The illustrated apparatus implements the MetaMode(R) Thin Film Deposition Process developed by Optical Coating Laboratory, Inc. (OCLI) of the USA. The MetaMode(R) Thin Film Deposition Process is mainly used to fabricate antireflection/antifouling films of displays, for example.

The illustrated apparatus has an Si sputtering station 902, an $O_2$ ion gun station 903, an Nb sputtering station 904, and an OPTOOL vapor deposition station 905 placed at four positions around a drum 901 that rotates in the direction of the arrow. All the components are placed in a vacuum chamber.

The Si sputtering station 902 sputters Si onto the surface of a plate. The $O_2$ ion gun station 903 bombards the Si sputtered surface with $O_2$ ions to form an $SiO_2$ film. Then, the Nb sputtering station 904 and the OPTOOL vapor deposition station 905 may respectively deposit Nb and OPTOOL DSX on the $SiO_2$ film as is necessary or desired. Specifically, in the case of forming an antireflection film, layers of Nb and $SiO_2$ are deposited to achieve a desired thickness after which the layers are vaporized. In the case where functions of an antireflection film are not necessary or desired, Nb sputtering may not be necessary.

In the following, a preferable critical surface tension of the ink repellent layer is described.

The critical surface tension of the ink repellent layer is preferably within a range of 5-40 mN/m, and more preferably within a range of 5-30 mN/m. When the critical surface tension is greater than 30 mN/m, the wettability of the nozzle plate to ink becomes too high after long-term use and durability of the nozzle plate with respect to repeated use may not be adequate.

When the critical surface tension is greater than 40 mN/m, the wettability of the nozzle plate to ink may be too high even before use, and problems such as ink spraying deviations and abnormal droplet formation may occur.

In an experiment, three types of nozzle plates with different types of ink repellent layers made of ink repellent materials as indicated in table 2 shown below were prepared and the critical surface tensions of the ink repellent layers were measured. It is noted that the ink repellent layers were formed by applying the ink repellent materials on aluminum plates and drying the materials through heating.

TABLE 2

| Manufaturer | Product name | Critical surface tension (mN/m) | Spray stability |
|---|---|---|---|
| Dow Corning Toray Co. Ltd. | SR2411 | 21.6 | Good |
| Shin-Etsu Chemical Co., Ltd. | KBM7803 | 16.9 | Good |
| Shin-Etsu Chemical Co., Ltd. | KP801M | 6.6 | Good |

The critical surface tension may be obtained by the Zisman method. According to this method, drops of liquids with known surface tensions are placed on the ink repellent layer and the angles of contact θ of the liquid drops are measured. The surface tensions of the liquids are plotted on the x axis and the cosines of the contact angles (cos θ) are plotted on the y axis. As a result, a downward sloping line (Zisman Plot) is obtained. The surface tension when y=1 (θ=0) on this line is calculated as the critical surface tension γc of the ink repellent layer. Also, the critical surface tension can be obtained using other methods such as the Fowkes method, the Owens and Wendt method, or the Van Oss method, for example.

In another experiment, inkjet heads were fabricated using the nozzle plates having the above-described ink repellent layers.

Testing was conducted by having these inkjet heads spray ink and filming the behavior of the sprayed ink by video for observation purposes. The tests revealed that ink drops can be normally formed and the adequate spraying stability can be obtained in all of the above nozzle plates.

As can be appreciated from the above descriptions, by arranging an ink repellent layer on a nozzle plate, ink spraying stability may be improved, and faults such as spraying deviations may be prevented. Also, even when ink with a low surface tension is used, since high dot position accuracy may be achieved in an embodiment of the present invention, the ink may be accurately applied to a recording medium even when the recording medium has low absorbability. In this way, irregularities or a decrease in the image density may be prevented and a printed image with high image quality may be obtained.

A nozzle plate according to an embodiment of the present invention has excellent water repellency (or ink repellency) and therefore can form ink drops normally even when an ink with a low surface tension is used. More specifically, a nozzle plate according to an embodiment of the present invention has low wettability and therefore a meniscus of an ink is formed normally. A normally formed meniscus prevents the ink from being drawn to one side so that ink spraying deviations may be prevented and an image with high dot position accuracy may be obtained. It is noted that an imaging method according to an embodiment of the present invention may be used in an image forming apparatus with low dot position accuracy to prevent image quality degradation. Also, such an imaging method may be used in an image forming apparatus with high dot accuracy to achieve further improvements in image quality, for example.

In the following, a preferred recording material used in an imaging method according to an embodiment of the present invention is described.

An ink used in an embodiment of the present invention contains at least water, a colorant, and a humectant, and may also include a penetrant, a surfactant, and other components.

The surface tension of the ink at 25° C. is preferably between 15 and 40 mN/m, and more preferably between 20 and 35 mN/m. When the surface tension of an ink is less than 15 mN/m, the wettability of the nozzle plate to the ink becomes too high. As a result, ink drops may not be formed normally, bleeding may occur on a recording medium, and ink spray stability may be reduced. When the surface tension of an ink is greater than 40 mN/m, the penetration capability of the ink is reduced, beading may occur, and the drying time may be prolonged.

The surface tension of an ink is measured, for example, by a surface tensiometer (for example, CBVP-Z of Kyowa Interface Science Co., Ltd.) with a platinum plate at a temperature of 25° C.

As a colorant, a pigment, a dye, and colored particles may be used individually or in combination.

As colored particles, an aqueous dispersion liquid of polymer microparticles containing at least a pigment or a dye as a colorant is preferably used.

"Containing" in this case means that a colorant is encapsulated in the polymer microparticles, a colorant is absorbed by the polymer microparticles, or both. However, a colorant may not be necessarily encapsulated in or absorbed by polymer microparticles, but may be dispersed in an emulsion as long as the resulting ink has characteristics suitable for the present invention. Any water-insoluble or poorly water-soluble colorant that can be absorbed by polymer microparticles may be used depending on the purpose.

"Water-insoluble" or "poorly water-soluble" in this case indicates that the maximum amount of a colorant that can dissolve in water at a temperature of 20° C. is less than a mass ratio of 10:100 (colorant:water). Also, "dissolve" means that no separation or sediment of a colorant is identified on the surface or bottom of the solution by eye observation.

The volume average particle diameter of a polymer microparticle (colored particle) containing a colorant is preferably between 0.01 and 0.16 μm in an ink. When the volume average particle diameter is less than 0.01 μm, the fluidity of polymer microparticles becomes very high and, as a result, bleeding may occur or the light resistance of the ink may become low. When the volume average particle diameter is more than 0.16 μm, nozzles may be clogged or color development of the ink may be inhibited.

As a colorant, for example, a water-soluble dye, an oil-soluble dye, a disperse dye, or a pigment may be used. An oil-soluble dye and a disperse dye is preferable in terms of absorbability and encapsulation. A pigment is preferable in terms of the light resistance of an image formed.

To be efficiently absorbed by polymer microparticles, the amount of a dye soluble in an organic solvent, such as a ketone solvent, is preferably 2 g/l or more, and more preferably between 20 and 600 g/l.

As a water-soluble dye, a dye categorized as an acid dye, a direct dye, a basic dye, a reactive dye, or a food dye in the Color Index may be used. Especially, a dye with high water-resistance and high light resistance is preferable.

For example, the following acid dyes and food dyes may be used: C. I. Acid Yellow 17, 23, 42, 44, 79, 142; C. I. Acid Red 1, 8, 13, 14, 18, 26, 27, 35, 37, 42, 52, 82, 87, 89, 92, 97, 106, 111, 114, 115, 134, 186, 249, 254, 289; C. I. Acid Blue 9, 29, 45, 92, 249; C. I. Acid Black 1, 2, 7, 24, 26, 94; C. I. Food Yellow 3, 4; C. I. Food Red 7, 9, 14; and C. I. Food Black 1, 2.

For example, the following direct dyes may be used: C. I. Direct Yellow 1, 12, 24, 26, 33, 44, 50, 86, 120, 132, 142, 144; C. I. Direct Red 1, 4, 9, 13, 17, 20, 28, 31, 39, 80, 81, 83, 89, 225, 227; C. I. Direct Orange 26, 29, 62, 102; C. I. Direct Blue 1, 2, 6; 15, 22, 25, 71, 76, 79, 86, 87, 90, 98, 163, 165, 199, 202; and C. I. Direct Black 19, 22, 32, 38, 51, 56, 71, 74, 75, 77, 154, 168, 171.

For example, the following basic dyes may be used: C. I. Basic Yellow 1, 2, 11, 13, 14, 15, 19, 21, 23, 24, 25, 28, 29, 32, 36, 40, 41, 45, 49, 51, 53, 63, 64, 65, 67, 70, 73, 77, 87, 91; C. I. Basic Red 2, 12, 13, 14, 15, 18, 22, 23, 24, 27, 29, 35, 36, 38, 39, 46, 49, 51, 52, 54, 59, 68, 69, 70, 73, 78, 82, 102, 104, 109, 112; C. I. Basic Blue 1, 3, 5, 7, 9, 21, 22, 26, 35, 41, 45, 47, 54, 62, 65, 66, 67, 69, 75, 77, 78, 89, 92, 93, 105, 117, 120, 122, 124, 129, 137, 141, 147, 155; and C. I. Basic Black 2, 8.

For example, the following reactive dyes may be used: C. I. Reactive Black 3, 4, 7, 11, 12, 17; C. I. Reactive Yellow 1, 5, 11, 13, 14, 20, 21, 22, 25, 40, 47, 51, 55, 65, 67; C. I. Reactive Red 1, 14, 17, 25, 26, 32, 37, 44, 46, 55, 60, 66, 74, 79, 96, 97; and C. I. Reactive Blue 1, 2, 7, 14, 15, 23, 32, 35, 38, 41, 63, 80, 95.

Any pigment, either an inorganic pigment or an organic pigment, may be used depending on the purpose.

For example, the following inorganic pigments may be used: titanium oxide, iron oxide, calcium carbonate, barium sulfate, aluminum hydroxide, barium yellow, cadmium red, chrome yellow, and carbon black. Among them, carbon black is especially preferable. Carbon blacks produced by a contact method, a furnace method, or a thermal method may be used.

The following organic pigments, for example, may be used: azo pigment, polycyclic pigment, dye chelate, nitro pigment, nitroso pigment, and aniline black. Especially, azo pigment and polycyclic pigment are preferable. As an azo pigment, for example, azo lake pigment, insoluble azo pigment, condensed azo pigment, or chelate azo pigment may be used. As a polycyclic pigment, for example, phthalocyanine pigment, perylene pigment, perynone pigment, anthraquinone pigment, quinacridone pigment, dioxazine pigment, indigo pigment, thioindigo pigment, isoindolinon pigment, or quinofraron pigment may be used. As a dye chelate, for example, basic dye chelate or acid dye chelate may be used.

A pigment of any color, for example, a black pigment or a color pigment, may be used depending on the purpose. The above substances may be used individually or in combination.

For a black ink, for example, the following pigments may be used: a carbon black (C. I. Pigment Black 11) such as furnace black, lamp black, acetylene black, or channel black; a metallic pigment such as copper, iron (C. I. Pigment Black 11), or titanium oxide pigment; and an organic pigment such as aniline black.

For a yellow ink, for example, the following pigments may be used: C. I. Pigment Yellow 1 (Fast Yellow G), 3, 12 (Disazo Yellow AAA), 13, 14, 17, 23, 24, 34, 35, 37, 42 (yellow iron oxide), 53, 55, 74, 81, 83 (Disazo Yellow HR), 95, 97, 98, 100, 101, 104, 108, 109, 110, 117, 120, 128, 138, 150, 153.

For a magenta ink, for example, the following pigments may be used: C. I. Pigment Red 1, 2, 3, 5, 17, 22 (Brilliant Fast Scarlet), 23, 31, 38, 48:2 (Permanent Red 2B (Ba)), 48:2 (Permanent Red 2B (Ca)), 48:3 (Permanent Red 2B (Sr)), 48:4 (Permanent Red 2B(Mn)), 49:1, 52:2, 53:1, 57:1 (Brilliant Carmine 6B), 60:1, 63:1, 63:2, 64:1, 81 (Rhodamine 6G lake), 83, 88, 92, 101 (colcothar), 104, 105, 106, 108 (cadmium red), 112, 114, 122 (dimethyl quinacridone), 123, 146, 149, 166, 168, 170, 172, 177, 178, 179, 185, 190, 193, 209, 219.

For a cyan ink, for example, the following pigments may be used: C. I. Pigment Blue 1, 2, 15 (Copper Phthalocyanine Blue R), 15:1, 15:2, 15:3 (Phthalocyanine Blue G), 15:4, 15:6 (Phthalocyanine Blue E), 16, 17:1, 56, 60, 63.

For neutral colors such as red, green, and blue, for example, the following pigments may be used: C. I. Pigment Red 177, 194, 224; C. I. Pigment Orange 43; C. I. Pigment Violet 3, 19, 23, 37; and C. I. Pigment Green 7, 36.

As a pigment, a self-dispersing pigment is preferable. A self-dispersing pigment has at least one type of hydrophilic group attached directly or via another atomic group to its surface, and is therefore stably dispersible without using a dispersing agent. Especially, an ionic self-dispersing pigment such as an anionic self-dispersing pigment or a cationic self-dispersing pigment is preferable.

The volume average particle diameter of a self-dispersing pigment is preferably between 0.01 and 0.16 μm in an ink.

Examples of anionic hydrophilic groups include —COOM, —SO3M, —PO3HM, —PO3M2, —SO2NH2, and —SO2NHCOR (in the formulas, M indicates a hydrogen atom, alkali metal, ammonium, or organic ammonium; and R indicates an alkyl group with 1-12 carbon atoms, a phenyl group with or without a substituent group, or a naphthyl group with or without a substituent group). A color pigment with —COOM or —SO3M attached to its surface is especially preferable.

Examples of alkali metals indicated by M in the hydrophilic groups include lithium, sodium, and potassium. Examples of organic ammoniums include monomethyl or trimethyl ammonium, monoethyl or triethyl ammonium, and monomethanol or trimethanol ammonium. To attach —COONa to the surface of a color pigment and thereby to obtain an anionic color pigment, the color pigment is, for example, oxidized with sodium hypochlorite, sulfonated, or reacted with diazonium salt.

As a cationic hydrophilic group, a quaternary ammonium group is preferable. Especially, quaternary ammonium groups represented by the formulas shown below are preferable. A colorant containing a pigment with any one of the quaternary ammonium groups attached to its surface is preferably used.

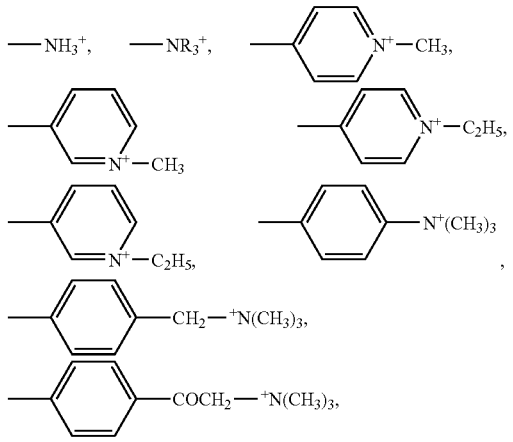

-continued

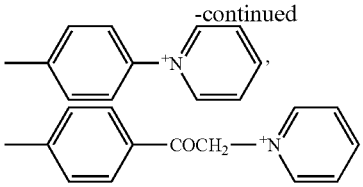

Any method may be used to produce a cationic self-dispersing carbon black having a hydrophilic group depending on the purpose. For example, to attach an N-ethyl-pyridyl group represented by the formula shown below, a carbon black is processed with 3-amino-N-ethylpyridium bromide.

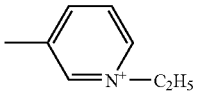

A hydrophilic group may be attached to the surface of a carbon black via another atomic group. As such an atomic group, for example, an alkyl group with 1-12 carbon atoms, a phenyl group with or without a substituent group, or a naphthyl group with or without a substituent group may be used. Exemplary combinations of a hydrophilic group and an atomic group to be attached to the surface of a carbon black include —C2H4COOM (M indicates alkali metal or quaternary ammonium), -PhSO3M (Ph indicates a phenyl group and M indicates alkali metal or quaternary ammonium), and —C5H10NH3+.

Also, a pigment dispersion liquid with a pigment dispersing agent may be used.

Natural hydrophilic polymers usable as pigment dispersing agents include vegetable polymers such as acacia gum, tragacanth gum, goor gum, karaya gum, locust bean gum, arabinogalactan, pectin, and quince seed starch; seaweed polymers such as alginic acid, carrageenan, and agar; animal polymers such as gelatin, casein, albumin, and collagen; and microbial polymers such as xanthene gum and dextran. Semi-synthetic polymers usable as pigment dispersing agents include cellulose polymers such as methyl cellulose, ethyl cellulose, hydroxyethyl cellulose, hydroxypropyl cellulose, and carboxymethyl cellulose; starch polymers such as sodium carboxymethyl starch and starch glycolic acid sodium; and seaweed polymers such as sodium alginate and propylene glycol esters alginate. Synthetic polymers usable as pigment dispersing agents include vinyl polymers such as polyvinyl alcohol, polyvinylpyrrolidone, and polyvinyl methyl ether; acrylic resins such as non-crosslinked polyacrylamide, polyacrylic acid, alkali metal salt of polyacrylic acid, and water-soluble styrene acrylic resin; water-soluble styrene-maleic acid resin; water-soluble vinylnaphthalene acrylic resin; water soluble vinylnaphthalene-maleic acid resin, polyvinylpyrrolidone; alkali metal salt of β-naphthalenesulfonic acid formalin condensate; polymers having a salt of a cationic functional group such as quaternary ammonium or an amino group as a side chain, and natural polymers such as shellac. Among them, a copolymer with an introduced carboxyl group and made up of a homopolymer of acrylic acid, methacrylic acid, or styrene acrylic acid and a monomer having a hydrophilic group is especially preferable.

The weight-average molecular weight of the above copolymer is preferably between 3,000-50,000 and more preferably between 7,000-15,000.

The mass ratio of an pigment to a dispersing agent is preferably between 1:0.06 and 1:3, and more preferably between 1:0.125 and 1:3.

The mass percentage of a colorant in an ink is preferably between 6 and 15%, and more preferably between 8 and 12%. When the mass percentage of a colorant is lower than 6%, the tinting strength and the viscosity of the ink become low. Low tinting strength results in low image density and low viscosity may cause feathering and bleeding. When the mass percentage of a colorant is more than 15%, the ink dries fast and may clog the nozzles on an ink jet recording apparatus. Also, the viscosity of the ink becomes very high and, as a result, the penetration capability of the ink becomes low. Drops of such an ink with high viscosity do not spread smoothly and lead to low image density.

Any humectant may be used depending on the purpose. For example, a polyol compound, a lactam compound, a urea compound, and a saccharide may be used individually or in combination.

Examples of polyol compounds include polyhydric alcohols, polyhydric alcohol alkyl ethers, polyhydric alcohol arylethers, nitrogen containing heterocyclic compounds, amides, amines, sulfur-containing compounds, propylene carbonate, and ethylene carbonate. The above substances may be used individually or in combination.

Examples of polyhydric alcohols include ethylene glycol, diethylene glycol, triethylene glycol, polyethylene glycol, polypropylene glycol, 1,3-propanediol, 1,3-butanediol, 1,4-butanediol, 3-methyl-1,3-butanediol,1,3-propanediol, 1,5-pentanediol, 1,6-hexanediol, glycerol, 1,2,6-hexanetriol, 1,2,4-butanetriol, 1,2,3-butanetriol, and petriol.

Examples of polyhydric alcohol alkyl ethers include ethylene glycol monoethyl ether, ethylene glycol monobutyl ether, diethylene glycol monomethyl ether, diethylene glycol monoethyl ether, diethylene glycol monobutyl ether, tetraethylene glycol monomethyl ether, and propylene glycol monoethyl ether.

Examples of polyhydric alcohol aryl ethers include ethylene glycol monophenyl ether and ethylene glycol monobenzyl ether.

Examples of nitrogen containing heterocyclic compounds include N-methyl-2-pyrrolidone, N-hydroxyethyl-2-pyrrolidone, 2-pyrrolidone, 1,3-dimethyl imidazolidinone, and ,,-caprolactam.

Examples of amides include formamide, N-methylformamide, and N,N-dimethylformamide.

Examples of amines include monoethanolamine, diethanolamine, triethanolamine, monoethylamine, diethylamine, and triethylamine.

Examples of sulfur-containing compounds include dimethyl sulfoxide, sulfolane, and thiodiethanol.

Among them, the following substances have excellent solubility and beneficial effects in preventing degradation of spray performance caused by evaporation of moisture and are therefore preferable: glycerin, ethylene glycol, diethylene glycol, triethylene glycol, propylene glycol, dipropylene glycol, tripropylene glycol, 1,3-butanediol, 2,3-butanediol, 1,4-butanediol, 3-methyl-1,3-butanediol,1,3-propanediol, 1,5-pentanediol, tetraethylene glycol, 1,6-hexanediol, 2-methyl-2,4-pentanediol, polyethylene glycol, 1,2,4-butanetriol, 1,2,6-hexanetriol, thiodiglycol, 2-pyrrolidone, N-methyl-2-pyrrolidone, and N-hydroxyethyl-2-pyrrolidone.

As a lactam compound, for example, at least any one of the following may be used: 2-pyrrolidone, N-methyl-2-pyrrolidone, N-hydroxyethyl-2-pyrrolidone, and ,,-caprolactam.

As a urea compound, for example, at least any one of the following may be used: urea, thiourea, ethyleneurea, and 1,3-dimethyl-2-imidazolidinone. The mass percentage of a urea compound in an ink is preferably between 0.5 and 50%, and more preferably between 1 and 20%.

Examples of saccharides include monosaccharide, disaccharide, oligosaccharide (including trisaccharide and tetrasaccharide), polysaccharide, and their derivatives. Among the above saccharides, glucose, mannose, fructose, ribose, xylose, arabinose, galactose, maltose, cellobiose, lactose, sucrose, trehalose, and maltotriose are preferable; and multitose, sorbitose, gluconolactone, and maltose are especially preferable.

Polysaccharides are saccharides in a broad sense and may include substances found in nature such as α-cyclodextrin and cellulose.

Examples of saccharide derivatives include reducing sugar (for example, sugar alcohol: HOCH2(CHOH)nCH2OH [n is an integer between 2 and 5]), oxidized saccharide (for example, aldonic acid and uronic acid), amino acid, and thioacid. Among the above saccharide derivatives, a sugar alcohol is especially preferable. Examples of sugar alcohols include maltitol and sorbitol.

The mass percentage of a humectant in an ink is preferably between 10 and 50%, and more preferably between 20 and 35%. When the amount of a humectant is very small, nozzles tend to easily dry and the spray performance is reduced. When the amount of a humectant is too large, the viscosity of the ink may become too high.

As a penetrant, for example, a water-soluble organic solvent such as a polyol compound or a glycol ether compound may be used. Especially, a polyol compound with 8 or more carbon atoms or a glycol ether compound is preferable.

When the number of carbon atoms of a polyol compound is less than 8, the penetration capability of the ink may become insufficient. An ink with low penetration capability may smear a recording medium in double side printing. Also, since such an ink do not spread smoothly on a recording medium, some pixels may be left blank, and as a result, the quality of characters may be reduced and the density of an image may become low.

Examples of polyol compounds with 8 or more carbon atoms include 2-ethyl-1,3-hexanediol (solubility: 4.2% (25° C.)) and 2,2,4-trimethyl-1,3-pentanediol (solubility: 2.0% (25° C.)).

Any glycol ether compound may be used depending on the purpose. Examples of glycol ether compounds include polyhydric alcohol alkyl ethers such as ethylene glycol monoethyl ether, ethylene glycol monobutyl ether, diethylene glycol monomethyl ether, diethylene glycol monoethyl ether, diethylene glycol monobutyl ether, tetraethylene glycol monomethyl ether, and propylene glycol monoethyl ether; and polyhydric alcohol aryl ethers such as ethylene glycol monophenyl ether and ethylene glycol monobenzyl ether.

There is no specific limit to the amount of a penetrant in an ink. However, the amount of a penetrant is preferably between 0.1 and 20 mass percent, and more preferably between 0.5 and 10 mass percent.

Any surfactant may be used depending on the purpose. For example, an anion surfactant, a nonion surfactant, an amphoteric surfactant, or a fluorinated surfactant may be used. Examples of anion surfactants include polyoxyethylene alkyl ether acetate, dodecylbenzenesulfonate, laurylate, and salt of polyoxyethylene alkyl ether sulfate.

Examples of nonion surfactants include acetylene glycol surfactant, polyoxyethylene alkyl ether, polyoxyethylene alkyl phenyl ether, polyoxyethylene alkyl ester, and polyoxyethylene sorbitan fatty acid ester.

Examples of acetylene glycol surfactants include 2,4,7,9-tetramethyl-5-desine-4,7-diol, 3,6-dimethyl-4-octine-3,6-diol, and 3,5-dimethyl-1-hexin-3-ol. For example, the following acetylene glycol surfactants are available as commercialized products: Surfynol 104, 82, 465, 485, TG (Air Products and Chemicals, Inc.).

Examples of amphoteric surfactants include lauryl amino propionate, lauryl dimethyl betaine, stearyl dimethyl betaine, and lauryl dihydroxyethyl betaine. More specifically, examples of amphoteric surfactants include lauryl dimethyl amine oxide, myristyl dimethyl amine oxide, stearyl dimethyl amine oxide, dihydroxyethyl lauryl amine oxide, polyoxyethylene coconut oil alkyldimethyl amine oxide, dimethylalkyl (coconut) betaine, and dimethyl lauryl betaine.

Especially, surfactants represented by chemical formulas (I), (II), (III), (IV), (V), and (VI) shown below are preferable.

$$R1\text{-}O\text{—}(CH_2CH_2O)hCH_2COOM \quad (I)$$

In chemical formula (I), R1 indicates an alkyl group with 6-14 carbon atoms. The alkyl group may be branched. h is an integer between 3 and 12. M indicates alkali metal ion, quaternary ammonium, quaternary phosphonium, or alkanolamine.

$$\begin{array}{l} \quad\;\; CH_2COO\text{—}R^2 \\ \quad\;\; | \\ MO_3SCHCOO\text{—}R^2 \end{array} \quad (II)$$

In chemical formula (II), R2 indicates an alkyl group with 5-16 carbon atoms. The alkyl group may be branched. M indicates alkali metal ion, quaternary ammonium, quaternary phosphonium, or alkanolamine.

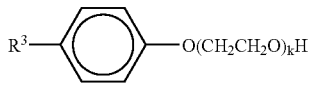

(III)

In chemical formula (III), R3 indicates a hydrocarbon radical, for example, an alkyl group with 6-14 carbon atoms. The alkyl group may be branched. k is an integer between 5 and 20.

$$R4\text{-}(OCH_2CH_2)jOH \quad (IV)$$

In chemical formula (IV), R4 indicates a hydrocarbon radical, for example, an alkyl group with 6-14 carbon atoms. j is an integer between 5 and 20.

$$\begin{array}{l} \quad\quad\quad\quad\quad\quad\quad\quad\quad\quad CH_3 \\ \quad\quad\quad\quad\quad\quad\quad\quad\quad\quad | \\ H\text{—}(OCH_2CH_2)_L\text{—}(OCHCH_2)_P\text{—}R^6 \end{array} \quad (V)$$

In chemical formula (V), R6 indicates a hydrocarbon radical, for example, an alkyl group with 6-14 carbon atoms. The alkyl group may be branched. L and p are integers between 1 and 20.

(VI)

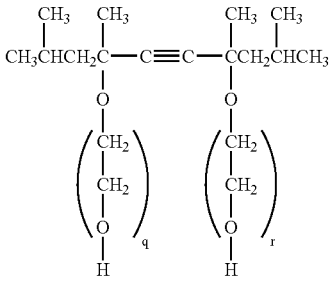

In chemical formula (VI), q and r are integers between 0 and 40.

The surfactants represented by chemical formulas (I) and (II) are shown in free acid forms below.

$$CH_3(CH_2)_{12}O(CH_2CH_2O)_3CH_2COOH \quad (I\text{-}1)$$

$$CH_3(CH_2)_{12}O(CH_2CH_2O)_4CH_2COOH \quad (I\text{-}2)$$

$$CH_3(CH_2)_{12}O(CH_2CH_2O)_5CH_2COOH \quad (I\text{-}3)$$

$$CH_3(CH_2)_{12}O(CH_2CH_2O)_6CH_2COOH \quad (I\text{-}4)$$

(I-5):

$$CH_3(CH_2)_{11}\underset{\underset{CH_3}{|}}{C}HO(CH_2CH_2O)_6CH_2COOH$$

(I-6):

$$CH_3(CH_2)_6\underset{\underset{(CH_2)_5CH_3}{|}}{C}HO(CH_2CH_2O)_3CH_2COOH$$

(II-1):

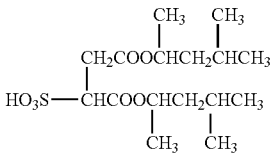

(II-2):

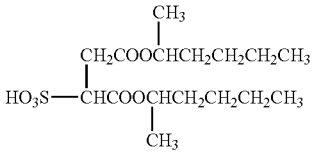

(II-3):

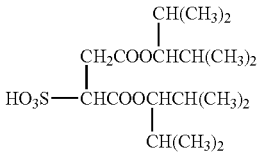

(II-4):

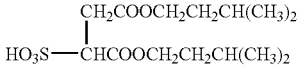

A fluorinated surfactant represented by chemical formula (A) below is preferably used.

$$CF_3CF_2(CF_2CF_2)m'CH_2CH_2O(CH_2CH_2O)nH \quad (A)$$

In chemical formula (A), m indicates an integer between 0 and 10, and n indicates an integer between 1 and 40.

Examples of fluorinated surfactant include a perfluoroalkyl sulfonic acid compound, a perfluoroalkyl carvone compound, a perfluoroalkyl phosphoric ester compound, a perfluoroalkyl ethylene oxide adduct, and a polyoxyalkylene ether polymer compound having a perfluoroalkylether group as a side chain.

Among them, a polyoxyalkylene ether polymer compound having a perfluoroalkylether group as a side chain has a low foaming property and a low fluorine compound bioaccumulation potential and is therefore especially preferable in terms of safety.

Examples of perfluoroalkyl sulfonic acid compounds include perfluoroalkyl sulfonic acid and perfluoroalkyl sulfonate.

Examples of perfluoroalkyl carvone compounds include perfluoroalkyl carboxylic acid and perfluoroalkyl carboxylate.

Examples of perfluoroalkyl phosphoric ester compounds include perfluoroalkyl phosphoric ester and salt of perfluoroalkyl phosphoric ester.

Examples of polyoxyalkylene ether polymer compounds having a perfluoroalkylether group as a side chain include a polyoxyalkylene ether polymer having a perfluoroalkylether group as a side chain, a sulfate ester salt of a polyoxyalkylene ether polymer having a perfluoroalkylether group as a side chain, and a salt of a polyoxyalkylene ether polymer having a perfluoroalkylether group as a side chain.

Counter ions of salts in the above fluorinated surfactants include Li, Na, K, NH4, NH3CH2CH2OH, NH2(CH2CH2OH)2, and NH(CH2CH2OH)3.

Fluorinated surfactants created for the present invention or those available as commercial products may be used.

Commercially available fluorinated surfactants include Surflon S-111, S-112, S-113, S-121, S-131, S-132, S-141, S-145 (Asahi Glass Co., Ltd.); Fluorad FC-93, FC-95, FC-98, FC-129, FC-135, FC-170C, FC-430, FC-431 (Sumitomo 3M Limited); Megafac F-470, F1405, F-474(Dainippon Ink and Chemicals, Incorporated); Zonyl TBS, FSP, FSA, FSN-100, FSN, FSO-100, FSO, FS-300, UR (DuPont); FT-110, FT-250, FT-251, FT-400S, FT-150, FT-400SW (NEOS Co. Ltd.); and PF-151N (Omnova Solutions, Inc.). Among them, in terms of reliability and color development, Zonyl FSN, FSO-100, and FSO (DuPont) are especially preferable.

Examples of other components in an ink include, but are not limited to, a resin emulsion, a pH adjuster, an antiseptic or a fungicide, a rust inhibitor, an antioxidant, an ultraviolet absorber, an oxygen absorber, and a light stabilizer.

A resin emulsion is made by dispersing resin microparticles in water as a continuous phase and may contain a dispersing agent such as a surfactant.

The mass percentage of the resin microparticles as a component of the disperse phase in a resin emulsion is preferably between 10 and 70%. The average particle diameter of the resin microparticles, especially for ink jet recording apparatuses, is preferably between 10 and 1000 nm, and more preferably between 20 and 300 nm.

Examples of resin microparticle materials include, but not limited to, acrylic resin, vinyl acetate resin, styrene resin, butadiene resin, styrene-butadiene resin, vinyl chloride resin, styrene-acrylic resin, and acrylic silicone resin. Especially, acrylic silicone resin is preferable.

Resin emulsions created for the present invention or those available as commercial products may be used.

Examples of commercially available resin emulsions include Microgel E-1002, E-5002 (styrene-acrylic resin emulsion, Nippon Paint Co., Ltd.); VONCOAT 4001 (acrylic resin emulsion, Dainippon Ink and Chemicals, Incorporated); VONCOAT 5454 (styrene-acrylic resin emulsion, Dainippon Ink and Chemicals, Incorporated); SAE-1014 (styrene-acrylic resin emulsion, ZEON Corporation); Saibinol SK-200 (acrylic resin emulsion, Saiden Chemical Industry Co., Ltd.); Primal AC-22, AC-61 (acrylic resin emulsion, Rohm and Haas Company); Nanocryl SBCX-2821, 3689 (acrylic silicone resin, Toyo Ink Mfg. Co., Ltd.); and #3070 (methyl methacrylate polymer resin emulsion, Mikuni Color Ltd.).

The mass percentage of the resin microparticles in a resin emulsion is preferably between 0.1 and 50%, more preferably between 0.5 and 20%, and further preferably between 1 and 10%. When the mass percentage of the resin microparticles is less than 0.1%, the resin emulsion may not be able to prevent clogging or may not be able to improve spray stability. When the mass percentage of the resin microparticles is more than 50%, the preservation stability of the ink may be reduced.

Examples of antiseptics or fungicides include 1,2-benzisothiazolin-3-on, sodium dehydroacetate, sodium sorbate, 2-pyridinethiol-1-oxide sodium, sodium benzoate, and pentachlorophenol sodium.

Any pH adjuster that does not have negative effects on an ink and adjust the pH of an ink to 7 or higher may be used depending on the purpose.

Examples of pH adjusters include amines such as diethanolamine and triethanolamine; hydroxides of alkali metals such as lithium hydroxide, sodium hydroxide, and potassium hydroxide; and carbonates of alkali metals such as ammonium hydroxide, quaternary ammonium hydroxide, quaternary phosphonium hydroxide, lithium carbonate, sodium carbonate, and potassium carbonate.

Examples of rust inhibitors include acidic sulfite, sodium thiosulfate, ammonium thiodiglycolic acid, diisopropyl ammonium nitrite, pentaerythritol tetranitrate, and dicyclohexyl ammonium nitrite.

As antioxidants, phenolic antioxidants (including hindered phenol antioxidants), amine antioxidants, sulfur antioxidants, and phosphorus antioxidants may be used.

Examples of phenolic antioxidants (including hindered phenol antioxidants) include butylated hydroxyanisole, 2,6-di-tert-butyl-4-ethylphenol, stearyl-β-(3,5-di-tert-butyl-4-hydroxyphenyl)propionate, 2,2'-methylenebis(4-methyl-6-tert-butylphenol), 2,2'-methylenebis(4-ethyl-6-tert-butylphenol), 4,4'-butylidenbis(3-methyl-6-tert-butylphenol), 3,9-bis[1,1-dimethyl-2-[..-(3-tert-butyl-4-hydroxy-5-methylphenyl)propionyloxyt]ethyl]2,4,8,10-tetraixaspiro[5,5]undecane, 1,1,3-tris(2-methyl-4-hydroxy-5-tert-butylphenyl)butane, 1,3,5-trimethyl-2,4,6-tris(3,5-di-tert-butyl-4-hydroxybenzyl)benzene, and tetrakis [methylene-3(3',5'-di-tert-butyl-4'-hydroxyphenyl) propionate]methane.

Examples of amine antioxidants include phenyl-..-naphthylamine, ..-naphthylamine, N,N'-di-sec-butyl-p-phenylenediamine, N,N'-diphenyl-p-phenylenediamine, 2,6-di-tert-butyl-p-cresol, 2,6-di-tert-butylphenol, 2,4-dimethyl-6-tert-butyl-phenol, butylhydroxyanisol, 2,2'-methylenebis(4-methyl-6-tert-butylphenol), 4,4'-butylidenbis(3-methyl-6-tert-butylphenol), 4,4'-thiobis(3-methyl-6-tert-butylphenol), tetrakis[methylene-3(3,5-di-tert-butyl-4-dihydroxyphenyl) propionate]methane, and 1,1,3-tris(2-methyl-4-hydroxy-5-tert-butylphenyl)butane.

Examples of sulfur antioxidants include dilauryl3,3'-thiodipropionate, distearyl thiodipropionate, lauryl stearyl thiodipropionate, dimyristyl3,3'-thiodipropionate, distearyl..,..'-thiodipropionate, 2-mercaptobenzoimidazole, and dilauryl sulfide.

Examples of phosphorus antioxidants include triphenyl phosphite, octadecyl phosphite, triisodecyl phosphite, trilauryl trithiophosphite, and trinonyl phenyl phosphate.

Examples of ultraviolet absorbers include a benzophenone ultraviolet absorber, a benzotriazole ultraviolet absorber, a salicylate ultraviolet absorber, a cyanoacrylate ultraviolet absorber, and a nickel complex salt ultraviolet absorber.

Examples of benzophenone ultraviolet absorbers include 2-hydroxy-4-n-octoxybenzophenone, 2-hydroxy-4-n-dodecyloxy benzophenone, 2,4-dihydroxybenzophenone, 2-hydroxy-4-methoxybenzophenone, and 2,2',4,4'-tetrahydroxybenzophenone.

Examples of benzotriazole ultraviolet absorbers include 2-(2'-hydroxy-5'-tert-octylphenyl)benzotriazole, 2-(2'-hydroxy-5'-methylphenyl)benzotriazole, 2-(2'-hydroxy-4'-octoxyphenyl)benzotriazole, and 2-(2'-hydroxy-3'-tert-butyl-5'-methylphenyl)-5-chlorobenzotriazole.

Examples of salicylate ultraviolet absorbers include phenyl salicylate, p-tert-butylphenylsalicylate, and p-octylphenylsalicylate.

Examples of cyanoacrylate ultraviolet absorbers include ethyl-2-cyano-3,3'-diphenylacrylate, methyl-2-cyano-3-methyl-3-(p-methoxyphenyl)acrylate, and butyl-2-cyano-3-methyl-3-(p-methoxyphenyl)acrylate.

Examples of nickel complex salt ultraviolet absorbers include nickelbis(octylphenyl)sulfide, 2,2'-tiobis(4-tert-octylphalate)-n-butylaminenickel(II), 2,2'-tiobis(4-tert-octylphalate)-2-ethylhexylaminenickel(II), and 2,2'-tiobis(4-tert-octylphalate)triethanolaminenickel(II).

An ink according to an embodiment of the present invention contains at least water, a colorant, and a humectant, and may also include a penetrant, a surfactant, and other components. To prepare an ink, the above components are dispersed or dissolved in an aqueous medium. The solution may be stirred if needed. To disperse the components, for example, a sand mill, a homogenizer, a ball mill, a paint shaker, or an ultrasound dispersing machine may be used. To stir the solution, a normal stirring machine having stirring blades, magnetic stirrer, or a high-speed dispersing machine may be used.

At a temperature of 25° C., the viscosity of an ink is preferably between 1 and 30 cPs, and more preferably between 2 and 20 cPs. When the viscosity is higher than 20 cPs, spray stability may be reduced. The pH of an ink is preferably between 7 and 10.

Colors of inks include, but not limited to, yellow, magenta, cyan, and black. A multi-color image can be formed with two or more color inks. A full-color image can be formed with the four color inks.

It is noted that when the surface tension of the recording material (ink) is not within the above-described preferred value range, problems such as beading and ink droplet malformation may occur in a recording (printing) operation. Problems related to beading may be particularly prominent when a recording medium with low ink absorbability is used, for example. According to an embodiment of the present invention, and imaging method as is described above and a recording material as is described above may be used to obtain a printed image with desirable image quality.

Also, by using the above-described imaging method, recording medium, image forming apparatus, and recording material, dot impact position irregularities may be reduced, and even if such irregularities occur, such faults may be dispersed throughout the printed image so that a high quality image may be obtained.

In the following, specific embodiments of the present invention are described.

It is noted that the specific embodiments described below relate to preparing inks according to embodiments of the present invention, fabricating a base material of a recording medium, fabricating a recording medium, using the above items to form (record) an image by implementing an imaging method according to an embodiment of the present invention in an image forming apparatus, and evaluating characteristics related to image formation.

However, the present invention is not limited to the specific embodiments described below.

PREPARATION EXAMPLE 1

Preparation of Dispersion of Polymer Microparticles Containing Copper Phthalocyanine Pigment To prepare a dispersion of polymer microparticles containing a copper phthalocyanine pigment, the air in a 1 L flask with a mechanical stirrer, a thermometer, a nitrogen gas inlet tube, a reflux tube, and a dropping funnel was replaced sufficiently with nitrogen gas; the 1 L flask was charged with 11.2 g of styrene, 2.8 g of acrylic acid, 12.0 g of lauryl methacrylate, 4.0 g of polyethylene glycol methacrylate, 4.0 g of styrene macromer (Toagosei Co., Ltd., brand name: AS-6), and 0.4 g of mercaptoethanol; and the temperature was raised to 65° C. Then, a mixed solution of 100.8 g styrene, 25.2 g of acrylic acid, 108.0 g of lauryl methacrylate, 36.0 g of polyethylene glycol methacrylate, 60.0 g of hydroxyethyl methacrylate, 36.0 g of styrene macromer (Toagosei Co., Ltd., brand name: AS-6), 3.6 g of mercaptoethanol, 2.4 g of azobisdimethylvaleronitrile, and 18.0 g of methyl ethyl ketone was dripped into the 1 L flask for 2.5 hours.

After the dripping was completed, a mixed solution of 0.8 g of azobisdimethylvaleronitrile and 18.0 g of methyl ethyl ketone was dripped into the 1 L flask for 0.5 hours. The resulting solution was matured for 1 hour at the temperature of 65° C., 0.8 g of azobisdimethylvaleronitrile was added to the solution, and then the solution was matured further for 1 hour. After the reaction stopped, 364 g of methyl ethyl ketone was put into the 1 L flask. As a result, 800 g of polymer solution with a concentration of 50 mass % was obtained. A portion of the obtained polymer solution was dried and its weight-average molecular weight (Mw) was measured by gel permeation chromatography (standard: polystyrene, solvent: tetrahydrofuran). The weight-average molecular weight was 15,000.

Next, 28 g of the obtained polymer solution, 26 g of copper phthalocyanine pigment, 13.6 g of 1 mol/L potassium hydroxide solution, 20 g of methyl ethyl ketone, and 30 g of ion-exchanged water were mixed and stirred sufficiently. The resulting substance was kneaded 20 times using the Tripole Roll Mill (Noritake Co., Limited, brand name: NR-84A). The obtained paste was put in 200 g of ion-exchanged water and stirred. Methyl ethyl ketone and water in the liquid was distilled away by using an evaporator. As a result, 160 g of polymer microparticle dispersion with a cyan color was obtained. The solid content of the polymer microparticle dispersion was 20.0 mass %.

The average particle diameter (D50%) of the polymer microparticles in the polymer microparticle dispersion was measured with a particle size distribution analyzer (Microtrac UPA, Nikkiso Co., Ltd.). The average particle diameter was 93 nm.

PREPARATION EXAMPLE 2

Preparation of Dispersion of Polymer Microparticles Containing Dimethyl Quinacridone Pigment A polymer microparticle dispersion with magenta color was prepared in substantially the same manner as the preparation example 1, except that C. I. Pigment Red 122 was used instead of a copper phthalocyanine pigment.

The average particle diameter (D50%) of the polymer microparticles in the polymer microparticle dispersion was measured with a particle size distribution analyzer (Microtrac UPA, Nikkiso Co., Ltd.). The average particle diameter was 127 nm.

PREPARATION EXAMPLE 3

Preparation of Dispersion of Polymer Microparticles Containing Monoazo Yellow Pigment A polymer microparticle dispersion with a yellow color was prepared in substantially the same manner as the preparation example 1, except that C. I. Pigment Yellow 74 was used instead of a copper phthalocyanine pigment.

The average particle diameter (D50%) of the polymer microparticles in the polymer microparticle dispersion was measured with a particle size distribution analyzer (Microtrac UPA, Nikkiso Co., Ltd.). The average particle diameter was 76 nm.

PREPARATION EXAMPLE 4

Preparation of Dispersion of Carbon Black Processed with Sulfonating Agent

To prepare a carbon black dispersion, 150 g of a commercially available carbon black pigment (Printex #85, Degussa) was mixed in 400 ml of sulfolane; the solution was microdispersed with a beads mill; 15 g of amidosulfuric acid was added to the solution; and then the solution was stirred for 10 hours at 140-150° C. The obtained slurry was put in 1000 ml of ion-exchanged water, and the solution was centrifuged at 12,000 rpm. As a result, a surface-treated carbon black wet cake was obtained. The obtained carbon black wet cake was dispersed again in 2,000 ml of ion-exchanged water; the pH of the solution was adjusted with lithium hydroxide; the solution was desalted/condensed using a ultrafilter; and then the solution was filtered with a nylon filter with an average pore diameter of 1 μm. As a result, a black carbon dispersion with a pigment concentration of 10 mass % was obtained.

The average particle diameter (D50%) of the microparticles in the carbon black dispersion was measured with a particle size distribution analyzer (Microtrac UPA, Nikkiso Co., Ltd.). The average particle diameter was 80 nm.

PRODUCTION EXAMPLE 1

Production of Cyan Ink

To produce a cyan ink, 20.0 mass % of the dispersion of polymer microparticles containing a copper phthalocyanine pigment prepared in the preparation example 1, 23.0 mass % of 3-methyl-1,3-butanediol, 8.0 mass % of glycerin, 2.0 mass % of 2-ethyl-1,3-hexanediol, 2.5 mass % of FS-300 (DuPont) used as a fluorinated surfactant, 0.2 mass % of Proxel LV (Avecia KK) used as an antiseptic or a fungicide, 0.5 mass % of 2-amino-2-ethyl-1,3-propanediol, and a certain amount of ion-exchanged water were mixed (100 mass % in total); and the mixture was filtered using a membrane filter with an average pore diameter of 0.8 μm.

PRODUCTION EXAMPLE 2

Production of Magenta Ink

To produce a magenta ink, 20.0 mass % of the dispersion of polymer microparticles containing a dimethyl quinacridone pigment prepared in the preparation example 2, 22.5 mass % of 3-methyl-1,3-butanediol, 9.0 mass % of glycerin, 2.0 mass % of 2-ethyl-1,3-hexanediol, 2.5 mass % of FS-300 (DuPont) used as a fluorinated surfactant, 0.2 mass % of Proxel LV (Avecia KK) used as an antiseptic or a fungicide, 0.5 mass % of 1-amino-2,3-propanediol, and a certain amount of ion-exchanged water were mixed (100 mass % in total); and the mixture was filtered using a membrane filter with an average pore diameter of 0.8 μm.

PRODUCTION EXAMPLE 3

Production of Yellow Ink

To produce a yellow ink, 20.0 mass % of the dispersion of polymer microparticles containing a monoazo yellow pigment prepared in the preparation example 3, 24.5 mass % of 3-methyl-1,3-butanediol, 8 mass % of glycerin, 2.0 mass % of 2-ethyl-1,3-hexanediol, 2.5 mass % of FS-300 (DuPont) used as a fluorinated surfactant, 0.2 mass % of Proxel LV (Avecia KK) used as an antiseptic or a fungicide, 0.5 mass % of 2-amino-2-methyl-1,3-propanediol, and a certain amount of ion-exchanged water were mixed (100 mass % in total); and the mixture was filtered using a membrane filter with an average pore diameter of 0.8 μm.

PRODUCTION EXAMPLE 4

Production of Black Ink

To produce a black ink, 20.0 mass % of the carbon black dispersion prepared in the preparation example 4, 22.5 mass % of 3-methyl-1,3-butanediol, 7.5 mass % of glycerin, 2.0 mass % of 2-pyrrolidone, 2.0 mass % of 2-ethyl-1,3-hexanediol, 2.5 mass % of FS-300 (DuPont) used as a fluorinated surfactant, 0.2 mass % of Proxel LV (Avecia KK) used as an antiseptic or a fungicide, 0.2 mass % of choline, and a certain amount of ion-exchanged water were mixed (100 mass % in total); and the mixture was filtered using a membrane filter with an average pore diameter of 0.8 μm.

PRODUCTION EXAMPLE 5

Production of Cyan Ink

To produce a cyan ink, 20.0 mass % of the dispersion of polymer microparticles containing a copper phthalocyanine pigment prepared in the preparation example 1, 23.0 mass % of 3-methyl-1,3-butanediol, 8.0 mass % of glycerin, 2.0 mass % of 2-ethyl-1,3-hexanediol, 0.2 mass % of Proxel LV (Avecia KK) used as an antiseptic or a fungicide, 0.5 mass % of 2-amino-2-ethyl-1,3-propanediol, and a certain amount of ion-exchanged water were mixed (100 mass % in total); and the mixture was filtered using a membrane filter with an average pore diameter of 0.8 μm.

PRODUCTION EXAMPLE 6

Production of Magenta Ink

To produce a magenta ink, 20.0 mass % of the dispersion of polymer microparticles containing a dimethyl quinacridone pigment prepared in the preparation example 2, 22.5 mass % of 3-methyl-1,3-butanediol, 9.0 mass % of glycerin, 2.0 mass % of 2-ethyl-1,3-hexanediol, 0.2 mass % of Proxel LV (Avecia KK) used as an antiseptic or a fungicide, 0.5 mass % of 2-amino-2-ethyl-1,3-propanediol, and a certain amount of ion-exchanged water were mixed (100 mass % in total); and the mixture was filtered using a membrane filter with an average pore diameter of 0.8 μm.

PRODUCTION EXAMPLE 7

Production of Yellow Ink

To produce a yellow ink, 20.0 mass % of the dispersion of polymer microparticles containing a monoazo yellow pigment prepared in the preparation example 3, 24.5 mass % of 3-methyl-1,3-butanediol, 8 mass % of glycerin, 2.0 mass % of 2-ethyl-1,3-hexanediol, 0.2 mass % of Proxel LV (Avecia KK) used as an antiseptic or a fungicide, 0.5 mass % of 2-amino-2-ethyl-1,3-propanediol, and a certain amount of ion-exchanged water were mixed (100 mass % in total); and the mixture was filtered using a membrane filter with an average pore diameter of 0.8 μm.

PRODUCTION EXAMPLE 8

Production of Black Ink

To produce a black ink, 20.0 mass % of the carbon black dispersion prepared in the preparation example 4, 22.5 mass % of 3-methyl-1,3-butanediol, 7.5 mass % of glycerin, 2.0 mass % of 2-pyrrolidone, 2.0 mass % of 2-ethyl-1,3-hexanediol, 0.2 mass % of Proxel LV (Avecia KK) used as an antiseptic or a fungicide, 0.5 mass % of 2-amino-2-ethyl-1,3-propanediol, and a certain amount of ion-exchanged water were mixed (100 mass % in total); and the mixture was filtered using a membrane filter with an average pore diameter of 0.8 μm.

The surface tensions and viscosities of the inks produced in the production examples 1 through 8 were measured as described below. The results are shown in table 3 below.

<Measurement of Viscosity>

The viscosities of the inks were measured at 25° C. with the R-500 Viscometer of Toki Sangyo Co., Ltd. (cone 1° 34'× R24, 60 rpm, after 3 minutes).

<Measurement of Surface Tension>

The static surface tensions of inks were measured at 25° C. with a surface tensiometer (CBVP-Z of Kyowa Interface Science Co., Ltd.) using a platinum plate.

TABLE 3

| | Viscosity (mPa · s) | Surface tension (mN/m) |
|---|---|---|
| Production example 1 | 8.05 | 25.4 |

TABLE 3-continued

| | Viscosity (mPa · s) | Surface tension (mN/m) |
|---|---|---|
| Production example 2 | 8.09 | 25.4 |
| Production example 3 | 8.11 | 25.7 |
| Production example 4 | 8.24 | 25.4 |
| Production example 5 | 8.02 | 37.5 |
| Production example 6 | 8.06 | 37.6 |
| Production example 7 | 8.08 | 37.8 |
| Production example 8 | 8.16 | 37.4 |

Production of Base Material

A base material with a grammage of 79 g/m$^2$ was produced using a fourdrinier from 0.3 mass % slurry made of materials in the formula below. In the size press step of the papermaking process, an oxidized starch solution was applied on the base material. The solid content of the oxidized starch on the base material was 1.0 g/m$^2$.

| | |
|---|---|
| Leaf bleached kraft pulp (LBKP) | 80 mass % |
| Needle bleached kraft pulp (NBKP) | 20 mass % |
| Precipitated calcium carbonate (brand name: TP-121, Okutama Kogyo Co., Ltd.) | 10 mass % |
| Aluminum sulfate | 1.0 mass % |
| Amphoteric starch (brand name: Cato3210, Nippon NSC Ltd.) | |
| Neutral rosin size (brand name: NeuSize M-10, Harima Chemicals, Inc.) | 0.3 mass % |
| Retention aid (brand name: NR-11LS, HYMO Co., Ltd.) | 0.02 mass % |

PRODUCTION EXAMPLE 9

Production of Recording Medium 1

A coating liquid with a solid content concentration of 60 mass % was produced by mixing 70 mass % of clay used as a pigment in which clay 97 mass % of particles have a diameter of 2 μm or smaller; 30 mass % of heavy calcium carbonate with an average particle diameter of 1.1 μm; 8 mass % of styrene-butadiene copolymer emulsion, used as an adhesive, with a glass-transition temperature (Tg) of −5° C.; 1 mass % of phosphoric esterified starch; 0.5 mass % of calcium stearate used as an aid; and water.

To produce the recording medium 1, the obtained coating liquid was applied on both sides of the above base material so that 8 g/m$^2$ of solid content of the coating liquid adheres to each side using a blade coater; and the base material was dried by hot air and supercalendered.

PRODUCTION EXAMPLE 10

Production of Recording Medium 2

A coating liquid with a solid content concentration of 60 mass % was produced by mixing 70 mass % of clay used as a pigment in which clay 97 mass % of particles have a diameter of 2 μm or smaller; 30 mass % of heavy calcium carbonate with an average particle diameter of 1.1 μm; 7 mass % of styrene-butadiene copolymer emulsion, used as an adhesive, with a glass-transition temperature (Tg) of −5° C.; 0.7 mass % of phosphoric esterified starch; 0.5 mass % of calcium stearate used as an aid; and water.

To produce the recording medium 2, the obtained coating liquid was applied on both sides of the above base material so that 8 g/m$^2$ of solid content of the coating liquid adheres to each side using a blade coater; and the base material was dried by hot air and supercalendered.

First Embodiment

Ink Set, Recording Medium, and Image Recording

By a conventional method, an ink set 1 made up of the cyan ink produced in the production example 1, the magenta ink produced in the production example 2, the yellow ink produced in the production example 3, and the black ink produced in the production example 4 was prepared.

Images were printed on the recording medium 1 with the ink set 1 (largest ink drop size: 18 pl) at an image resolution of 600 dpi using a 300 dpi image forming apparatus having nozzles with a nozzle resolution of 384 according to an embodiment of the present invention. The total amount of ink per unit area for a secondary color was limited to 140% and solid-color images and characters were formed.

COMPARATIVE EXAMPLE 1

Ink Set, Recording Medium, and Image Recording

Images were formed in substantially the same manner as the first embodiment, except that a commercially available coated paper for offset printing (brand name: Aurora Coat, grammage=104.7 g/m$^2$, Nippon Paper Industries Co., Ltd.) was used as a recording medium.

COMPARATIVE EXAMPLE 2

Ink Set, Recording Medium, and Image Recording

Images were formed in substantially the same manner as the first embodiment, except that a commercially available matt coated paper for ink jet printing (brand name: Superfine, Seiko Epson Corporation) was used as a recording medium.

Second Embodiment

Ink Set, Recording Medium, and Image Recording

Images were formed in substantially the same manner as the first embodiment, except that the recording medium 2 was used as a recording medium.

Third Embodiment

Ink Set, Recording Medium, and Image Recording

Images were formed in substantially the same manner as the first embodiment, except that a commercially available coated paper for gravure printing (brand name: Space DX, grammage=56 g/m$^2$, Nippon Paper Industries Co., Ltd.) (hereafter called a recording medium 3) was used as a recording medium.

COMPARATIVE EXAMPLE 3

Ink Set, Recording Medium, and Image Recording

Images were formed in substantially the same manner as the first embodiment, except that an ink set 2 made up of the cyan ink produced in the production example 5, the magenta ink produced in the production example 6, the yellow ink produced in the production example 7, and the black ink produced in the production example 8 was used.

COMPARATIVE EXAMPLE 4

Ink Set, Recording Medium, and Image Recording

Images were formed in substantially the same manner as the first embodiment, except that the ink set 2 and a commercially available coated paper for offset printing (brand name: Aurora Coat, grammage=104.7 g/m$^2$, Nippon Paper Industries Co., Ltd.) were used instead of the ink set 1 and the recording medium 1.

COMPARATIVE EXAMPLE 5

Ink Set, Recording Medium, and Image Recording

Images were formed in substantially the same manner as the first embodiment, except that the ink set 2 and a commercially available matt coated paper for ink jet printing (brand name: Superfine, Seiko Epson Corporation) were used instead of the ink set 1 and the recording medium 1.

COMPARATIVE EXAMPLE 6

Ink Set, Recording Medium, and Image Recording

Images were formed in substantially the same manner as the first embodiment, except that the ink set 2 and the recording medium 2 were used instead of the ink set 1 and the recording medium 1.

For each of the recording medium 1, the recording medium 2, the recording medium 3, and the recording media used in the comparative examples 4 and 5, the amount of transferred pure water and the amount of transferred cyan ink produced in the production example 1 were measured as described below using a dynamic scanning absorptometer. The results are shown in table 4.

Also, for each of the recording medium 1, the recording medium 2, and the recording media used in the comparative examples 4 and 5, the amount of transferred cyan ink produced in the production example 5 was measured as described below using a dynamic scanning absorptometer. The results are shown in table 5.

<Measurement of Amounts of Transferred Pure Water and Cyan Ink with Dynamic Scanning Absorptometer>

For each of the above recording media, the amounts of transferred pure water and cyan ink were measured using a dynamic scanning absorptometer (K350 series, type D, Kyowa Co., Ltd.). The amounts of transferred pure water and cyan ink at a contact time of 100 ms and 400 ms were obtained by interpolation, using the transferred amounts measured at time points around each contact time.

TABLE 4

| | Pure water | | Cyan ink (production example 1) | |
|---|---|---|---|---|
| Recording media | Contact time: 100 ms | Contact time: 400 ms | Contact time: 100 ms | Contact time: 400 ms |
| Recording medium 1 | 10.1 ml/m$^2$ | 20.2 ml/m$^2$ | 7.2 ml/m$^2$ | 14.8 ml/m$^2$ |
| Recording medium 2 | 25.2 ml/m$^2$ | 28.5 ml/m$^2$ | 14.6 ml/m$^2$ | 19.4 ml/m$^2$ |
| Recording medium 3 | 10.4 ml/m$^2$ | 21.8 ml/m$^2$ | 6.4 ml/m$^2$ | 8.8 ml/m$^2$ |
| Comparative example 4 | 2.8 ml/m$^2$ | 3.4 ml/m$^2$ | 2.7 ml/m$^2$ | 3.1 ml/m$^2$ |
| Comparative example 5 | 41.0 ml/m$^2$ | 44.8 ml/m$^2$ | 38.1 ml/m$^2$ | 46.2 ml/m$^2$ |

TABLE 5

| | Cyan ink (production example 5) | |
|---|---|---|
| Recording media | Contact time: 100 ms | Contact time: 400 ms |
| Recording medium 1 | 2.7 ml/m$^2$ | 4.1 ml/m$^2$ |
| Recording medium 2 | 3.8 ml/m$^2$ | 5.6 ml/m$^2$ |
| Comparative example 4 | 0.6 ml/m$^2$ | 0.9 ml/m$^2$ |
| Comparative example 5 | 31.3 ml/m$^2$ | 36.8 ml/m$^2$ |

The quality of the images printed in the first through third embodiments and the comparative examples 1 through 6 were evaluated in terms of beading, bleeding, spur marks, and glossiness. The results are shown in table 6.

<Beading>

The degree of beading in the printed green solid-color image was evaluated by eye observation according to the evaluation criteria below.

[Evaluation Criteria]

AA: No beading is observed and image is evenly printed.

BB: Beading is slightly observed.

CC: Beading is clearly observed.

DD: Excessive beading is observed.

<Bleeding>

The degree of bleeding of the printed black characters in the yellow background was evaluated by eye observation according to the evaluation criteria below.

[Evaluation Criteria]

AA: No bleeding is observed and characters are clearly printed.

BB: Bleeding is slightly observed.

CC: Bleeding is clearly observed.

DD: Excessive bleeding is observed and outlines of characters are blurred.

<Spur Marks>

The degree of spur marks in the printed images was evaluated by eye observation according to the evaluation criteria below.

[Evaluation Criteria]

AA: No spur mark is observed.

BB: Spur marks are observed slightly.

CC: Spur marks are clearly observed.DD: Excessive spur marks are observed.

<Glossiness>

The degree of glossiness of the printed images was evaluated by eye observation according to the evaluation criteria below.

[Evaluation Criteria]

AA: Images are highly glossy.

BB: Images are glossy.

CC: Images are not glossy.

TABLE 6

| | Beading | Bleeding | Spur mark | Glossiness |
|---|---|---|---|---|
| First embodiment | BB | BB | BB | BB |
| Second embodiment | AA | AA | AA | BB |
| Third embodiment | BB | BB | BB | AA |
| Comparative Example 1 | DD | CC | DD | BB |
| Comparative Example 2 | AA | AA | AA | CC |
| Comparative Example 3 | DD | DD | DD | BB |
| Comparative Example 4 | CC | CC | CC | BB |
| Comparative Example 5 | DD | DD | DD | BB |
| Comparative Example 6 | AA | AA | AA | CC |

As can be appreciated from the above table, each of the first through third embodiments uses as an ink-recording medium set an ink containing at least water, a colorant, and a humectant and having a surface tension between 20 and 35 mN/m at 25° C.; and a recording medium characterized in that the amount of ink transferred to the recording medium as measured by a dynamic scanning absorptometer is between 4 and 15 ml/m$^2$ after being in contact with the ink for a contact time of 100 ms, and between 7 and 20 ml/m$^2$ after being in contact with the ink for a contact time of 400 ms. Compared with the ink-recording medium sets used in the comparative examples 1 through 6, the ink-recording medium sets used in the first through third embodiments showed superior evaluation results in terms of beading, bleeding, spur marks, and glossiness.

It is noted that embodiments of the present invention are related to an imaging method for achieving higher image quality in forming an image by combining halftone processing using a linear base tone and multi-pass printing, a computer-readable program enabling a computer to perform such an imaging method, and an image forming apparatus having means for executing such an imaging method.

Also, embodiments of the present invention are related to a computer-readable medium storing the above computer-readable program, a recorded item having information recorded thereon through execution of the above imaging method, an image forming system including the above image forming apparatus, a recording medium that is used by the above image forming apparatus to produce the recorded item, and an ink used in the above image forming apparatus.

According to an embodiment of the present invention, in forming an image by a combination of multi-pass scanning and a halftone process using an orderly arrangement of dots, dots consecutively aligned in the base tone direction and dots consecutively aligned in the sub scanning direction are respectively formed by non-consecutive passes. In this way, errors may be prevented from being concentrated in one group of dots consecutively aligned in the base tone direction, and errors may be prevented from being concentrated in one group of dots consecutively aligned in the sub scanning direction so that the errors may be dispersed throughout the image. As a result, image degradation due to banding or uneven printing may be effectively reduced, for example.

Also, according to a preferred embodiment, the arrangement of dots is configured such that the dot formation scanning interval for each set of adjacent dots with respect to the sub scanning direction is greater than one. In this way, no adjacent dots in the sub scanning direction are formed in consecutive order so that dispersity of the dots may be further improved. It is noted that application of the present embodiment is not limited to a halftone pattern with a line base tone; that is, the above-described advantages may equally be obtained by applying the present embodiment to other types of halftone patterns.

Also, according to another preferred embodiment, a recording medium that is prone to show prominent dot impact position deviations upon having an image printed thereon may be used to effectively achieve the above-described advantages. According to other preferred embodiments, an imaging method according to an embodiment of the present invention may be used in combination with an image forming apparatus and/or a recording material that are configured to reduce the influences of dot impact position deviations to achieve further improvements in image quality, for example.

Although the present invention is shown and described with respect to certain preferred embodiments, it is obvious that equivalents and modifications may occur to others skilled in the art upon reading and understanding the specification. The present invention includes all such equivalents and modifications, and is limited only by the scope of the claims.

The present application is based on and claims the benefit of the earlier filing date of Japanese Patent Application No. 2006-252954 filed on Sep. 19, 2006 and Japanese Patent Application No. 2007-067094 filed on Mar. 15, 2007, the entire contents of which are hereby incorporated by reference.

What is claimed is:

1. An imaging method implemented in an image forming apparatus for forming a tone pattern on a recording medium by forming an arrangement of dots on the recording medium, the arrangement of dots being formed on the recording medium by jetting a recording liquid from a recording head while moving the recording head in a main scanning direction a plurality of times and intermittently conveying the recording medium in a sub-scanning direction that perpendicularly intersects the main scanning direction, the method comprising a step of;

forming the arrangement of dots such that more than one of said dots belonging to a first group that are consecutively aligned in abase tone direction are formed in non-consecutive order on the recording medium and more than one of said dots belonging to second group that are consecutively aligned in the sub scanning direction are formed in non-consecutive order on the recording medium.

2. The imaging method as claimed in claim 1, wherein the dots belonging to the second group that are consecutively aligned in the sub scanning direction are arranged at a dispersity less than or equal to five, the dispersiry being defined as:

dispersity=Σ(dot formation scanning interval−average scanning interval)$^2$/number of scans for dot formation.

3. The imaging method as claimed in claim 1 wherein the arrangement of dots is configured such that a dot formation scanning interval for each set of adjacent dots with respect to the sub scanning direction is greater than one.

4. The imaging method as claimed in claim 1 wherein the arrangement of dots is configured by one or two dot alignments in the sub scanning direction; and the arrangement of dots is configured such that a dot formation scanning interval for each set of adjacent dots with respect to the sub scanning direction is greater than one.

5. The imaging method as claimed in claim 1, wherein the dots belonging to the second group that are consecutively aligned in the sub scanning direction are arranged at a consecutive dispersiry less than or equal to fifteen, the consecutive dispersity being defined as:

consecutive dispersity=Σ(dot formation scanning interval in dot arrangement order−average scanning interval in dot arrangement order)$^2$/number of scans for dot formation.

6. An image forming apparatus that is configured to form a tone pattern on a recording medium by forming an arrangement of dots on the recording medium, the arrangement of dots being formed on the recording medium by jetting a recording liquid from a recording head while moving the recording head in a main scanning direction a plurality of times and intermittently conveying the recording medium in a sub-scanning direction that perpendicularly intersects the main scanning direction, the apparatus comprising:

a control part that executes an imaging method involving forming the arrangement of dots such that more than one of said dots belonging to a first group that are consecutively aligned in a base tone direction are formed in non-consecutive order on the recording medium and more than one of said dots belonging to a second group that are consecutively aligned in the sub scanning direction are formed in non-consecutive order on the recording medium.

7. The image forming apparatus as claimed in claim 6, wherein the dots belonging to the second group that are consecutively aligned in the sub scanning direction are arranged at a dispersity less than or equal to five, the dispersity being defined as:

dispersity=Σ(dot formation scanning interval−average scanning interval)$^2$/number of scans for dot formation.

8. The image forming apparatus as claimed in claim 6, wherein the arrangement of dots is configured such that a dot formation scanning interval for each set of adjacent dots with respect to the sub scanning direction is greater than one.

9. The image forming apparatus as claimed in claim 6, wherein the arrangement of dots is configured by one or two dot alignments in the sub scanning direction; and the arrangement of dots is configured such that a dot formation scanning interval for each set of adjacent dots with respect to the sub scanning direction is greater than one.

10. The image forming apparatus as claimed in claim 6, wherein the clots belonging to the second group that are consecutively aligned in the sub scanning direction are arranged at a consecutive dispersity less than or equal to fifteen, the consecutive dispersity being defined as:

consecutive dispersity=Σ(dot formation scanning interval in dot arrangement order−average scanning interval in dot arrangement order)$^2$/number of scans for dot formation.

11. A computer-readable program, which when executed by a computer, causes the computer to perform an imaging method for forming a tone pattern on a recording medium in an image forming apparatus by forming an arrangement of dots on the recording medium, the arrangement of dots being formed on the recording medium by jetting a recording liquid from a recording head while moving the recording head in a main scanning direction a plurality of times and intermittently conveying the recording medium in a sub-scanning direction that perpendicularly intersects the main scanning direction, the method being characterized by comprising a step of:

forming the arrangement of dots such that more than one of said dots belonging to a first group that are consecutively aligned in a base tone direction are formed in non-consecutive order on the recording medium and more than one of said dots belonging to a second group that are consecutively aligned in the sub scanning direction are formed in non-consecutive order on the recording medium.

12. The computer-readable program as claimed in claim 11, wherein the dots belonging to the second group that are consecutively aligned in the sub scanning direction are arranged at a dispersity less than or equal to five, the dispersity being defined as:

dispersity=Σ(dot formation scanning interval−average scanning interval)$^2$/number of scans for dot formation.

13. The computer-readable program as claimed in claim 11, wherein the dots belonging to the second group that are consecutively aligned in the sub scanning direction are arranged at a consecutive dispersity less than or equal to fifteen, the consecutive dispersity being defined as:

consecutive dispersity=Σ(dot formation scanning interval in dot arrangement order−average scanning interval in dot arrangement order)$^2$/number of scans for dot formation.

* * * * *